US006878510B2

(12) United States Patent
Morimura et al.

(10) Patent No.: US 6,878,510 B2
(45) Date of Patent: Apr. 12, 2005

(54) METHOD OF PROCESSING SILVER HALIDE PHOTOSENSITIVE MATERIAL

(75) Inventors: Kimiyasu Morimura, Minami-Ashigara (JP); Kohzaburoh Yamada, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/658,607

(22) Filed: Sep. 10, 2003

(65) Prior Publication Data

US 2004/0058282 A1 Mar. 25, 2004

(30) Foreign Application Priority Data

Sep. 10, 2002 (JP) ..... 2002-263715

(51) Int. Cl.[7] ..... G03C 5/29; G03C 7/407
(52) U.S. Cl. ..... 430/413; 430/419
(58) Field of Search ..... 430/413, 419

(56) References Cited

U.S. PATENT DOCUMENTS 3,149,970 A * 9/1964 Weyde ..... 430/411
3,206,310 A * 9/1965 Herz ..... 430/415
3,390,998 A * 7/1968 Cole ..... 430/477
5,747,235 A 5/1998 Farid et al.
5,747,236 A 5/1998 Farid et al.
6,010,841 A 1/2000 Farid et al.
6,054,260 A 4/2000 Adin et al.
6,153,371 A 11/2000 Farid et al.
6,306,570 B1 10/2001 Adin et al.
6,689,554 B2 * 2/2004 Yamada et al. ..... 430/600
6,696,215 B2 * 2/2004 Yasuda et al. ..... 430/264
6,787,298 B2 * 9/2004 Goto et al. ..... 430/619
2003/0203329 A1 * 10/2003 Yamada et al. ..... 430/567

FOREIGN PATENT DOCUMENTS

JP 2001-42466 A 2/2001

OTHER PUBLICATIONS

U.S. Appl. No. 10/298,633, filed Nov. 19, 2002.*
U.S. Appl. No. 10/873,382, filed Jun. 23, 2004.*

* cited by examiner

*Primary Examiner*—Hoa Van Le
(74) *Attorney, Agent, or Firm*—Sughrue Mion, PLLC

(57) ABSTRACT

A method of processing, with a developer in which a solution physical development arises, a silver halide photosensitive material containing a compound capable of undergoing a one-electron oxidation to thereby form a one-electron oxidation product thereof which belongs to the following types 1 to 4:

Type 1: the one-electron oxidation product being capable of releasing further two or more electrons accompanying a subsequent bond cleavage reaction;

Type 2: the one-electron oxidation product being capable of releasing further one electron accompanying a subsequent bond cleavage reaction, and the compound having, in its molecule, two or more groups adsorptive to silver halide;

Type 3: the one-electron oxidation product being capable of releasing further one or more electrons after going through a subsequent bond forming reaction; and Type 4: the one-electron oxidation product being capable of releasing further one or more electrons after going through a subsequent intramolecular ring cleavage reaction.

3 Claims, No Drawings

METHOD OF PROCESSING SILVER HALIDE PHOTOSENSITIVE MATERIAL

CROSS-REFERENCE TO RELATED APPLICATIONS

This application is based upon and claims the benefit of priority from the prior Japanese Patent Application No. 2002-263715, filed Sep. 10, 2002, the entire contents of which are incorporated herein by reference.

BACKGROUND OF THE INVENTION

1. Field of the Invention

The present invention relates to a method of processing a silver halide photosensitive material.

2. Description of the Related Art

In recent years, various line-ups of photo-sensitive materials ranging from low speeds to high speeds are provided. For example, with respect to photosensitive materials for photographing, there are those of speed indication ranging from about ISO 25 to ISO 3200. Those of low speed need a high intensity of light and thus are not suitable for snap photographing performed at a high shutter speed, but photographed images are smooth and coarse grains are not pronounced (being excellent in graininess). On the other hand, those of high speed enable photographing without flashlights and thus widen the range of photographing objects, but the graininess of photographed images is conspicuous (being poor in graininess). From an idealistic viewpoint, a high-speed photosensitive material exhibiting excellent graininess is demanded. The cause of the coarse grains of images is the large size of silver halide emulsion grains as a photo-sensitive element and as a responsibility to display elements. Consequently, minimizing the grain size is needed for attaining an enhanced graininess. However, reducing the grain size would cause a speed drop. Thus, a speed increase technology for compensating for the speed drop is required separately. A variety of methods are being employed for increasing the inherent sensitivity of silver halides. For example, a speed increase by a chemical sensitizer such as sulfur, gold or a compound of Group VIII metal, a speed increase by the use of a chemical sensitizer such as sulfur, gold or a compound of Group VIII metal in combination with an additive capable of promoting the sensitizing effect of the chemical sensitizer and a speed increase by the addition of an additive capable of exerting a sensitizing effect depending on the type of silver halide emulsion are being performed. Furthermore, a method of speed increase wherein a so-called reduction sensitizer is added to thereby form reduced silver in the internal part of emulsion or on the surface thereof is well known.

Sensitizing technologies wherein an organic electron-donating compound comprising an electron donating group and a split-off group is employed are reported in the specifications of some patents and the like (for example, U.S. Pat. Nos. 5,747,235, 5,747,236 and 6,054,260; EP No. 786,692A1; EP's 893,731A1 and 893,732A1; and WO 99/05570).

However, when the above organic electron-donating compound was used in the development processing after image-wise exposure in which a processing step by a developer inducing a solution physical development was included, there occurred such a problem that although an effect could be recognized, the degree of speed increase was low and the storability was deteriorated, as compared with those attained in the conventional speed increase method wherein reduction sensitizers were added.

It is reported in Jpn. Pat. Appln. KOKAI Publication No. (hereinafter referred to as JP-A-) 2001-42466 that a storability enhancement can be achieved by the use of an organic electron-donating compound in combination with a specified storage improver. However, results of a follow-up test showed that the effect of storability enhancement was trivial in the development processing step wherein the solution physical development occurred.

BRIEF SUMMARY OF THE INVENTION

It is an object of the present invention to provide a method of processing a silver halide photosensitive material, which method enables enhancing the speed of silver halide photosensitive material and also enhancing the storability thereof. More specifically, it is an object of the present invention to provide a method of processing a silver halide photosensitive material, which method enables enhancing the speed of silver halide photosensitive material requiring a processing by a developer wherein a solution physical development occurs and also enables enhancing the storability thereof.

It is another object of the present invention to provide a silver halide reversal photosensitive material which exhibits high speed and enhanced storability.

The inventors have studied the increasing of speed of silver halide photosensitive material, this photosensitive material requiring a developer inducing a solution physical development in development processing, by the addition of organic electron-donating compounds. As a result, an organic electron-donating compound capable of exhibiting excellent performance in speed and storability as compared with those of conventional compounds has been found. Moreover, it has been found that a further fog decrease and a storability enhancement can be attained by the joint use of a compound having a specified range of oxidation potential for the silver halide photosensitive material.

The above objects have been attained by the method of processing a silver halide photosensitive material as recited in the following item (1) or (2).

Furthermore, the present invention provides silver halide reversal photosensitive materials as recited in the following items (3) to (7). These silver halide reversal photosensitive materials exhibit excellent performance in speed and storability.

(1) A method of processing a silver halide photosensitive material comprising:

processing, with a developer in which a solution physical development arises, the silver halide photosensitive material containing at least one compound selected from the group consisting of compounds of the following types 1 to 4:

(Type 1)

a compound capable of undergoing a one-electron oxidation to thereby form a one-electron oxidation product thereof, wherein the one-electron oxidation product is capable of releasing further two or more electrons accompanying a subsequent bond cleavage reaction;

(Type 2)

a compound capable of undergoing a one-electron oxidation to thereby form a one-electron oxidation product thereof, wherein the one-electron oxidation product is capable of releasing further one electron accompanying a subsequent carbon-carbon bond cleavage reaction, and the compound having, in its molecule, two or more groups adsorptive to silver halide;

(Type 3)

a compound capable of undergoing a one-electron oxidation to thereby form a one-electron oxidation product thereof, wherein the one-electron oxidation product is capable of releasing further one or more electrons after going through a subsequent bond forming reaction; and (Type 4)

a compound capable of undergoing a one-electron oxidation to thereby form a one-electron oxidation product thereof, wherein the one-electron oxidation product is capable of releasing further one or more. electrons after going through a subsequent intramolecular ring cleavage reaction.

Among the compounds belonging to the above types 1 to 4, preferable ones are represented by the following general formulae (1-1) to (4-2). That is, among the compounds belonging to the above type 1, preferable compounds are represented by the following general formula (1-1) or (1-2). Among the compounds belonging to the above type 2, preferable compounds are represented by the following general formula (2).

Among the compounds belonging to the above type 3, preferable compounds are represented by the following general formula (3). Among the compounds belonging to the above type 4, preferable compounds are represented by the following general formula (4-1) or (4-2):

(1-1)

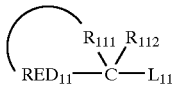

(1-2)

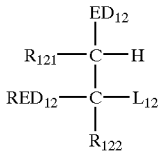

(2)

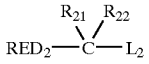

(3)

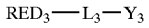

(4-1)

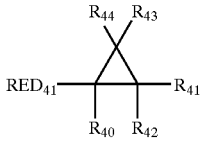

(4-2)

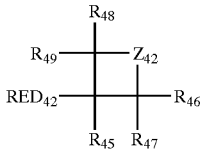

In the general formula (1-1), $RED_{11}$ represents a reducing group; $L_{11}$ represents a split-off group; and $R_{112}$ represents a hydrogen atom or substituent. $R_{111}$ represents a group of nonmetallic atoms capable of forming a cyclic structure corresponding to a tetrahydro form, hexahydro form or octahydro form of a 5-membered or 6-membered aromatic ring (including an aromatic heterocycle) together with the carbon atom (C) and $RED_{11}$.

In the general formula (1-2), $RED_{12}$ and $L_{12}$ have the same meanings as those of $RED_{11}$ and $L_{11}$ of the general formula (1-1), respectively. Each of $R_{121}$ and $R_{122}$ represents a hydrogen atom or substituent capable of substituting on the carbon atom, which may have the same meaning as $R_{112}$ of the general formula (1-1). $ED_{12}$ represents an electron-donating group. In the general formula (1-2), the groups $R_{121}$ and $RED_{12}$, the groups $R_{121}$ and $R_{122}$, or the groups $ED_{12}$ and $RED_{12}$ may be bonded with each other to thereby form a cyclic structure.

In the general formula (2), $RED_2$ has the same meaning as that of $RED_{12}$ of the general formula (1-2); $L_2$ represents a split-off group; each of $R_{21}$ and $R_{22}$ represents a hydrogen atom or substituent; and $RED_2$ and $R_{21}$ may be bonded with each other to thereby form a cyclic structure. The compound represented by the general formula (2) is a compound having, in its molecule, two or more groups adsorptive to silver halide.

In the general formula (3), $RED_3$ has the same meaning as $RED_{12}$ of the general formula (1-2). $Y_3$ represents a reactive group having a carbon-carbon double bond moiety or a carbon-carbon triple bond moiety, which moiety being capable of forming a new bond by reacting with a one-electron oxidized $RED_3$. $L_3$ represents a linking group that links between $RED_3$ and $Y_3$.

In the general formulae (4-1) and (4-2), each of $RED_{41}$ and $RED_{42}$ has the same meaning as $RED_{12}$ of the general formula (1-2). Each of $R_{40}$ to $R_{44}$ and $R_{45}$ to $R_{49}$ represents a hydrogen atom or substituent. In the general formula (4-2), $Z_{42}$ represents —$CR_{420}R_{421}$—, —$NR_{423}$— or —O—. Herein, each of $R_{420}$ and $R_{421}$ represents a hydrogen atom or substituent; and $R_{423}$ represents a hydrogen atom, alkyl group, aryl group or heterocyclic group.

Among the compounds belonging to the above types 1, 3 and 4, preferable ones are "compounds each having, in its molecular, a group adsorptive to silver halide" or "compounds each having, in its molecular, a partial structure of spectral sensitizing dye". More preferable ones are "compounds each having, in its molecular, a group adsorptive to silver halide".

Similarly, among the compounds represented by the general formulae (1-1) to (4-2), preferable ones are "compounds each having, in its molecular, a group adsorptive to silver halide" or "compounds each having, in its molecular, a partial structure of spectral sensitizing dye". More preferable ones are "compounds each having, in its molecular, a group adsorptive to silver halide".

(2) The method of processing a silver halide photosensitive material according to item (1), wherein the compound selected from those of types 1 to 4 is one having, in its molecule, an adsorptive group or a partial structure of sensitizing dye.

(3) A silver halide reversal photosensitive material comprising at least one compound selected from those of types 1 to 4 described in item (1).

(4) The silver halide reversal photosensitive material according to item (3), wherein the at least one compound selected from those of types 1 to 4 described in item (1) is incorporated in a silver halide emulsion.

(5) The silver halide reversal photosensitive material according to item (3) or (4), wherein the silver halide reversal photosensitive material has a layer containing at least one compound whose oxidation potential is in the range of 0.18 to 0.90 eV.

(6) The silver halide reversal photosensitive material according to any of items (3) to (5), wherein the silver halide reversal photosensitive material contains silver halide emulsion grains each having a shell formed with silver halide after a chemical sensitization step wherein the average shell thickness of each grain is 20 nm or less.

(7) The silver halide reversal photosensitive material according to any of items (3) to (6), wherein the silver halide reversal photosensitive material is a color reversal photosensitive material containing at least one azole magenta coupler represented by the following general formula (MC-I):

(MC-1)

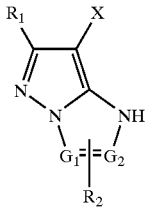

In the general formula (MC-I), $R_1$ represents a hydrogen atom or substituent; one of $G_1$ and $G_2$ represents a carbon atom, and the other represents a nitrogen atom; and $R_2$ represents a substituent that substitutes one of $G_1$ and $G_2$ which is a carbon atom. $R_1$ and $R_2$ may further have a substituent. A polymer of the general formula (MC-I) may be formed via $R_1$ or $R_2$. A polymer chain may be bonded via $R_1$ or $R_2$. X represents a hydrogen atom or a group that is capable of splitting off by a coupling reaction with an oxidized aromatic primary amine color developing agent.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below. In the present invention, the developer arising a solution physical development refers to one wherein 0.10 mol or more of sulfite ions are contained in 1 L of a solution containing a developing agent (corresponding to the first developer in the event of color reversal processing). Sulfite ions are also formed by decomposition of disulfite ions, and unite with silver ions to thereby form complex ions, so that silver halide grains are well dissolved thereby. In that instance, one molecule of disulfite ion is counted as two molecules of sulfite ion.

The compounds belonging to types 1 to 4 for use in the present invention will now be described in detail.

(Type 1)

A compound capable of undergoing a one-electron oxidation to thereby form a one-electron oxidation product thereof, wherein the one-electron oxidation product is capable of releasing further two or more electrons accompanying a subsequent bond cleavage reaction.

(Type 2)

A compound capable of undergoing a one-electron oxidation to thereby form a one-electron oxidation product thereof, wherein the one-electron oxidation product is capable of releasing further one electron accompanying a subsequent carbon-carbon bond cleavage reaction, and the compound having, in its molecule, two or more groups adsorptive to silver halide;

(Type 3)

A compound capable of undergoing a one-electron oxidation to thereby form a one-electron oxidation product thereof, wherein the one-electron oxidation product is capable of releasing further one or more electrons after going through a subsequent bond forming reaction; and (Type 4)

A compound capable of undergoing a one-electron oxidation to thereby form a one-electron oxidation product thereof, wherein the one-electron oxidation product is capable of releasing further one or more electrons after going through a subsequent intramolecular ring cleavage reaction.

Among the compounds belonging to the above types 1 to 4, preferable ones are represented by the following general formulae (1-1) to (4-2). That is, among the compounds belonging to the above type 1, preferable compounds are represented by the following general formula (1-1) or (1-2). Among the compounds belonging to the above type 2, preferable compounds are represented by the following general formula (2). Among the compounds belonging to the above type 3, preferable compounds are represented by the following general formula (3). Among the compounds belonging to the above type 4, preferable compounds are represented by the following general formula (4-1) or (4-2):

(1-1)

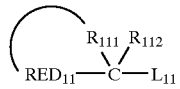

(1-2)

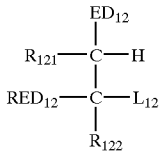

(2)

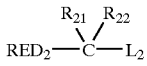

(3)

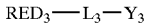

(4-1)

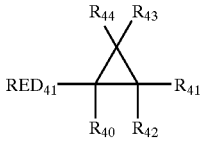

(4-2)

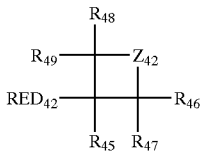

In the general formula (1-1), $RED_{11}$ represents a reducing group; $L_{11}$ represents a split-off group; and $R_{112}$ represents a hydrogen atom or substituent. $R_{111}$ represents a group of nonmetallic atoms capable of forming a cyclic structure corresponding to a tetrahydro form, hexahydro form or octahydro form of a 5-membered or 6-membered aromatic ring (including an aromatic heterocycle) together with the carbon atom (C) and $RED_{11}$.

In the general formula (1-2), $RED_{12}$ and $L_{12}$ have the same meanings as those of $RED_{11}$ and $L_{11}$ of the general formula (1-1), respectively. Each of $R_{121}$ and $R_{122}$ represents a hydrogen atom or substituent capable of substituting on the carbon atom, which may have the same meaning as $R_{112}$ of the general formula (1-1). $ED_{12}$ represents an electron-donating group. In the general formula (1-2), the groups $R_{121}$ and $RED_{12}$, the groups $R_{121}$ and $R_{122}$, or the groups $ED_{12}$ and $RED_{12}$ may be bonded with each other to thereby form a cyclic structure.

In the general formula (2), $RED_2$ has the same meaning as that of $RED_{12}$ of the general formula (1-2); $L_2$ represents a split-off group; each of $R_{21}$ and $R_{22}$ represents a hydrogen atom or substituent; and $RED_2$ and $R_{21}$ may be bonded with each other to thereby form a cyclic structure. The compound represented by the general formula (2) is a compound having, in its molecule, two or more groups adsorptive to silver halide.

In the general formula (3), $RED_3$ has the same meaning as $RED_{12}$ of the general formula (1-2). $Y_3$ represents a reactive group having a carbon-carbon double bond moiety or a carbon-carbon triple bond moiety, which moiety being capable of forming a new bond by reacting with a one-electron oxidized $RED_3$. $L_3$ represents a linking group that links between $RED_3$ and $Y_3$.

In the general formulae (4-1) and (4-2), each of $RED_{41}$ and $RED_{42}$ has the same meaning as $RED_{12}$ of the general formula (1-2). Each of $R_{40}$ to $R_{44}$ and $R_{45}$ to $R_{49}$ represents a hydrogen atom or substituent. In the general formula (4-2), $Z_{42}$ represents —$CR_{420}R_{421}$—, —$NR_{423}$— or —O—. Herein, each of $R_{420}$ and $R_{421}$ represents a hydrogen atom or substituent; and $R_{423}$ represents a hydrogen atom, alkyl group, aryl group or heterocyclic group.

Among the compounds belonging to the above types 1, 3 and 4, preferable ones are "compounds each having, in its molecular, a group adsorptive to silver halide" or "compounds each having, in its molecular, a partial structure of spectral sensitizing dye". More preferable ones are "compounds each having, in its molecular, a group adsorptive to silver halide".

Similarly, among the compounds represented by the general formulae (1-1) to (4-2), preferable ones are "compounds each having, in its molecular, a group adsorptive to silver halide" or "compounds each having, in its molecular, a partial structure of spectral sensitizing dye". More preferable ones are "compounds each having, in its molecular, a group adsorptive to silver halide".

Next, the compounds of the present invention will be described in detail.

The compound belonging to type 1 is a compound capable of undergoing a one-electron oxidation to thereby form a one-electron oxidation product thereof, wherein the one-electron oxidation product is capable of releasing further two or more electrons accompanying a subsequent bond cleavage reaction. In the compound belonging to type 1, expression "bond cleavage reaction" refers to the cleavage of a carbon-carbon bond, or carbon-silicon bond. Further, the cleavage of carbon-hydrogen bond may accompany the above bond cleavage. The one-electron oxidation product only thereafter capable of undergoing a bond cleavage reaction to thereby further release two or more electrons (preferably three or more electrons). In another expression, the one-electron oxidation product of the compound of type 1 is capable of being oxidized with further two or more electrons (preferably three or more electrons).

Among the compounds of type 1, preferable compounds are represented by the general formula (1-1) or general formula (1-2). These compounds are compounds which, after a one-electron oxidation of the reducing group represented by $RED_{11}$ or $RED_{12}$ of the general formula (1-1) or general formula (1-2), can spontaneously split $L_{11}$ or $L_{12}$ through a bond cleavage reaction, namely, cleave the C (carbon atom)—$L_{11}$ bond or the C (carbon atom)—$L_{12}$ bond to thereby further release two or more, preferably three or more, electrons.

The compounds of the general formula (1-1) will first be described in detail below.

In the general formula (1-1), the reducing group represented by $RED_{11}$, capable of being oxidized with one-electron is a group capable of bonding with $R_{111}$ described later to thereby form a specific ring. The reducing group can be, for example, a divalent group corresponding to a monovalent group, as mentioned below, having one hydrogen atom removed therefrom at a position which is appropriate for cyclization. The monovalent group can be, for example, any of an alkylamino group, arylamino group (e.g., anilino, naphthylamino), heterocyclic amino group (e.g., benzothiazolylamino, pyrrolylamino), alkylthio group, arylthio group (e.g., phenylthio), heterocyclic thio group, alkoxy group, aryloxy group (e.g., phenoxy), heterocyclic oxy group, aryl group (e.g., phenyl, naphthyl, anthranyl) and aromatic or nonaromatic heterocyclic group (for example, 5- to 7-membered monocyclic or condensed heterocycle containing at least one hetero atom selected from a group consisting of a nitrogen atom, sulfur atom, oxygen atom and selenium atom, which heterocycle can be, for example, a tetrahydroquinoline ring, tetrahydroisoquinoline ring, tetrahydroquinoxaline ring, tetrahydroquinazoline ring, indoline ring, indole ring, indazole ring, carbazole ring, phenoxazine ring, phenothiazine ring, benzothiazoline ring, pyrrole ring, imidazole ring, thiazoline ring, piperidine ring, pyrrolidine ring, morpholine ring, benzimidazole ring, benzimidazoline ring, benzoxazoline ring or 3,4-methylenedioxyphenyl ring) (hereinafter, for simplicity, $RED_{11}$ is referred to as denoting a monovalent group). These groups may each have a substituent.

The substituent can be, for example, any of a halogen atom, alkyl groups (including, e.g., an aralkyl group, cycloalkyl group, active methine group), an alkenyl group, alkynyl group, aryl group, heterocyclic group, with its substitution position is not questioned), heterocyclic group containing a quaternated nitrogen atom (e.g., pyridinio, imidazolio, quinolinio or isoquinolinio), acyl group, alkoxycarbonyl group, aryloxycarbonyl group, carbamoyl group, carboxyl group or salt thereof, sulfonylcarbamoyl group, acylcarbamoyl group, sulfamoylcarbamoyl group, carbazoyl group, oxalyl group, oxamoyl group, cyano group, thiocarbamoyl group, hydroxyl group, alkoxy groups (including a group containing ethyleneoxy or propyleneoxy repeating units), aryloxy group, heterocyclic oxy group, acyloxy group, alkoxy- or aryloxy-carbonyloxy group, carbamoyloxy group, sulfonyloxy group, amino group, alkyl-, aryl- or heterocyclic-amino group, acylamino group, sulfonamido group, ureido group, thioureido group, imido group, alkoxy- or aryloxy-carbonylamino group, sulfamoylamino group, semicarbazido group, thiosemicarbazido group, hydrazino group, ammonio group, oxamoylamino group, alkyl- or aryl-sulfonylureido group, acylureido group, acylsulfamoylamino group, nitro group, mercapto group, alkyl-, aryl- or heterocyclic-thio group, alkyl- or aryl-sulfonyl group, alkyl- or aryl-sulfinyl group, sulfo group or salt thereof, sulfamoyl group, acylsulfamoyl group, sulfonylsulfamoyl group or salt thereof, and group containing a phosphoramide or phosphoric ester structure. These substituents may be further substituted with these substituents.

In the general formula (1-1), $L_{11}$ represents a split-off group which can be split off through a bond cleavage only after a one-electron oxidation of the reducing group represented by $RED_{11}$. Specifically, $L_{11}$ represents, for example, a carboxyl group or salt thereof, or silyl group.

When $L_{11}$ represents a salt of carboxyl group, as a counter ion for forming a salt, there can be mentioned, for example, an alkali metal ion (e.g., $Li^+$, $Na^+$, $K^+$ or $Cs^+$), an alkaline earth metal ion (e.g., $Mg^{2+}$, $Ca^{2+}$ or $Ba^{2+}$), a heavy metal ion (e.g., $Ag^+$ or $Fe^{2+/3+}$), an ammonium ion or a phosphonium ion. When $L_{11}$ represents a silyl group, the silyl group is, for example, a trialkylsilyl group, an aryldialkylsilyl group or a triarylsilyl group. The alkyl of these groups can be, for example, methyl, ethyl, benzyl or t-butyl. The aryl of these groups can be, for example, phenyl.

In the general formula (1-1), $R_{112}$ represents a hydrogen atom or substituent capable of substituting on the carbon atom. When $R_{112}$ represents a substituent capable of substituting on the carbon atom, the substituent can be, for example, any of those mentioned as substituent examples with respect to the $RED_{11}$ having a substituent. Provided however that $R_{112}$ and $L_{11}$ do not represent the same group.

In the general formula (1-1), $R_{111}$ represents a group of nonmetallic atoms capable of forming a specific 5-membered or 6-membered cyclic structure together with the carbon atom (C) and $RED_{11}$. Herein, the expression "specific 5-membered or 6-membered cyclic structure" formed by $R_{111}$ means a cyclic structure corresponding to a tetrahydro form, hexahydro form or octahydro form of 5-membered or 6-membered aromatic ring, including an aromatic heterocycle. Herein, the terminology "hydro form" means a cyclic structure resulting from partial hydrogenation of internal carbon-carbon double bonds or carbon-nitrogen double bonds of an aromatic ring, including an aromatic heterocycle. The tetrahydro form refers to a structure resulting from hydrogenation of two carbon-carbon double bonds or carbon-nitrogen double bonds. The hexahydro form refers to a structure resulting from hydrogenation of three carbon-carbon double bonds or carbon-nitrogen double bonds. The octahydro form refers to a structure resulting from hydrogenation of four carbon-carbon double bonds or carbon-nitrogen double bonds. As a result of hydrogenation, the aromatic ring becomes a partially hydrogenated nonaromatic cyclic structure.

Specifically, as examples of 5-membered monocycles, there can be mentioned a pyrrolidine ring, imidazolidine ring, thiazolidine ring, pyrazolidine ring and oxazolidine ring which correspond to tetrahydro forms of aromatic rings including a pyrrole ring, imidazole ring, thiazole ring, pyrazole ring and oxazole ring, respectively. As examples of 6-membered monocycles, there can be mentioned tetrahydro or hexahydro forms of aromatic rings such as a pyridine ring, pyridazine ring, pyrimidine ring and pyrazine ring. Particular examples thereof include a piperidine ring, tetrahydropyridine ring, tetrahydropyrimidine ring and piperazine ring. As examples of 6-membered condensed rings, there can be mentioned a tetralin ring, tetrahydroquinoline ring, tetrahydroisoquinoline ring, tetrahydroquinazoline ring and tetrahydroquinoxaline ring which correspond to tetrahydro forms of aromatic rings including a naphthalene ring, quinoline ring, isoquinoline ring, quinazoline ring and quinoxaline ring, respectively. As examples of tricyclic compounds, there can be mentioned a tetrahydrocarbazole ring, which is a tetrahydro form of a carbazole ring, and an octahydrophenanthridine ring, which is an octahydro form of a phenanthridine ring.

These cyclic structures may further be substituted. As examples of suitable substituents, there can be mentioned those described above with respect to substituents which may be had by the $RED_{11}$. Substituents of these cyclic structures may be further bonded with each other to thereby form a ring. The thus newly formed ring is a nonaromatic carbon ring or heterocycle.

Preferred range of compounds represented by the general formula (1-1) of the present invention will be described below.

In the general formula (1-1), $L_{11}$ preferably represents a carboxyl group or salt thereof. More preferably, $L_{11}$ is a carboxyl group or salt thereof. As a counter ion of the salt, there can preferably be mentioned an alkali metal ion or an ammonium ion. An alkali metal ion (especially $Li^+$, $Na^+$ or $K^+$ ion) is most preferred.

In the general formula (1-1), it is preferred that $RED_{11}$ represents an alkylamino group, arylamino group, heterocyclic amino group, aryl group, or aromatic or nonaromatic heterocyclic group. As the heterocyclic group, preferred group is, for example, tetrahydroquinolinyl, tetrahydroquinoxalinyl, tetrahydroquinazolinyl, indolyl, indolenyl, carbazolyl, phenoxazinyl, phenothiazinyl, benzothiazolinyl, pyrrolyl, imidazolyl, thiazolidinyl, benzimidazolyl, benzimidazolinyl or 3,4-methylenedioxyphenyl-1-yl. More preferred group is an arylamino group (especially an anilino) or aryl group (especially an phenyl).

When $RED_{11}$ represents an aryl group, it is preferred that the aryl group has at least one electron-donating group. The number of electron-donating groups is preferably 4 or less, more preferably 1 to 3. Herein, the electron-donating group specifically refers to a hydroxyl group, alkoxy group, mercapto group, sulfonamido group, acylamino group, alkylamino group, arylamino group, heterocyclic amino group, active methine group, electron-excessive aromatic heterocyclic group (e.g., indolyl, pyrrolyl, imidazolyl, benzimidazolyl, thiazolyl, benzthiazolyl or indazolyl), or a nonaromatic nitrogen-containing heterocyclic group that is bonded to the carbon atom of the general formula (1-1) via its nitrogen atom (e.g., pyrrolidinyl, indolinyl, piperidinyl, piperazinyl or morpholino). Herein, the active methine group refers to a methine group substituted with two electron-withdrawing groups. Herein, the electron-withdrawing groups refer to an acyl group, alkoxycarbonyl group, aryloxycarbonyl group, carbamoyl group, alkylsulfonyl group, arylsulfonyl group, sulfamoyl group, trifluoromethyl group, cyano group, nitro group and imino group. These two electron-withdrawing groups may be bonded with each other to thereby form a circular structure.

When $RED_{11}$ represents an aryl group, the substituent of the aryl group is preferably an alkylamino group, hydroxyl group, alkoxy group, mercapto group, sulfonamido group, active methine group, or nonaromatic nitrogen-containing heterocyclic group that is bonded to the carbon atom of the general formula (1-1) via its nitrogen atom. More preferably, the substituent is an alkylamino group, hydroxyl group, active methine group, or nonaromatic nitrogen-containing heterocyclic group that is bonded to the carbon atom of the general formula (1-1) via its nitrogen atom. Most preferably, the substituent is an alkylamino group, or nonaromatic nitrogen-containing heterocyclic group that is bonded to the carbon atom of the general formula (1-1) via its nitrogen atom.

In the general formula (1-1), $R_{112}$ preferably represents any of a hydrogen atom, alkyl group, aryl group (e.g., phenyl), alkoxy group (e.g., methoxy, ethoxy or benzyloxy), hydroxyl group, alkylthio group (e.g., methylthio or butylthio), amino group, alkylamino group, arylamino group and heterocyclic amino group. More preferably, $R_{112}$ represents any of a hydrogen atom, alkyl group, alkoxy group, phenyl group, alkylamino group, each preferably having 10 or less carbon atoms.

In the general formula (1-1), $R_{111}$ preferably represents a group of nonmetallic atoms capable of forming the following specific 5-membered or 6-membered cyclic structure together with the carbon atom (C) and $RED_{11}$. Specifically, the cyclic structure formed by $R_{111}$ may be, for example, either of a pyrrolidine ring and an imidazolidine ring which correspond to tetrahydro forms of monocyclic 5-membered aromatic rings including a pyrrole ring and imidazole ring, respectively. Also, the cyclic structure may be a tetrahydro or hexahydro form of monocyclic 6-membered aromatic ring such as a pyridine ring, pyridazine ring, pyrimidine ring or pyrazine ring. For example, the cyclic structure may be a piperidine ring, tetrahydropyridine ring, tetrahydropyrimidine ring or piperazine ring. Further, the cyclic structure may be any of a tetralin ring, tetrahydroquinoline ring, tetrahydroisoquinoline ring, tetrahydroquinazoline ring and tetrahydroquinoxaline ring which correspond to tetrahydro forms of condensed-ring of 6-membered aromatic rings including a naphthalene ring, a quinoline ring, isoquinoline ring, quinazoline ring and quinoxaline ring, respectively. Still further, the cyclic structure may be a tetrahydrocarbazole ring which is a tetrahydro form of a tricyclic aromatic carbazole ring, or octahydrophenanthridine ring which is an octahydro form of a phenanthridine ring.

The cyclic structure formed by $R_{111}$ is more preferably selected from a pyrrolidine ring, imidazolidine ring, piperidine ring, tetrahydropyridine ring, tetrahydropyrimidine ring, piperazine ring, tetrahydroquinoline ring, tetrahydroquinazoline ring, tetrahydroquinoxaline ring and tetrahydrocarbazole ring. Most preferably, the cyclic structure formed by $R_{111}$ is selected from a pyrrolidine ring, piperidine ring, piperazine ring, tetrahydroquinoline ring, tetrahydroquinazoline ring, tetrahydroquinoxaline ring and tetrahydrocarbazole ring. Optimally, the cyclic structure formed by $R_{111}$ is selected from a pyrrolidine ring, piperidine ring and tetrahydroquinoline ring.

Now, the general formula (1-2) will be described in detail.

With respect to the $RED_{12}$ and $L_{12}$ of the general formula (1-2), not only the meanings but also the preferred ranges thereof are the same as those of the $RED_{11}$ and $L_{11}$ of the general formula (1-1), respectively. Provided however that $RED_{12}$ represents a monovalent group unless the following cyclic structure is formed thereby. For example, the monovalent group can be any of those mentioned with respect to $RED_{11}$. With respect to $R_{121}$ and $R_{122}$, not only the meanings but also the preferred ranges thereof are the same as those of the $R_{112}$ of the general formula (1-1). $ED_{12}$ represents an electron-donating group. $R_{121}$ and $RED_{12}$; $R_{121}$ and $R_{122}$; or $ED_{12}$ and $RED_{12}$ may be bonded with each other to thereby form a cyclic structure.

In the general formula (1-2), the electron-donating group represented by $ED_{12}$ refers to a hydroxyl group, alkoxy group, mercapto group, alkylthio group, arylthio group, heterocyclic thio group, sulfonamido group, acylamino group, alkylamino group, arylamino group, heterocyclic amino group, active methine group, electron-excessive aromatic heterocyclic group (e.g., indolyl, pyrrolyl or indazolyl), a nonaromatic nitrogen-containing heterocyclic group that is bonded to the carbon atom of the general formula (1-2) via its nitrogen atom (e.g., pyrrolidinyl, piperidinyl, indolinyl, piperazinyl or morpholino), or an aryl group substituted with any of these electron-donating groups (e.g., p-hydroxyphenyl, p-dialkylaminophenyl, an o,p-dialkoxyphenyl or 4-hydroxynaphthyl). Herein, the active methine group is the same as described above as a substituent when $RED_{11}$ represents an aryl group.

$ED_{12}$ preferably represents a hydroxyl group, alkoxy group, mercapto group, sulfonamido group, alkylamino group, arylamino group, active methine group, electron-excessive aromatic heterocyclic group, nonaromatic nitrogen-containing heterocyclic group that is bonded to the carbon atom of the general formula (1-2) via its nitrogen atom, or phenyl group substituted with any of these electron-donating groups. More preferably, $ED_{12}$ represents a hydroxyl group, mercapto group, sulfonamido group, alkylamino group, arylamino group, active methine group, nonaromatic nitrogen-containing heterocyclic group that is bonded to the carbon atom of the general formula (1-2) via its nitrogen atom, or phenyl group substituted with any of these electron-donating groups (e.g., p-hydroxyphenyl, p-dialkylaminophenyl or o,p-dialkoxyphenyl).

In the general formula (1-2), $R_{121}$ and $RED_{12}$; $R_{122}$ and $R_{121}$; or $ED_{12}$ and $RED_{12}$ may be bonded with each other to thereby form a cyclic structure. The thus formed cyclic structure is a substituted or unsubstituted cyclic structure of a 5 to 7-membered monocyclic or condensed-ring nonaromatic carbon ring or heterocycle.

When $R_{121}$ and $RED_{12}$ form a cyclic structure, the thus formed cyclic structure can be, for example, a pyrrolidine ring, pyrroline ring, imidazolidine ring, imidazoline ring, thiazolidine ring, thiazoline ring, pyrazolidine ring, pyrazoline ring, oxazolidine ring, oxazoline ring, indane ring, piperidine ring, piperazine ring, morpholine ring, tetrahydropyridine ring, tetrahydropyrimidine ring, indoline ring, tetralin ring, tetrahydroquinoline ring, tetrahydroisoquinoline ring, tetrahydroquinoxaline ring, tetrahydro-1,4-oxazine ring, 2,3-dihydrobenzo-1,4-oxazine ring, tetrahydro-1,4-thiazine ring, 2,3-dihydrobenzo-1,4-thiazine ring, 2,3-dihydrobenzofuran ring or 2,3-dihydrobenzothiophene ring.

When $ED_{12}$ and $RED_{12}$ form a cyclic structure, $ED_{12}$ preferably represents an amino group, alkylamino group or arylamino group. The cyclic structure formed thereby can be, for example, a tetrahydropyrazine ring, piperazine ring, tetrahydroquinoxaline ring or tetrahydroisoquinoline ring.

When $R_{122}$ and $R_{121}$ form a cyclic structure, the thus formed cyclic structure can be, for example, a cyclohexane ring or cyclopentane ring.

Those which are more preferred among the compounds of the general formula (1-1) of the present invention are represented by the following general formulae (10) to (12). Those which are more preferred among the compounds of the general formula (1-2) are represented by the following general formulae (13) and (14):

(10)

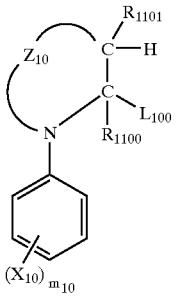

(11)

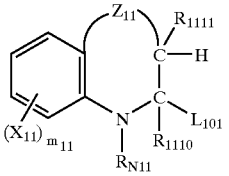

(12)

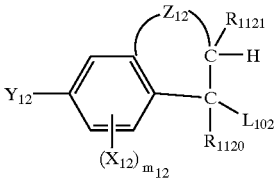

(13)

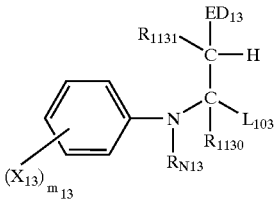

(14)

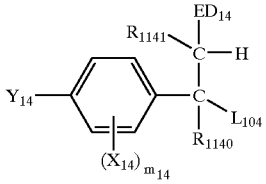

With respect to the $L_{100}$, $L_{101}$, $L_{102}$, $L_{103}$ and $L_{104}$ of the general formulae (10) to (14), not only the meanings but also the preferred ranges thereof are the same as those of the $L_{11}$ of the general formula (1-1). With respect to $R_{1100}$ and $R_{1101}$; $R_{1110}$ and $R_{1111}$; $R_{1120}$ and $R_{1121}$; $R_{1130}$ and $R_{1131}$; and $R_{1140}$ and $R_{1141}$; not only the meanings but also the preferred ranges thereof are the same as those of the $R_{122}$ and $R_{121}$, respectively of the general formula (1-2). With respect to the $ED_{13}$ and $ED_{14}$, not only the meanings but also the preferred ranges thereof are the same as those of the $ED_{12}$ of the general formula (1-2).

Each of $X_{10}$, $X_{11}$, $X_{12}$, $X_{13}$ and $X_{14}$ represents a substituent capable of substituting on the benzene ring. Each of $m_{10}$, $m_{11}$, $m_{12}$, $m_{13}$ and $m_{14}$ is an integer of 0 to 3. When it is 2 or more, a plurality of $X_{10}$, $X_{11}$, $X_{12}$, $X_{13}$ or $X_{14}$ groups may be the same or different. Each of $Y_{12}$ and $Y_{14}$ represents an amino group, alkylamino group, arylamino group, nonaromatic nitrogen-containing heterocyclic group that is bonded to the benzene ring of the general formula (12) or (14) via its nitrogen atom (e.g., pyrrolyl, piperidinyl, indolinyl, piperazino or morpholino), hydroxyl group or alkoxy group.

Each of $Z_{10}$, $Z_{11}$ and $Z_{12}$ represents a nonmetallic atomic group capable of forming a specific cyclic structure. The specific cyclic structure formed by $Z_{10}$ means a cyclic structure corresponding to a tetrahydro form or hexahydro form of 5- or 6-membered, monocyclic or condensed-ring, nitrogen-containing aromatic heterocycle. As such a cyclic structure, there can be mentioned, for example, a pyrrolidine ring, imidazolidine ring, thiazolidine ring, pyrazolidine ring, piperidine ring, tetrahydropyridine ring, tetrahydropyrimidine ring, piperazine ring, tetrahydroquinoline ring, tetrahydroisoquinoline ring, tetrahydroquinazoline ring or tetrahydroquinoxaline ring. The specific cyclic structure formed by $Z_{11}$ refers to a tetrahydroquinoline ring or tetrahydroquinoxaline ring. The specific cyclic structure formed by $Z_{12}$ refers to a tetralin ring, tetrahydroquinoline ring or tetrahydroisoquinoline ring.

Each of $R_{N11}$ and $R_{N13}$ represents a hydrogen atom or substituent capable of substituting on the nitrogen atom. The substituent can be, for example, any of an alkyl group, alkenyl group, alkynyl group, aryl group, heterocyclic group and acyl group, preferably an alkyl group or aryl group.

The substituents capable of substituting on the benzene ring, represented by $X_{10}$, $X_{11}$, $X_{12}$, $X_{13}$ or $X_{14}$, can be, for example, those which may be had by the $RED_{11}$ of the general formula (1-1). Preferably, the substituents can be a halogen atom, alkyl group, aryl group, heterocyclic group, acyl group, alkoxycarbonyl group, aryloxycarbonyl group, carbamoyl group, cyano group, alkoxy group (including a group containing ethyleneoxy or propyleneoxy repeating units), alkyl-, aryl- or heterocyclic-amino group, an acylamino group, sulfonamido group, ureido group, thioureido group, imido group, alkoxy- or aryloxy-carbonylamino group, nitro group, alkyl-, aryl- or heterocyclic-thio group, alkyl- or aryl-sulfonyl group, a sulfamoyl group, etc.

Each of $m_{10}$, $m_{11}$, $m_{12}$, $m_{13}$ and $m_{14}$ is preferably an integer of 0 to 2, more preferably 0 or 1.

Each of $Y_{12}$ and $Y_{14}$ preferably represents an alkylamino group, arylamino group, nonaromatic nitrogen-containing heterocyclic group that is bonded to the benzene ring of the general formula (12) or (14) via its nitrogen atom, hydroxyl group or alkoxy group. More preferably, each of $Y_{12}$ and $Y_{14}$ represents an alkylamino group, 5- or 6-membered nonaromatic nitrogen-containing heterocyclic group that is bonded to the benzene ring of the general formula (12) or (14) via its nitrogen atom, or hydroxyl group. Most preferably, each of $Y_{12}$ and $Y_{14}$ represents an alkylamino group (especially, dialkylamino) or a 5- or 6-membered nonaromatic nitrogen-containing heterocyclic group that is bonded to the benzene ring of the general formula (12) or (14) via its nitrogen atom.

In the general formula (13), $R_{1131}$ and $X_{13}$; $R_{1131}$ and $R_{N13}$; $R_{1130}$ and $X_{13}$; or $R_{1130}$ and $R_{N13}$ may be bonded with each other to thereby form a cyclic structure. In the general formula (14), $R_{1141}$ and $X_{14}$; or $R_{1141}$ and $R_{1140}$; $ED_{14}$ and $X_{14}$; or $R_{1140}$ and $X_{14}$ may be bonded with each other to thereby form a cyclic structure. The thus formed cyclic structure is a substituted or unsubstituted cyclic structure consisting of a 5- to 7-membered monocyclic or condensed-ring nonaromatic carbon ring or heterocycle.

When, in the general formula (13), $R_{1131}$ and $X_{13}$ are bonded with each other to thereby form a cyclic structure, or $R_{1131}$ and $R_{N13}$ are bonded with each other to thereby form a cyclic structure, the resultant compound, like that wherein no cyclic structure is formed, is a preferred example of the compounds of the general formula (13).

As the cyclic structure formed by $R_{1131}$ and $X_{13}$ in the general formula (13), there can be mentioned, for example, any of an indoline ring (in which case, $R_{1131}$ represents a single bond), tetrahydroquinoline ring, tetrahydroquinoxaline ring, 2,3-dihydrobenzo-1,4-oxazine ring and 2,3-dihydrobenzo-1,4-thiazine ring. Of these, an indoline ring, tetrahydroquinoline ring and tetrahydroquinoxaline ring are especially preferred.

As the cyclic structure formed by $R_{1131}$ and $R_{N13}$ in the general formula (13), there can be mentioned, for example, any of a pyrrolidine ring, pyrroline ring, imidazolidine ring, imidazoline ring, thiazolidine ring, thiazoline ring, pyrazolidine ring, pyrazoline ring, oxazolidine ring, oxazoline ring, piperidine ring, piperazine ring, morpholine ring, tetrahydropyridine ring, tetrahydropyrimidine ring, indoline ring, tetrahydroquinoline ring, tetrahydroisoquinoline ring, tetrahydroquinoxaline ring, tetrahydro-1,4-oxazine ring, 2,3-dihydrobenzo-1,4-oxazine ring, tetrahydro-1,4-thiazine ring, 2,3-dihydrobenzo-1,4-thiazine ring, 2,3-dihydrobenzofuran ring and 2,3-dihydrobenzothiophene ring. Of these, a pyrrolidine ring, piperidine ring, tetrahydroquinoline ring and tetrahydroquinoxaline ring are especially preferred.

When, in the general formula (14), $R_{1141}$ and $X_{14}$ are bonded with each other to thereby form a cyclic structure, or $ED_{14}$ and $X_{14}$ are bonded with each other to thereby form a cyclic structure, the resultant compound, like that wherein no cyclic structure is formed, is a preferred example of the compounds of the general formula (14). As the cyclic structure formed by the bonding of $R_{1141}$ and $X_{14}$ in the general formula (14), there can be mentioned, for example, an indane ring, tetralin ring, tetrahydroquinoline ring, tetrahydroisoquinoline ring or indoline ring. As the cyclic structure formed by the bonding of $ED_{14}$ and $X_{14}$, there can be mentioned, for example, a tetrahydroisoquinoline ring or tetrahydrocinnoline ring.

The compound of type 2 will be described below.

The compound of type 2 is a compound capable of undergoing a one-electron oxidation to thereby form a one-electron oxidation product and capable of, only thereafter, undergoing a carbon-carbon bond cleavage reaction to thereby further release another electron. That is, the one-electron oxidation product of the compound of type 2 is capable of being oxidized with a further one-electron oxidation. Herein, the expression "bond cleavage reaction" refers to the cleavage of a carbon-carbon bond. The cleavage of carbon-hydrogen bond may accompany the above carbon-carbon bond cleavage.

Among the compounds belonging to type 2, those preferred are represented by the general formula (2). Herein, the compound of type 2 is, after the one-electron oxidation of the reducing group represented by $RED_2$, $L_2$ is spontaneously split off through a bond cleavage reaction, namely, the C (carbon atom)—$L_2$ bond is cleaved, so that further another electron can be released.

Provided that the compound belonging to type 2 is a compound having, in its molecule, two or more groups adsorptive to silver halide. More preferably, the compound of type 2 is a compound having a nitrogen-containing heterocyclic group substituted with two or more mercapto groups as the adsorptive group. The number of adsorptive group is preferably in the range of 2 to 6, more preferably 2 to 4. The adsorptive groups will be described later.

With respect to $RED_2$ of the general formula (2), not only the meaning but also the preferred range thereof is the same as those of the $RED_{12}$ of the general formula (1-2). $L_2$ represents a carboxy group or a salt thereof, not only the counter ion forming the salt but also the preferred range thereof is the same as those described for the $L_{11}$ of the general formula (1-1). Each of $R_{21}$ and $R_{22}$ represents a hydrogen atom or substituent. With respect to these, not only the meanings but also the preferred ranges thereof are the same as those of the $R_{112}$ of the general formula (1-1). $RED_2$ and $R_{21}$ may be bonded with each other to thereby form a cyclic structure.

The thus formed cyclic structure is preferably a cyclic structure corresponding to the dihydro form of a 5- or 6-membered monocyclic or condensed-ring naromatic carbon ring (including aromatic heterocycle), which may have a substituent.

Examples of the cyclic structure are 2-pyrroline ring, 2-imidazoline ring, 2-thiazoline ring, 1,2-dihydropyridine ring, 1,4-dihydropyridine ring, indoline ring, benzimidazoline ring, benzothiazoline ring, benzoxazoline ring, 2,3-dihydrobenzothiophene ring, 2,3-dihydrobenzofurane ring, benzo-α-pyran ring, 1,2-dihydroquinoline ring, 1,2-dihydroquinazoline ring, and 1,2-dihydroquinoxaline ring. Preferably, the examples of the cyclic structure are 2-imidazoline ring, 2-thiazoline ring, indoline ring, benzimidazoline ring, bezothiazoline ring, benzoxazoline ring, 1,2-dihydropyridine ring, 1,2-dihydroquinoline ring, 1,2-dihydroquinazoline ring, 1,2-dihydroquinoxaline ring. More preferable examples are indoline ring, benzimidazoline ring, benzothiazoiline ring, and 1,2-dihydroquinoline ring. Especially preferable example is indoline ring.

The compound belonging to type 3 will be described below.

The compound belonging to type 3 is a compound characterized in that it can undergo a one-electron oxidation to thereby form a one-electron oxidation product, the one-electron oxidation product undergoing a subsequent bond forming reaction to thereby further release one or more electrons. Herein the expression "bond forming reaction" refers to the formation of bond between atoms, in particular, carbon-carbon bond, carbon-nitrogen bond, carbon-sulfur bond or carbon-oxygen bond.

The compound belonging to type 3 is preferably a compound characterized in that it can undergo a one-electron oxidation to thereby form a one-electron oxidation product, the one-electron oxidation product subsequently reacting with a carbon-carbon double bond moiety, or a carbon-carbon triple bond moiety, which coexists in the molecule to thereby form a bond, followed by further release of one or more electrons.

The one-electron oxidation product formed by the one-electron oxidation of the compound belonging to type 3 refers to a cation radical species, which may undergo splitting off a proton to thereby form a neutral radical species. This one-electron oxidation product (cation radical species or neutral radical species) undergoes chemical reaction, in the form of generally called "addition cyclization reaction", with a carbon-carbon double bond moiety, or a carbon-carbon triple bond moiety which coexist in the molecule, thereby forming interatomic bonds such as carbon-carbon bond, carbon-nitrogen bond, carbon-sulfur bond and carbon-oxygen bond. Thus, a new intramolecular cyclic structure is formed. Simultaneously or thereafter, further one or more electrons are released. The characteristic of the electron-releasing compound of type 3 resides in this respect.

More specifically, the compound belonging to type 3 generates radical species having a new cyclic structure by this addition cyclization reaction, after the compound is one-electron oxidized. The compound belonging to type 3 is characterized in that the radical species releases further second electron directly or through splitting off a proton, to thereby cause an oxidation thereof.

Furthermore, the compounds belonging to type 3 include one exhibiting such a capability that the thus formed two-electron oxidation product subsequently undergoes a tautomeric reaction accompanying a transfer of proton either by way of a hydrolytic reaction or directly to thereby further release one or more, generally two or more, electrons, resulting in an oxidation thereof. Still further, the compounds belonging to type 3 include one exhibiting such a capability that, without undergoing such a tautomeric reaction, further one or more, generally two or more, electrons are directly released from the two-electron oxidation product, resulting in oxidation thereof.

The compound of type 3 is preferably represented by the general formula (3).

In the general formula (3), $RED_3$ represents the same meanings as defined for $RED_{12}$ of the general formula (1-2).

$RED_3$ preferably represents an arylamino group, heterocyclic amino group, or aryl group or heterocyclic group substituted with a group selected from the group consisting of a hydroxy group, a mercapto group, an alkylthio group, a methyl group and an amino group.

When $RED_3$ represents an arylamino group, for example, an anilino group, a naphthylamino group or the like can be mentioned as the same. The heterocycle of the heterocyclic amino group is an aromatic or nonaromatic, monocyclic or condensed-ring heterocycle. The heterocycle preferably contains at least one aromatic ring as a partial structure thereof. The expression "contain an aromatic ring as a partial structure" may refer to (1) the heterocycle itself being an aromatic ring, (2) an aromatic ring attached to the heterocycle by condensation, or (3) the heterocycle substituted with an aromatic ring. Among these, the instance (1) or (2) is preferred. Herein, the amino group is linked by direct substitution onto the aromatic ring contained as a partial structure in the heterocycle. As the heterocycle, there can be mentioned, for example, a pyrrole ring, indole ring, indoline ring, imidazole ring, benzimidazole ring, benzimidazoline ring, thiazole ring, benzothiazole ring, benzothiazoline ring, oxazole ring, benzoxazole ring, benzoxazoline ring, quinoline ring, tetrahydroquinoline ring, quinoxaline ring, tetrahydroquinoxaline ring, quinazoline ring, tetrahydroquinazoline ring, pyridine ring, isoquinoline ring, thiophene ring, benzothiophene ring, 2,3-dihydrobenzothiophene ring, furan ring, benzofuran ring, 2,3-dihydrobenzofuran ring, carbazole ring, phenothiazine ring, phenoxazine ring or phenazine ring.

When $RED_3$ represents an arylamino group or heterocyclic amino group, the amino of the arylamino group or the amino of the heterocyclic amino group may have any substituent. This substituent may further form a ring structure together with the aryl group or the heterocyclic group. As examples thereof, there can be mentioned, for example, an indoline ring, tetrahydroquinoline ring and carbazole ring.

When $RED_3$ represents an aryl group or heterocyclic group substituted with a hydroxy group, mercapto group, methyl group, alkylthio group, amino group or the like, the aryl group can be a phenyl group, naphthyl group or the like. The heterocycle of the heterocyclic group can be any of those mentioned above with respect to the "heterocycle of the heterocyclic amino group". This methyl group may have any arbitrary substituent, and, by means of the substituent, may form a ring structure together with the aryl group or heterocyclic group. As this ring structure, there can be mentioned, for example, a tetralin ring, an indane ring or the like. On the other hand, the amino group may have an alkyl group, an aryl group or a heterocyclic group as a substituent, and, by means of the substituent, may form a ring structure together with the aryl group or heterocyclic group. As this ring structure, there can be mentioned, for example, a tetrahydroquinoline ring, indoline ring, carbazole ring or the like.

$RED_3$ preferably represents an arylamino group, or an aryl group or heterocyclic group substituted with a hydroxy group, mercapto group, methyl group or amino group. $RED_3$ more preferably represents an arylamino group, or an aryl group or heterocyclic group substituted with a mercapto group, methyl group or amino group. $RED_3$ most preferably represents an arylamino group, or an aryl group or heterocyclic group substituted with a methyl group or amino group.

An anilino group or a naphthylamino group is preferred as the arylamino group. An anilino group is most preferred. The substituent of the anilino group can preferably be any of a chlorine atom, alkyl group, alkoxy group, acylamino group, sulfamoyl group, carbamoyl group, ureido group, sulfonamido group, alkoxycarbonyl group, cyano group, alkyl- or arylsulfonyl group, heterocyclic group and the like.

The aryl group or heterocyclic group substituted with a hydroxy group can preferably be any of, for example, a hydroxyphenyl group, 5-hydroxyindoline ring group, 6-hydroxy-1,2,3,4-tetrahydroquinoline ring group and the like. Among these, a hydroxyphenyl group is most preferred.

The aryl group or heterocyclic group substituted with a mercapto group can preferably be any of, for example, a mercaptophenyl group, 5-mercaptoindoline ring group, 6-mercapto-1,2,3,4-tetrahydroquinoline ring group and the like. Among these, a mercaptophenyl group is most preferred.

The aryl group or heterocyclic group substituted with a methyl group can preferably be any of, for example, a methylphenyl group, ethylphenyl group, isopropylphenyl group, 3-methylindole ring group, 3-isopropylindole ring group, 5-methylindole ring group, 5-methylindoline ring group, 6-methyl-1,2,3,4-tetrahydroquinoline ring group, 6-methyl-1,2,3,4-tetrahydroquinoxaline ring group and the like.

The aryl group or heterocyclic group substituted with an amino group can preferably be any of, for example, a methylaminophenyl group, octylaminophenyl group, dodecylaminophenyl group, dimethylaminophenyl group, benzylaminophenyl group, phenylaminophenyl group, methylaminonaphthyl group, 5-methylaminotetralin group, 1-butylamino-3,4-methylenedioxyphenyl group, 3-methylaminopyrrole ring group, 3-ethylaminoindole ring group, 5-benzylaminoindoline ring group, 2-aminoimidazole ring group, 2-ethylaminothiazole ring group, 6-phenylaminobenzothiazole ring group and the like. Among these, a phenyl group substituted with an alkylamino group or phenylamino group is more preferred, and a phenyl group substituted with an alkylamino group is most preferred.

The substituent had by the aryl group or heterocyclic group substituted with a hydroxy group, mercapto group, methyl group or amino group can preferably be any of a chlorine atom, alkyl group, alkoxy group, acylamino group, sulfamoyl group, carbamoyl group, ureido group, sulfonamido group, alkoxycarbonyl group, cyano group, alkyl- or aryl-sulfonyl group, heterocyclic group, alkylamino group, arylamino group and the like.

In the general formula (3), the reactive group represented by $Y_3$ specifically means an organic group having at least one carbon-carbon double bond moiety or carbon-carbon triple bond moiety. A substituted or unsubstituted vinyl group can be mentioned as an example of the organic group having a carbon-carbon double bond. A substituted or unsubstituted ethynyl group can be mentioned as an example of the organic group having a carbon-carbon triple bond moiety. The organic group having at least one carbon-carbon double bond moiety or carbon-carbon triple bond moiety may have a substituent, which, for example, is the same as those described as the substituent that $RED_{11}$ of the general formula (1-1) may have. The substituent is preferably be any of, for example, an alkyl group, aryl group, alkoxycarbonyl group, carbamoyl group, acyl group, cyano group, and electron-donating group. Herein, the electron-donating group refers to any of an alkoxy group, hydroxyl group, amino group, alkylamino group, arylamino group, heterocyclic amino group, sulfonamido group, acylamino group, active methine group, mercapto group, alkylthio group, arylthio group and an aryl group having any of these groups as a substituent. Herein the active methine group refers to a methine group substituted with two electron-withdrawing groups, wherein the electron-withdrawing group means an acyl group, alkoxycarbonyl group, aryloxycarbonyl group, carbamoyl group, alkylsulfonyl group, arylsulfonyl group, sulfamoyl group, trifluoromethyl group, cyano group, nitro group or imino group. Herein, the two electron-withdrawing groups may be bonded to each other to form a cyclic structure.

When $Y_3$ represents an organic group having at least one carbon-carbon double bond moiety, the substituents of the moiety may be bonded together to for a cyclic structure. Herein the cyclic structure is nonaromatic 5- to 7-membered carbon ring or hetero ring. When $Y_3$ represents an organic group having at least one carbon-carbon triple bond moiety, the substituent thereof is preferably, for example, any one of a hydrogen atom, alkoxycarbonyl group, carbamoyl group, or electron-donating group. Herein, the electron-donating group preferably refers to any of an alkoxy group, amino group, alkylamino group, arylamino group, heterocyclic amino group, sulfonamide group, acylamino group, active methylene group, mercapto group, and alkylthio group, and a phenyl group having one of these electron-donating groups as a substituent thereof.

In the general formula (3), the reactive group represented by $Y_3$ is more preferably an organic group having at least one carbon-carbon double bond moiety.

In the general formula (3), $L_3$ represents a linking group which links between $RED_3$ and $Y_3$. For example, $L_3$ represents a group consisting of each of, or each of combinations of, a single bond, alkylene group, arylene group, heterocyclic group, —O—, —S—, —$NR_N$—, —C(=O)—, —$SO_2$—, —SO— and —P(=O)—. Herein, $R_N$ represents a hydrogen atom, alkyl group, aryl group or heterocyclic group. The linking group represented by $L_3$ may have a substituent. The substituent can be any of those mentioned hereinbefore as substituents which may be had by $RED_{11}$ of the general formula (1-1).

When a cation radical species generated through an oxidation of $RED_3$ of the general formula (3), or a radical species generated together with dissociation of a proton therefrom, reacts with the reactive group represented by $Y_3$ of the general formula (3) thereby to form a bonding, an atomic group concerting this reaction preferably is capable of forming a 3- to 7-membered cyclic structure including $L_3$.

As a preferred example of $L_3$, there can be mentioned a divalent linking group selected from a single bond, alkylene group, an arylene group (especially phenylene), —C(=O)— group, —O— group, —NH— group, —N(alkyl group)— group and combinations thereof.

Among the compounds of the general formula (3), preferred compounds are represented by the following general formulae (I) to (IV):

(I)

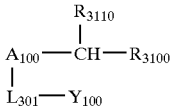

(II)

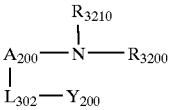

(III)

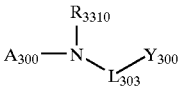

(IV)

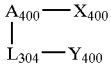

In the general formulae (I) to (IV), each of $A_{100}$, $A_{200}$, $A_{300}$ and $A_{400}$ represents an aryl group or heterocyclic group. The preferred ranges thereof are the same as those of $RED_3$ of the general formula (3). Provided that $A_{100}$, $A_{200}$ and $A_{400}$ each represents a divalent group derived from an aryl group or heterocyclic group, one hydrogen atom from which is removed. Each of $L_{301}$, $L_{302}$, $L_{303}$ and $L_{304}$ represents a linking group. With respect to these, not only the meanings but also the preferred ranges thereof are the same as those of $L_3$ of the general formula (3). Each of $Y_{100}$, $Y_{200}$, $Y_{300}$ and $Y_{400}$ represents a reactive group. With respect to these, not only the meanings but also the preferred ranges thereof are the same as those of $Y_3$ of the general formula (3). Each of $R_{3100}$, $R_{3110}$, $R_{3200}$, $R_{3210}$ and $R_{3310}$ represents a hydrogen atom or substituent. Each of $R_{3100}$ and $R_{3110}$ preferably represents a hydrogen atom, alkyl group or aryl group. Each of $R_{3200}$ and $R_{3310}$ preferably represents a hydrogen atom. $R_{3210}$ preferably represents a substituent. This substituent is preferably an alkyl group or aryl group. Each of $R_{3110}$ and $A_{100}$; $R_{3210}$ and $A_{200}$; and $R_{3310}$ and $A_{300}$ may be bonded with each other to thereby form a cyclic structure. The thus formed cyclic structure is preferably, for example, a tetralin ring, indane ring, tetrahydroquinoline ring or indoline ring. $X_{400}$ represents a hydroxyl group, mercapto group or alkylthio group, preferably represents a hydroxyl group or mercapto group, and more preferably represents a mercapto group.

The relation between the general formula (I) to (IV) and the general formula (3) is as follows. $A_{100}$ of the general formula (I) represents a heterocyclic group or aryl group substituted with a group represented by —CH($R_{3110}$)($R_{3100}$). $A_{200}$ of the general formula (II) represents a heterocyclic group or aryl group substituted with a group represented by —N($R_{3210}$)($R_{3300}$). $A_{400}$ Of the general formula (IV) represents a heterocyclic group or aryl group substituted with a hydroxy group, mercapto group, or alkylthio group. The group represented by $A_{300}$—N($R_{3310}$)— of the general formula (III) similarly represents a heterocyclic amino group or arylamino group.

Among the compounds of the general formulae (I) to (IV), the compounds of the general formulae (I), (II) and (IV) are preferred.

The compound belonging to type 4 will be described below.

The compound belonging to type 4 is a compound having a circular structure substituted with a reducing group, which compound can undergo a one-electron oxidation of the reducing group and thereafter a cleavage reaction of the circular structure to thereby further release one or more electrons.

In the compound belonging to type 4, the cyclic structure is cleaved after going through a one-electron oxidation. Herein, the cyclic cleavage reaction refers to the following scheme of reaction:

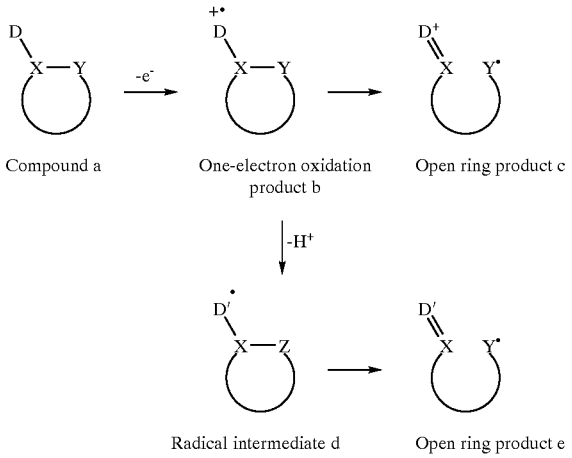

In the scheme, the compound a represents a compound belonging to type 4. In the compound a, D represents a reducing group, and X and Y represent atoms forming a bond of the circular structure which is cleaved after a one-electron oxidation. First, the compound undergoes a one-electron oxidation to thereby form a one-electron oxidation product b. Then, the D—X single bond is converted to a double bond, and simultaneously the X—Y bond is cleaved to thereby form an open-ring product c. An alternative route wherein a proton is split from the one-electron oxidation product b to thereby form a radical intermediate d, from which an open-ring product e is similarly formed, may be taken. One or more electrons are further released from the thus formed open-ring product c or e. The characteristic of this compound of the present invention resides in this respect.

The cyclic structure of the compound belonging to type 4 refers to a 3- to 7-membered carbon ring or heterocycle, which is a monocyclic or condensed-ring, saturated or unsaturated, nonaromatic ring. A saturated cyclic structure is preferred, and a 3- or 4-membered ring is more preferred. As preferred cyclic structures, there can be mentioned a cyclopropane ring, cyclobutane ring, oxirane ring, oxetane ring, aziridine ring, azetidine ring, episulfide ring and thietane ring. Of these, a cyclopropane ring, cyclobutane ring, oxirane ring, oxetane ring and azetidine ring are preferred. A cyclopropane ring, cyclobutane ring and azetidine ring are more preferred. The cyclic structure may have a substituent.

The compound belonging to type 4 is preferably represented by the general formula (4-1) or (4-2).

With respect to $RED_{41}$ and $RED_{42}$ of the general formulae (4-1) and (4-2), not only the meanings but also the preferred ranges thereof are the same as those of $RED_{12}$ of the general formula (1-2). Each of $R_{40}$ to $R_{44}$ and $R_{45}$ to $R_{49}$ represents a hydrogen atom or substituent. The substituent can be any of those which may be had by $RED_{12}$. In the general formula (4-2), $Z_{42}$ represents $—CR_{420}R_{421}—$, $—NR_{423}—$ or —O—. Each of $R_{420}$ and $R_{421}$ represents a hydrogen atom or substituent, and $R_{423}$ represents a hydrogen atom, alkyl group, aryl group or heterocyclic group.

In the general formula (4-1), $R_{40}$ preferably represents any of a hydrogen atom, alkyl group, alkenyl group, alkynyl group, aryl group, heterocyclic group, alkoxy group, amino group, alkylamino group, arylamino group, heterocyclic amino group, alkoxycarbonyl group, acyl group, carbamoyl group, cyano group and sulfamoyl group. Of these, a hydrogen atom, alkyl group, aryl group, heterocyclic group, alkoxy group, alkoxycarbonyl group, acyl group and carbamoyl group are more preferred. A hydrogen atom, alkyl group, aryl group, heterocyclic group, alkoxycarbonyl group and carbamoyl group are most preferred.

With respect to $R_{41}$ to $R_{44}$, it is preferred that at least one thereof be a donating group. It is also preferred that $R_{41}$ and $R_{42}$; or $R_{43}$ and $R_{44}$ be simultaneously electron-withdrawing groups. The electron-withdrawing groups are the same as those mentioned in the above description of active methine group. More preferably, at least one of $R_{41}$ to $R_{44}$ is a donating group. Most preferably, at least one of $R_{41}$ to $R_{44}$ is a donating group while, among $R_{41}$ to $R_{44}$, non-donating group or groups are a hydrogen atom or alkyl group.

Herein, the donating group refers to a hydroxyl group, alkoxy group, aryloxy group, mercapto group, acylamino group, sulfonylamino group, active methine group, or group selected from preferred examples of the $RED_{41}$ and $RED_{42}$ groups. As the donating group, there can preferably be used any of an alkylamino group, arylamino group, heterocyclic amino group, 5-membered aromatic heterocyclic group having one nitrogen atom in its ring (which may be monocyclic or in the form of condensed rings), a nonaromatic nitrogen-containing heterocyclic group that is bonded to the carbon atom of the general formula (4-1) via its nitrogen atom and phenyl group substituted with at least one electron-donating group (wherein the electron-donating group refers to a hydroxyl group, alkoxy group, aryloxy group, amino group, alkylamino group, arylamino group, heterocyclic amino group or nonaromatic nitrogen-containing heterocyclic group that is bonded to the carbon atom of the general formula (4-1) via its nitrogen atom). Of these, an alkylamino group, arylamino group, 5-membered aromatic heterocyclic group having one nitrogen atom in its ring (wherein the aromatic heterocycle refers to an indole ring, pyrrole ring or carbazole ring), and a phenyl group substituted with at least one electron-donating group (in particular, a phenyl group substituted with 3 or more alkoxy groups or a phenyl group substituted with a hydroxyl group or alkylamino group or arylamino group), are more preferred. An arylamino group, 5-membered aromatic heterocyclic group having one nitrogen atom in its ring, wherein the 5-membered aromatic heterocyclic group represents a 3-indolyl group, and a phenyl group substituted with at least one electron-donating group, in particular, a trialkoxyphenyl group or a phenyl group substituted with an alkylamino group or arylamino group, are most preferred.

In the general formula (4-2), the preferred range of $R_{45}$ is the same as described above with respect to $R_{40}$ of the general formula (4-1).

Each of $R_{46}$ to $R_{49}$ preferably represents any of a hydrogen atom, alkyl group, alkenyl group, alkynyl group, aryl group, heterocyclic group, hydroxyl group, alkoxy group, amino group, alkylamino group, arylamino group, heterocyclic amino group, mercapto group, arylthio group, alkylthio group, acylamino group and sulfonamino group. Of these, a hydrogen atom, alkyl group, aryl group, heterocyclic group, alkoxy group, alkylamino group, arylamino group and heterocyclic amino group are more preferred. Most preferably, each of $R_{46}$ to $R_{49}$ represents a hydrogen atom, alkyl group, aryl group, heterocyclic group, alkylamino group or arylamino group when $Z_{42}$ represents a group of the formula —$CR_{420}R_{421}$—; represents a hydrogen atom, alkyl group, aryl group or heterocyclic group when $Z_{42}$ represents a —$NR_{423}$—; and represents a hydrogen atom, alkyl group, aryl group or heterocyclic group when $Z_{42}$ represents —O—.

$Z_{42}$ preferably represents —$CR_{420}R_{421}$— or —$NR_{423}$—, and more preferably represents —$NR_{423}$—.

Each of $R_{420}$ and $R_{421}$ preferably represents any of a hydrogen atom, alkyl group, alkenyl group, alkynyl group, aryl group, heterocyclic group, hydroxyl group, alkoxy group, amino group, mercapto group, acylamino group and sulfonamino group. Of these, a hydrogen atom, alkyl group, aryl group, heterocyclic group, alkoxy group and amino group are more preferred. $R_{423}$ preferably represents a hydrogen atom, alkyl group, aryl group or aromatic heterocyclic group, and more preferably represents methyl, ethyl, isopropyl, t-butyl, t-amyl, benzyl, diphenylmethyl, allyl, phenyl, naphthyl, 2-pyridyl, 4-pyridyl or 2-thiazolyl.

When each of $R_{40}$ to $R_{49}$, $R_{420}$, $R_{421}$ and $R_{423}$ represents a substituent, the total number of carbon atoms of each thereof is preferably 40 or less, more preferably 30 or less, and most preferably 15 or less. These substituents may be bonded with each other or bonded with other moieties (e.g., $RED_{41}$, $RED_{42}$ or $Z_{42}$) of the molecule to thereby form rings.

It is preferred that the compounds of types 1, 3 and 4 according to the present invention be "compounds each having, in its molecule, at least one group adsorptive to silver halide" or "compounds each having, in its molecule, at least one partial structure of sensitizing dye". The compound of type 2 is a "compound having, in its molecule, two or more groups adsorptive to silver halide".

With respect to the compounds belonging to types 1 to 4 according to the present invention, the group adsorptive to silver halide refers to a group directly adsorbed onto silver halide or a group capable of promoting the adsorption onto silver halide. More specifically, the group adsorptive to silver is a mercapto group (or a salt thereof), thione group (—C(═S)—), heterocyclic group containing at least one atom selected from a nitrogen atom, sulfur atom, selenium atom and tellurium atom, sulfido group, disulfido group, cationic group or ethynyl group.

Provided however that, with respect to the compound of type 2 according to the present invention, a sulfido group is not included in the adsorptive group thereof.

The mercapto group (or a salt thereof) as the adsorptive group means not only a mercapto group (or a salt thereof) per se but also, preferably, a heterocyclic, aryl or alkyl group substituted with at least one mercapto group (or salt thereof). Herein, the heterocyclic group refers to a 5- to 7-membered, monocyclic or condensed-ring, aromatic or nonaromatic heterocycle. As the heterocyclic group, there can be mentioned, for example, an imidazole ring group, thiazole ring group, oxazole ring group, benzimidazole ring group, benzothiazole ring group, benzoxazole ring group, triazole ring group, thiadiazole ring group, oxadiazole ring group, tetrazole ring group, purine ring group, pyridine ring group, quinoline ring group, isoquinoline ring group, pyrimidine ring group or triazine ring group. The heterocyclic group may be one containing a quaternary nitrogen atom, which may become a mesoion as a result of dissociation of a substituted mercapto group. This heterocyclic group can be, for example, any of an imidazolium ring group, pyrazolium ring group, thiazolium ring group, triazolium ring group, tetrazolium ring group, thiadiazolium ring group, pyridinium ring group, pyrimidinium ring group and triazinium ring group. Of these groups, a triazolium ring group (e.g., 1,2,4-triazolium-3-thiolate ring group) is preferred. The aryl group can be, for example, a phenyl group or naphthyl group. The alkyl group can be a linear, or branched, or cyclic alkyl group having 1 to 30 carbon atoms. When the mercapto group forms a salt, as the counter ion, there can be mentioned, for example, a cation of alkali metal, alkaline earth metal or heavy metal (e.g., $Li^+$, $Na^+$, $K^+$, $Mg^{2+}$, $Ag^+$ or $Zn^{2+}$), an ammonium ion, a heterocyclic group containing a quaternary nitrogen atom, or a phosphonium ion.

The mercapto group as the adsorptive group may further be tautomerized into a thione group. As such, there can be mentioned, for example, a thioamido group (herein a —C(═S)—NH— group) or a group containing a partial structure of the thioamido group, namely, a linear or cyclic thioamido group, thioureido group, thiourethane group or dithiocarbamic acid ester group. As examples of suitable cyclic groups, there can be mentioned, for example, a thiazolidine-2-thione group, oxazolidine-2-thione group, 2-thiohydantoin group, rhodanine group, isorhodanine group, thiobarbituric acid group and 2-thioxo-oxazolidin-4-one group.

The thione groups as the adsorptive group include not only the above thione groups resulting from tautomerization of mercapto groups but also a linear or cyclic thioamido group, thioureido group, thiourethane group and dithiocarbamic acid ester group which cannot be tautomerized into mercapto groups, i.e., not having any hydrogen atom at the α-position of thione group.

The heterocyclic group containing at least one atom selected from a nitrogen atom, sulfur atom, selenium atom and tellurium atom as the adsorptive group is a nitrogen-containing heterocyclic group having an —NH— group capable of forming an iminosilver (>NAg) as a partial structure of the heterocycle, or a heterocyclic group having an "—S—" group or "—Se—" group or "—Te—" group or "═N—" group capable of coordinating to silver ion by coordinate bond as a partial structure of the heterocycle. The former heterocyclic group can be, for example, a benzotriazole group, triazole group, indazole group, pyrazole group, tetrazole group, benzimidazole group, imidazole group or purine group. The latter heterocyclic group can be, for example, a thiophene group, thiazole group, oxazole group, benzothiiphene group, benzothiazole group, benzoxazole group, thiadiazole group, oxadiazole group, triazine group, selenoazole group, benzoselenoazole group, tellurazole group or benzotellurazole group. The former heterocyclic group is preferred.

As the sulfido group as the adsorptive group, there can be mentioned all the groups having a partial structure of "—S—" or "—S—S—". Preferably, the sulfido group is a group having a partial structure of alkyl (or alkylene)-X-alkyl (or alkylene), aryl (or arylene)-X-alkyl (or alkylene), or aryl (or arylene)-X-aryl(or arylene). Herein, X represents a —S— group or —S—S— group. This sulfido group or disulfido group may be in the form of a cyclic structure. As examples of the cyclic structure, there can be mentioned groups containing a thiolane ring, 1,3-dithiolane ring, 1,2-dithiolane ring, thiane ring, dithiane ring, thiomorphorine ring or the like. Among the sulfido groups, groups having a partial structure of alkyl (or alkylene)-S-alkyl (or alkylene) are especially preferred. Especially preferable disulfido group is 1,2-dithiolane ring group.

The cationic group as the adsorptive group refers to a group containing a quaternary nitrogen atom. Specifically, it is a group containing an ammonio group or a nitrogen-containing heterocyclic group containing a quaternary nitrogen atom. Herein, the ammonio group is, for example, a trialkylammonio group, dialkylarylammonio group or alkyldiarylammonio group. For example, as such, there can be mentioned benzyldimethylammonio group, trihexylammonio group or phenyldiethylammonio group. The nitrogen-containing heterocyclic group containing a quaternary nitrogen atom can be, for example, any of pyridinio group, quinolinio group, isoquinolinio group and imidazolio group. Of these, pyridinio group and imidazolio group are preferred. A pyridinio group is most preferred. The nitrogen-containing heterocyclic group containing a quaternary nitrogen atom may have an arbitrary substituent. However, when the nitrogen-containing heterocyclic group is a pyridinio group or imidazolio group, the substituent is preferably selected from, for example, an alkyl group, aryl group, acylamino group, chlorine atom, alkoxycarbonyl group and carbamoyl group. When the nitrogen-containing heterocyclic group is a pyridinio group, the substituent is most preferably a phenyl group.

The ethynyl group as the adsorptive group refers to a —C≡CH group, whose hydrogen atom may be replaced by a substituent.

The above adsorptive groups may have an arbitrary substituent.

Furthermore, examples of suitable adsorptive groups include those listed on pages 4 to 7 of JP-A-11-95355, (U.S. Pat. No. 6,054,260, the entire contents of which are incorporated herein by reference.).

In the present invention, it is preferred that the adsorptive group be a heterocyclic group substituted with mercapto (e.g., 2-mercaptothiadiazole, 3-mercapto-1,2,4-triazole, 5-mercaptotetrazole, 2-mercapto-1,3,4-oxadiazole, 2-mercaptobenzothiazole or 1,5-dimethyl-1,2,4-triazolium-3-thiolate group), a heterocyclic group substituted with dimercapto (e.g., 2,4-dimercaptopyrimidine, 2,4-dimercaptotriazine, 3,5-dimercapto-1,2,4-triazole, 2,5-dimercapto-1,3-thiazole), or a nitrogen-containing heterocyclic group having an —NH— group capable of forming an iminosilver (>NAg) as a partial structure of the heterocycle (e.g., a benzotriazole group, benzimidazole group or indazole group). Although the adsorptive group may be substituted at any position of the general formulae (1-1) to (4-2), the substitution at $RED_{11}$, $RED_{12}$, $RED_2$ or $RED_3$ is preferred in the general formulae (1-1) to (3), and the substitution at $RED_{41}$, $R_{41}$, $RED_{42}$, or $R_{46}$ to $R_{48}$ is preferred in the general formulae (4-1) and (4-2). The adsorptive group is more preferably substituted at $RED_{11}$ to $RED_{42}$ for all the general formulae (1-1) to (4-2).

The partial structure of spectral sensitizing dye refers to a group containing a chromophore of spectral sensitizing dye, and refers to a residue resulting from removal of an arbitrary hydrogen atom or substituent from a spectral sensitizing dye compound. Although the partial structure of spectral sensitizing dye may be substituted at any position of the general formulae (1-1) to (4-2), the substitution at $RED_1$, $RED_{12}$, $RED_2$ and $RED_3$ is preferred in the general formulae (1-1) to (3), and the substitution at $RED_{41}$, $R_{41}$, $RED_{42}$ and $R_{46}$ to $R_{48}$ is preferred in the general formulae (4-1) and (4-2). The adsorptive group is more preferable substituted at $RED_{11}$ to $RED_{42}$ for all the general formulae (1-1) to (4-2). Preferred spectral sensitizing dyes are those typically employed in color sensitization techniques, which include, for example, cyanine dyes, composite cyanine dyes, merocyanine dyes, composite merocyanine dyes, homopolar cyanine dyes, styryl dyes and hemicyanine dyes. Representative spectral sensitizing dyes are disclosed in Research Disclosure, item 36544, September 1994, the entire contents of which are incorporated herein by reference. These spectral sensitizing dyes can be synthesized by persons skilled in the art to which the invention pertains in accordance with the procedure described in the above Research Disclosure or F. M. Hamer "The Cyanine Dyes and Related Compounds", Interscience Publishers, New York, 1964, the entire contents of which are incorporated herein by reference. Further, all the dyes described on pages 7 to 14 of JP-A-11-95355 (U.S. Pat. No. 6,054,260) per se are applicable.

With respect to the compounds belonging to types 1 to 4 according to the present invention, the total number of carbon atoms is preferably in the range of 10 to 60, more preferably 10 to 50, most preferably 11 to 40, and optimally 12 to 30.

With respect to the compounds belonging to types 1 to 4 according to the present invention, a one-electron oxidation thereof is induced upon exposure of the silver halide photosensitive material wherein use is made of the compounds, followed by reaction. Thereafter, another electron, or two or more electrons depending on the type of compound are released to thereby cause further oxidation. The oxidation potential with respect to the first electron is preferably about 1.4V or below, more preferably 1.0V or below. This oxidation potential is preferably higher than 0V, more preferably higher than 0.3V. Thus, the oxidation potential is preferably in the range of about 0 to about 1.4V, more preferably about 0.3 to about 1.0V.

Herein, the oxidation potential can be measured in accordance with the cyclic voltammetry technique. For example, a sample compound is dissolved in a solution consisting of a 80%:20% (vol. %) mixture of acetonitrile and water (containing 0.1 M lithium perchlorate), and nitrogen gas is passed through the solution for 10 min. Thereafter, the oxidation potential is measured at 25° C. and at a potential scanning rate of 0.1V/sec with the use of a glassy carbon disk as a working electrode, a platinum wire as a counter electrode and a calomel electrode (SCE) as a reference electrode. The oxidation potential vs. SCE is determined at the peak potential of cyclic voltammetry wave.

With respect to, among the compounds of types 1 to 4 according to the present invention, those which undergo a one-electron oxidation and, after a subsequent reaction, further release another electron, the oxidation potential at the latter stage is preferably in the range of −0.5 to −2V, more preferably −0.7 to −2V, and most preferably −0.9 to −1.6V.

On the other hand, with respect to, among the compounds belonging to types 1 to 4 according to the present invention, those which undergo a one-electron oxidation and, after a subsequent reaction, further release two or more electrons to thereby effect oxidation, the oxidation potential at the latter stage is not particularly limited. The reason is that the oxidation potential with respect to the second electron cannot be clearly distinguished from the oxidation potential with respect to the third electron et seqq., so that it is often difficult to practically accomplish accurate measuring and distinguishing thereof.

Specific examples of the compounds belonging to types 1 to 4 according to the present invention will be listed below, which however in no way limit the scope of the present invention.

1
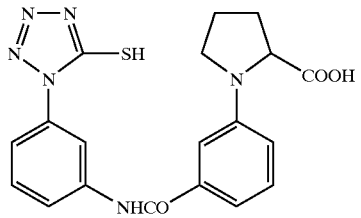
2
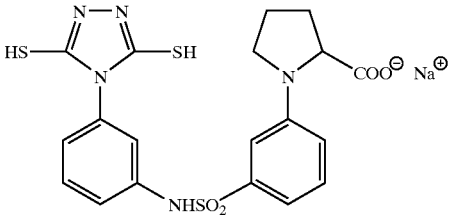
3
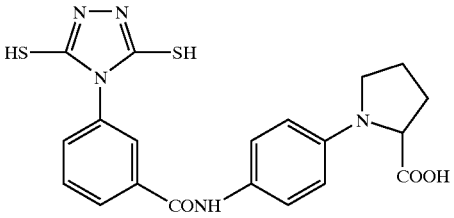
4
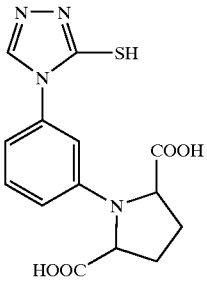
5
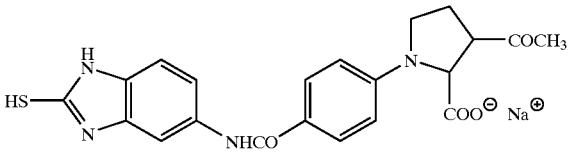
6
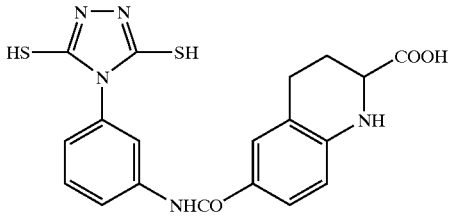
-continued
7
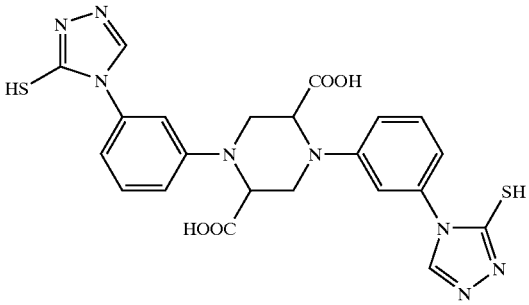
8
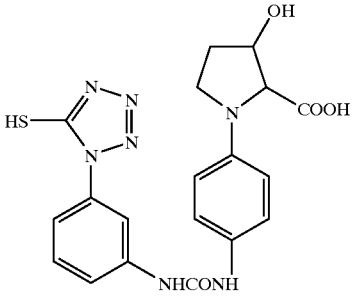
9
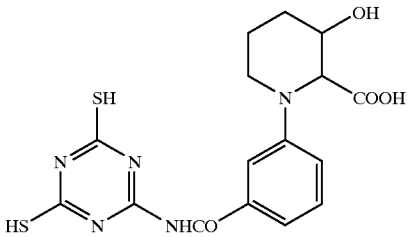
10
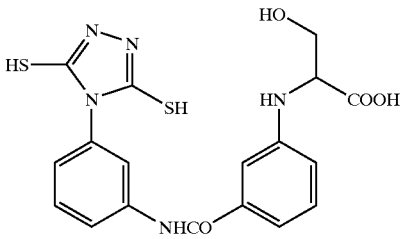
11
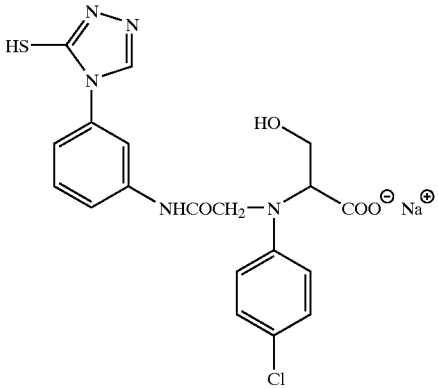

-continued
12
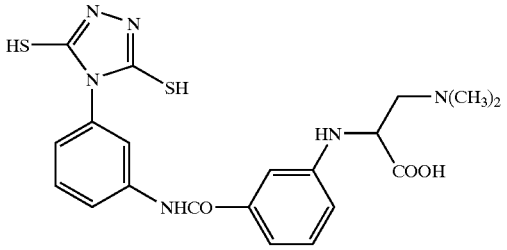
13
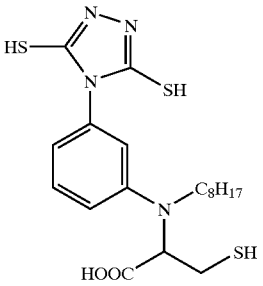
14
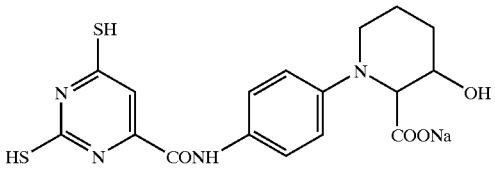
15
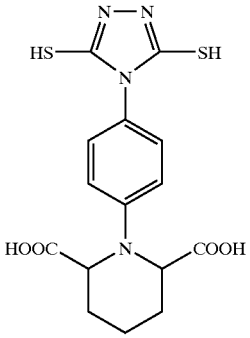
16
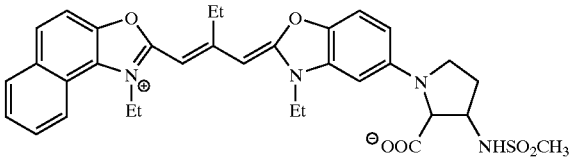
17
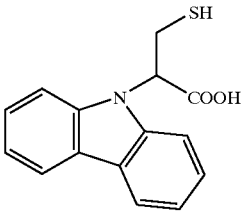
-continued
18
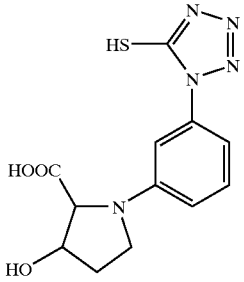
19
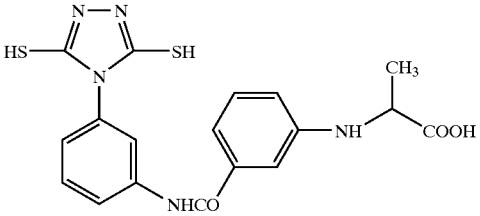
20
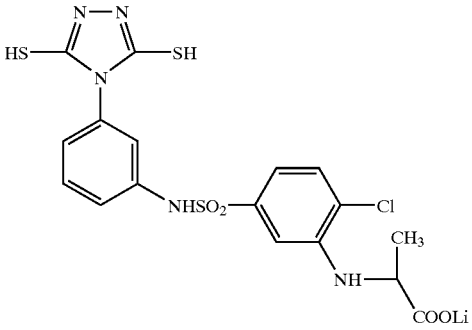
21
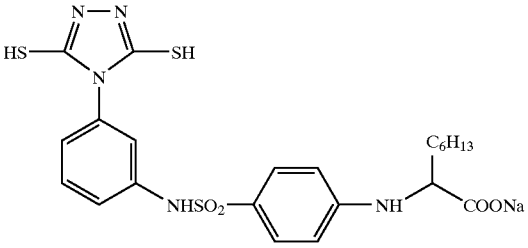
22
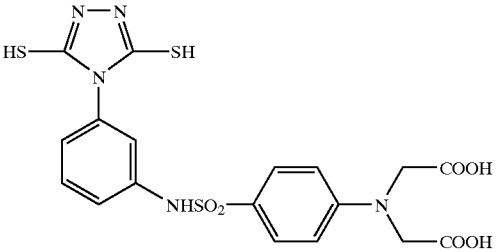

-continued
23
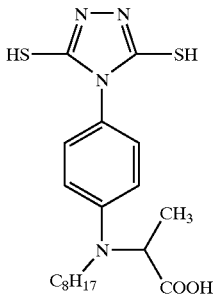
24
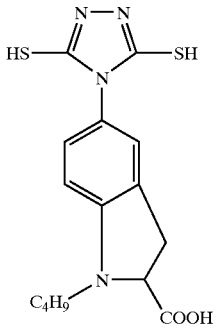
25
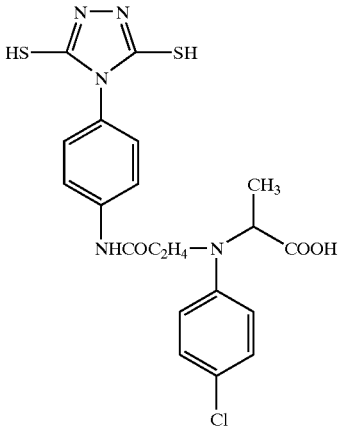
26
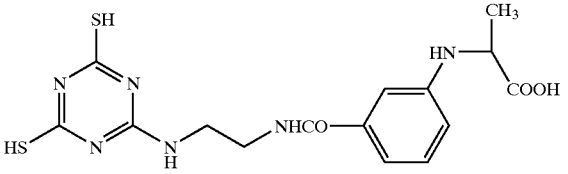
27
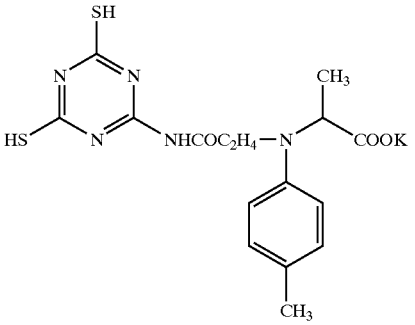
-continued
28
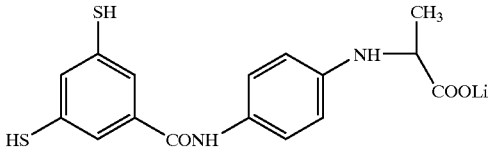
29
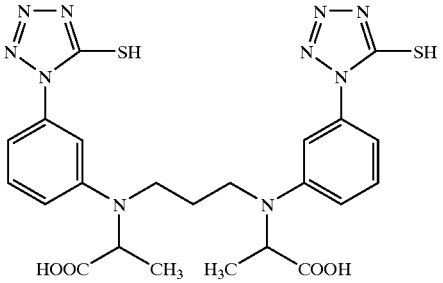
30
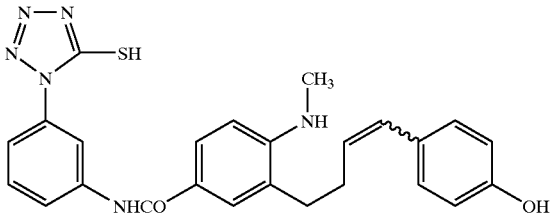
(cis or trans)
31
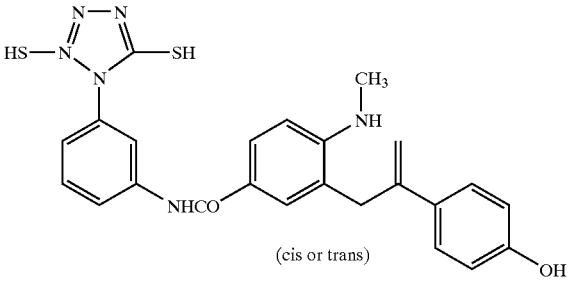
(cis or trans)
32
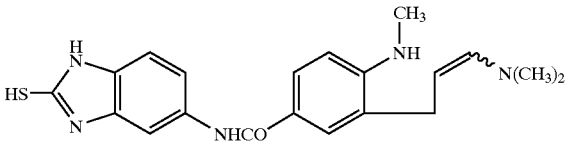
33
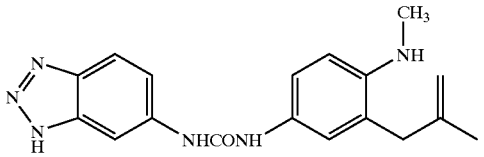
34
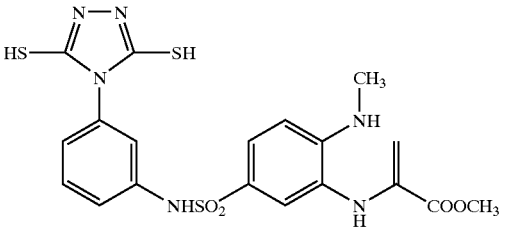

-continued
35
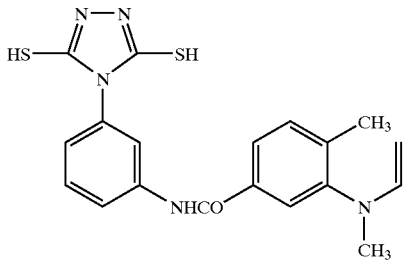
36
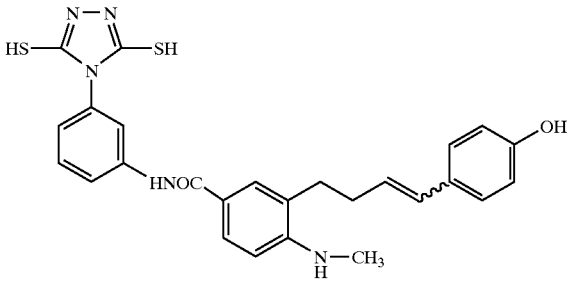
(cis or trans)
37
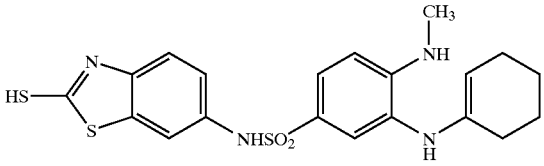
38
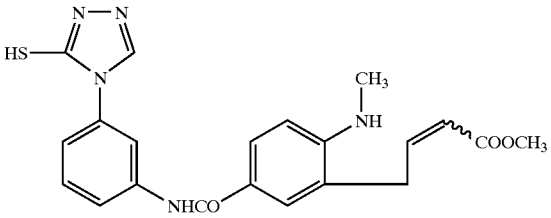
(cis or trans)
39
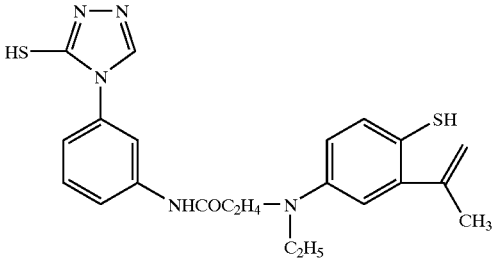
40
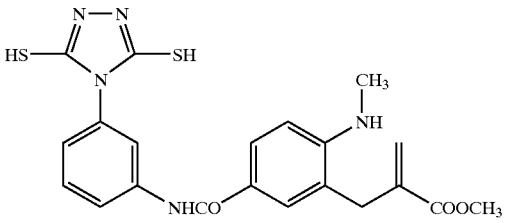
-continued
41
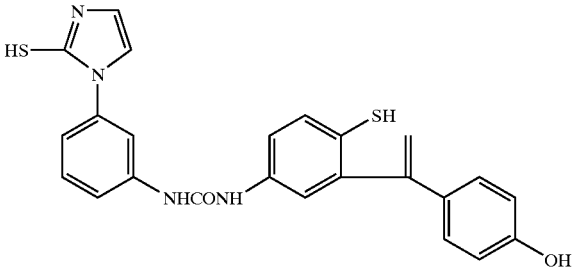
42
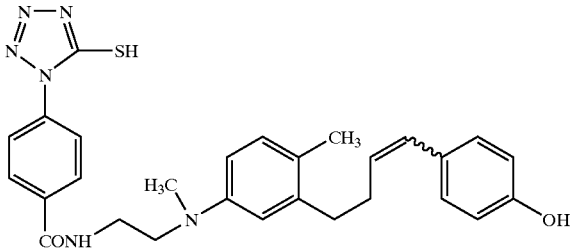
(cis or trans)
43
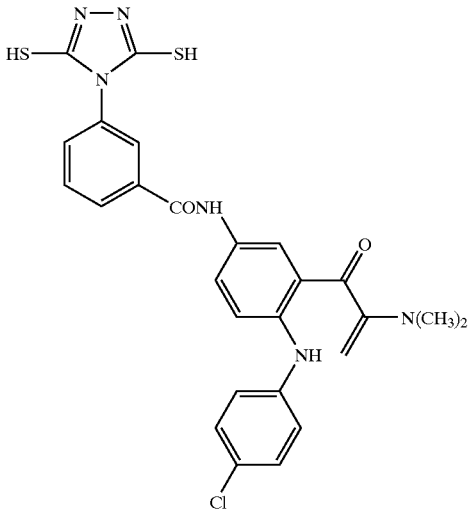
44
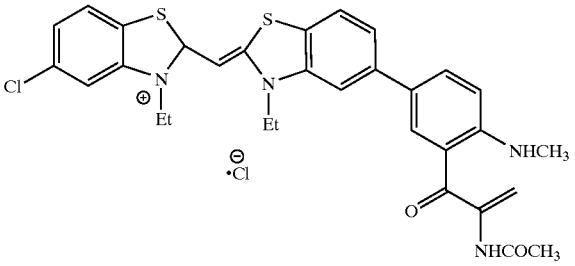
45
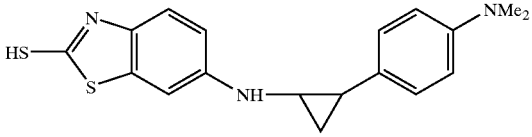

-continued
46
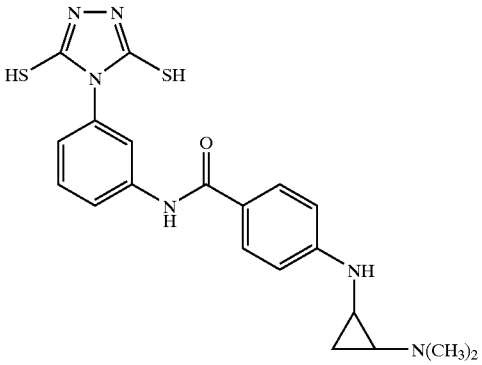
47
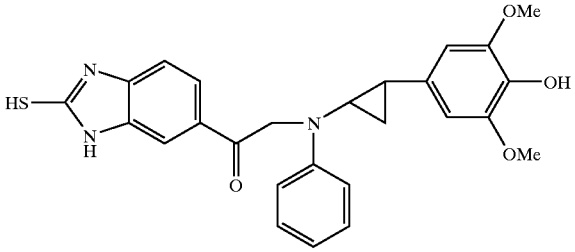
48
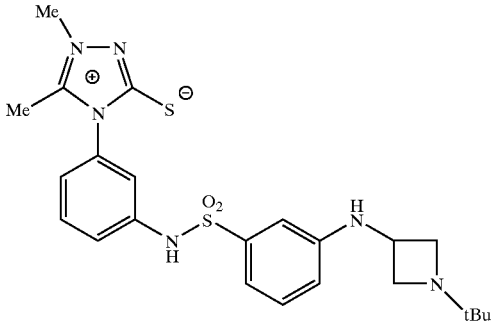
49
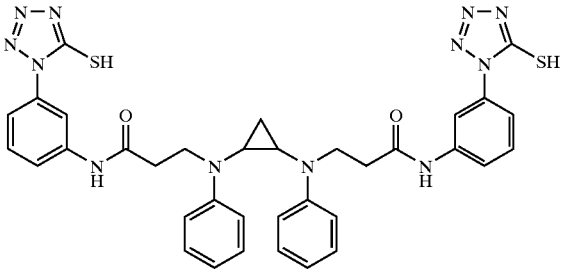
50
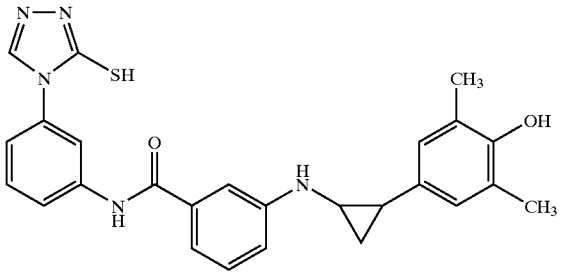
-continued
51
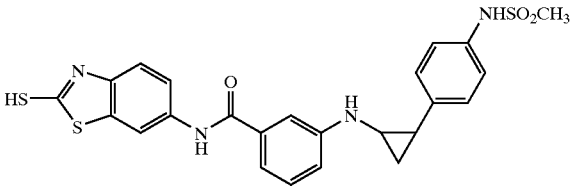
52
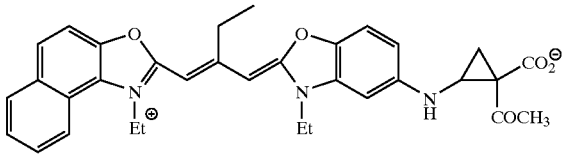
53
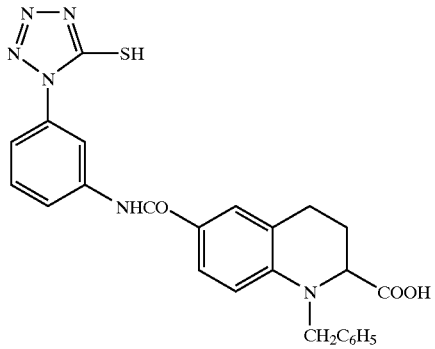
54
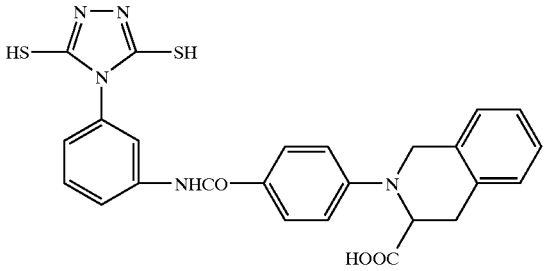
55
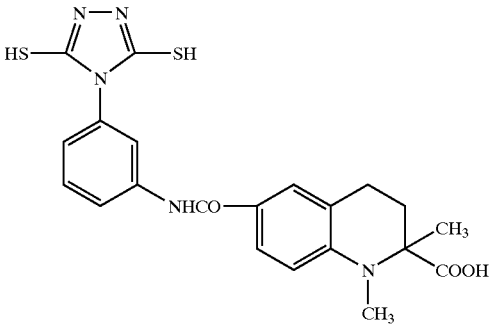
56
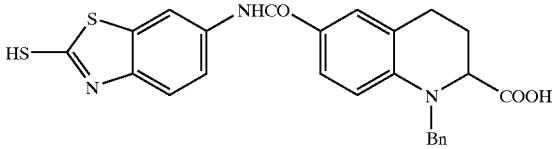

The compounds belonging to types 1 to 4 are the same as those described in detail in Jpn. Pat. Appln. Nos. 2002-192373, 2002-192374, 2002-188537 and 2002-188536, and JP-A-2003-75950, the entire contents of all of which are incorporated herein by reference. The specific compounds described in these patent applications are also examples of the compounds belonging to types 1 to 4 of the present invention. Also, synthetic examples of the compounds belonging to types 1 to 4 are the same as those described in these patent applications.

The compound belonging to types 1 to 4 may be used at any time during emulsion preparation or in photosensitive material manufacturing step, for example, during grain formation, at desalting step, at the time of chemical sensitization, or before coating. The compound may be added separately in a plurality of times during the steps. Preferable addition timing is from the completion of grain formation to before a desalting step, at the time of chemical sensitization (immediately before the initiation of chemical sensitization to immediately after the completion thereof), or before coating. More preferable addition timing is at chemical sensitization or before coating.

The compound belonging to types 1 to 4 may preferable be added by dissolving it to a water or water-soluble solvent such as methanol, ethanol or a mixture of solvents. When the compound is added to water, if the solubility of the compound increases in a case where pH is raised or lowered, the compound may be added to the solvent by raising or lowering the pH thereof.

It is preferable that the compound belonging to types 1 to 4 is used in an emulsion layer, but the compound may be added in a protective layer or interlayer together with the emulsion layer, thereby making the compound diffuse during coating. The addition time of the compound of the invention is irrespective of before or after the addition time of a sensitizing dye. Each of the compounds is preferably contained in a silver halide emulsion layer in an amount of $1\times10^{-9}$ to $5\times10^{-2}$ mol, more preferably $1\times10^{-8}$ to $2\times10^{-3}$ mol pre mol of silver halide.

The silver halide photosensitive material of the present invention preferably has a layer containing at least one compound that exhibits an oxidation potential of 0.18 to 0.90 eV. More preferably, this compound is contained in the silver halide emulsion layer containing at least one compound selected from among the compounds represented by the above general formulae (1-1) to (4-2). The oxidation potential can be measured by the cyclic voltammetry technique as mentioned above.

Examples of the compounds exhibiting an oxidation potential of 0.18 to 0.90 eV according to the present invention will be set out below, which however in no way limit the scope of the present invention.

A-2

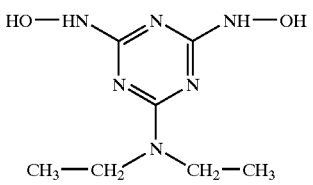

-continued

A-3

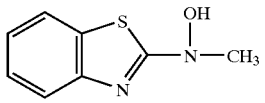

A-4

$NH_2$—CONH—OH

A-5 t-$C_4H_9$—O—CONH—OH

A-6

$NH_2$—CON($CH_3$)—OH

A-7 n-$C_{14}H_{29}$—OCO—$(CH_2)_2$—CON($CH_3$)OH

A-8

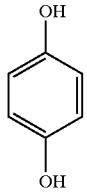

A-9

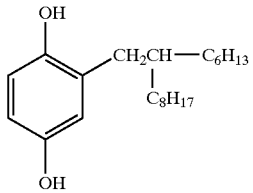

A-10

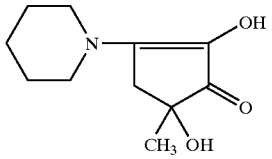

It is preferred that the silver halide emulsion grains of the present invention be chemically sensitized by the use of at least one sensitizer selected from the later described sulfur sensitizers, selenium sensitizers and tellurium sensitizers. When shell covering with silver halide is carried out after the step of chemical sensitization so that the average shell thickness of each grain becomes 20 nm or less, the advantages of the present invention are more conspicuous. More preferably, the average shell thickness is 10 nm or less.

The shell covering may be accomplished by either the method of adding silver halide fine grains, or adding a solution containing halide ions, such as an aqueous solution of at least one alkali metal salt of bromine, chlorine or iodine, together with a solution containing silver ions, or the method of jointly adding silver halide fine grains and a solution containing silver ions.

When silver halide fine grains are employed in the shell covering, it is preferred that the amount of silver chloride contained in the silver halide fine grains be in the range of 0 to 10 mol % based on the silver halide fine grains. When, in place of the silver halide fine grains, a solution containing halide ions and a solution containing silver ions are added, it is preferred that the amount of added chloride ions be in the range of 0 to 10 mol % based on all the halide ions contained in the solution containing halide ions.

The amount of silver halides used in the shell covering is in the range of 0.05 to 20 mol %, preferably 0.2 to 15 mol %, based on the silver halide grains over which the shell is formed.

The silver halide grains for use in the present invention preferably contain 0.5 to 22 mol % of silver iodide. More preferably, the content of silver iodide is in the range of 1 to 10 mol %. Boundaries of layers having different silver iodide contents may be clear, or may continuously and gently change. At the time of grain formation, iodide ions may be added from the middle of later described growth stage so that the ensuing the subsequent silver iodide content becomes uniform. Also, the addition may be performed so as to effect high concentration in the beginning and concentration decreased with the passage of time, or so as to effect low concentration in the beginning and concentration increased with the passage of time, or so as to cause the concentration of iodide ion to change during the course of addition. The introduction of silver iodide may be effected by simultaneously adding a halide ion solution containing iodide ions and a silver nitrate solution, or by separate addition thereof. It also can be achieved solely by adding only a solution containing iodide ions under such conditions that iodide ions are incorporated in the grains. Further, use may be made of the method of adding silver iodide fine grains. Dislocation lines may be incorporated in grain main planes or peripheral portions by the introduction of iodide gaps during the course of grain formation, or such an incorporation of dislocation lines may not be performed.

With respect to the configuration of grains, the grains may be in the form of regular crystals or in the form of tabular grains. The tabular grains each have parallel main planes and sides joining the main planes to each other. The tabular grains generally each have one or two twin planes between the main planes. The tabular grains for use in the present invention may be tabular grains comprising a twin plane as mentioned above. However, with respect to the tabular grains, it is preferred that the average projected area diameter thereof be in the range of 0.08 to 2.0 $\mu$m. In the use of cubic regular crystals, the length of each side thereof is preferably 0.2 $\mu$m or less. The average projected area diameter thereof is more preferably in the range of 0.1 to 0.8 $\mu$m. The average projected area diameter is most preferably in the range of 0.15 to 0.5 $\mu$m.

The variation coefficient of distribution of grain projected area diameters is preferably 30% or below, more preferably 25% or below. The projected area diameter and aspect ratio can be measured from electron micrographs according to the carbon replica method wherein the grains together with reference latex spheres are shadowed. Although the tabular grains, when viewed in the direction perpendicular to the main plane, generally each have a hexagonal, triangular or circular shape, the projected area diameter thereof is defined as the diameter of a circle whose area is equal to the projected area of the tabular grains. The aspect ratio refers to the quotient of the projected area diameter divided by the thickness of tabular grains. With respect to the configuration of main planes of tabular grains, the higher the ratio of hexagonal shape, the greater the preference. Further, it is preferred that the ratio between the lengths of hexagon adjacent sides be 1:2 or below. Herein, the average projected area diameter and aspect ratio refer to those determined from the averages of projected area diameters and thickness of 100 or more grains contained in a uniform emulsion.

The higher to some extent the aspect ratio of tabular grains, the greater the advantages of the present invention realized by the tabular grains. It is preferred that 50% or more of the total projected area of tabular grains be occupied by grains of 5 or higher aspect ratio. When the aspect ratio is too large, the above variation coefficient of grain size distribution tends to increase. Therefore, generally, the aspect ratio is preferably 20 or below.

In the present invention, the emulsions of the present invention wherein preferred tabular silver iodobromide emulsions are contained can be prepared by various methods. For example, the preparation of tabular grains generally consists of three fundamental steps, namely, nucleation, ripening and growth. In the step of nucleation of tabular grain emulsions preferred in the present invention, it is extremely effective to employ a gelatin of low methionine content as described in U.S. Pat. Nos. 4,713,320 and 4,942,120; to carry out nucleation at high pBr as described in U.S. Pat. No. 4,914,014; and to carry out nucleation within a short period of time as described in JP-A-2-222940, the entire contents of all of which are incorporated herein by reference. In the step of ripening the tabular portions of grains according to the present invention, it is occasionally effective to conduct ripening in the presence of a low-concentration base as described in U.S. Pat. No. 5,254,453, and to carry out ripening at high pH as described in U.S. Pat. No. 5,013,641, the entire contents of both of which are incorporated herein by reference. In the step of growing the emulsion grains according to the present invention, it is especially effective to carry out growth at low temperatures as described in U.S. Pat. No. 5,248,587, and to employ silver iodide fine grains as described in U.S. Pat. Nos. 4,672,027 and 4,693,964, the entire contents of all of which are incorporated herein by reference.

The silver halide emulsion grains of the present invention can have the effect thereof enhanced when used in a silver halide color reversal photosensitive material containing at least one azole magenta coupler represented by the following general formula (MC-I):

(MC-1)

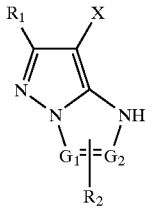

In general formula (MC-I), $R_1$ represents a hydrogen atom or substituent; one of $G_1$ and $G_2$ represents a carbon atom, and the other represents a nitrogen atom; and $R_2$ represents a substituent that substitutes one of $G_1$ and $G_2$ which is a carbon atom. $R_1$ and $R_2$ may further have a substituent. A polymer may be formed, via $R_1$ or $R_2$, with general formula (MC-I) as constituting units. A polymer chain may be bonded via $R_1$ or $R_2$. X represents a hydrogen atom or a group that is capable of splitting off by a coupling reaction with an oxidized aromatic primary amine color developing agent.

In the formula $R_1$ represents a hydrogen atom or substituent, $R_2$ represents a substituent. Examples of the substituents represented by $R_1$ and $R_2$ are a halogen atom, alkyl group (including a cycloalkyl group and bicycloalkyl group), alkenyl group (including a cycloalkenyl group and bicycloalkenyl group), alkynyl group, aryl group, heterocyclic group, cyano group, hydroxyl group, nitro group, carboxyl group, alkoxy group, aryloxy group, silyloxy group, heterocyclic oxy group, acyloxy group, carbamoyloxy group, alkoxycarbonyloxy group, aryloxycarbonyloxy group, amino group (including an anilino group), acylamino group, aminocarbonylamino group, alkoxycarbonylamino group, aryloxycarbonylamino group, sulfamoylamino group, alkyl- and aryl-sulfonylamino groups, mercapto group, alkylthio group, arylthio group, heterocyclic thio group, sulfamoyl group, sulfo group, alky- and aryl-sulfinyl groups, alkyl- and aryl-sulfonyl groups, acyl group, aryloxycarbonyl group, alkoxycarbonyl group, carbamoyl group, aryl- and heterocyclic-azo groups, imide group, phosphino group, phosphinyl group, phosphinyloxy group, phosphinylamino group, and silyl group.

Examples of the substituents represented by $R_1$ and $R_2$ in more detail are halogen atom (e.g., a chlorine atom, bromine atom, and iodine atom), an alkyl group [which represents a straight-chain, branched, or cyclic, substituted or unsubstituted alkyl group. Examples are an alkyl group (preferably a 1- to 30-carbon, substituted or unsubstituted alkyl group, e.g., methyl, ethyl, n-propyl, isopropyl, t-butyl, n-octyl, eicosyl, 2-chloroethyl, 2-cyanoethyl, and 2-ethylhexyl), cycloalkyl group (preferably a 3- to 30-carbon, substituted or unsubstituted cycloalkyl group, e.g., cyclohexyl, cyclopentyl, and 4-n-dodecylcyclohexyl), bicycloalkyl group (preferably a 5- to 30-carbon, substituted or unsubstituted bicycloalkyl group, i.e., a monovalent group obtained by removing one hydrogen atom from 5- to 30-carbon bicycloalkane. Examples are bicyclo[1,2,2]heptane-2-yl and bicyclo[2,2,2]octane-3-yl)], an alkenyl group [which represents a straight-chain, branched, or cyclic, substituted or unsubstituted alkenyl group. Examples are an alkenyl group (preferably a 2- to 30-carbon, substituted or unsubstituted alkenyl group, e.g., vinyl, allyl, prenyl, geranyl, and oleyl), cycloalkenyl group (preferably a 3- to 30-carbon, substituted or unsubstituted cycloalkenyl group, i.e., a monovalent group obtained by removing one hydrogen atom from 3- to 30-carbon cycloalkene. Examples are 2-cyclopentene-1-yl and 2-cyclohexene-1-yl), bicycloalkenyl group (a substituted or unsubstituted bicycloalkenyl group, preferably a 5- to 30-carbon, substituted or unsubstituted bicycloalkenyl group, i.e., a monovalent group obtained by removing one hydrogen atom from bicycloalkene having one double bond. Examples are bicyclo[2,2,1]hepto-2-ene-1-yl and bicyclo[2,2,2]octo-2-ene-4-yl)], an alkynyl group (preferably a 2- to 30-carbon, substituted or unsubstituted alkynyl group, e.g., ethynyl, propargyl, and trimethylsilylethynyl), aryl group (preferably a 6- to 30-carbon, substituted or unsubstituted aryl group, e.g., phenyl, p-tolyl, naphthyl, m-chlorophenyl, and o-hexadecanoylaminophenyl), heterocyclic group (preferably a monovalent group obtained by removing one hydrogen atom from a 5- or 6-membered, substituted or unsubstituted, aromatic or nonaromatic heterocyclic compound, and more preferably, a 3- to 30-carbon, 5- or 6-membered aromatic heterocyclic group. Examples are 2-furyl, 2-thienyl, 2-pyrimidinyl, and 2-benzothiazolyl), cyano group, hydroxyl group, nitro group, carboxyl group, alkoxy group (preferably a 1- to 30-carbon, substituted or unsubstituted alkoxy group, e.g., methoxy, ethoxy, isopropoxy, t-butoxy, n-octyloxy, and 2-methoxyethoxy), an aryloxy group (preferably a 6- to 30-carbon, substituted or unsubstituted aryloxy group, e.g., phenoxy, 2-methylphenoxy, 4-t-butylphenoxy, 3-nitrophenoxy, and 2-tetradecanoylaminophenoxy), silyloxy group (preferably a 3- to 20-carbon silyloxy group, e.g., trimethylsilyloxy and t-butyldimethylsilyloxy), heterocyclic oxy group (preferably a 2- to 30-carbon, substituted or unsubstituted heterocyclic oxy group, e.g., 1-phenyltetrazole-5-oxy and 2-tetrahydropyranyloxy), acyloxy group (preferably a formyloxy group, 2- to 30-carbon, substituted or unsubstituted alkylcarbonyloxy group, and 7- to 30-carbon, substituted or unsubstituted arylcarbonyloxy group, e.g., formyloxy, acetyloxy, pivaloyloxy, stearoyloxy, benzoyloxy, and p-methoxyphenylcarbonyloxy), carbamoyloxy group (preferably a 1- to 30-carbon, substituted or unsubstituted carbamoyloxy group, e.g., N,N-dimethylcarbamoyloxy, N,N-diethylcarbamoyloxy, morpholinocarbonyloxy, N,N-di-n-octylaminocarbonyloxy, and N-n-octylcarbamoyloxy), alkoxycarbonyloxy group (preferably a 2- to 30-carbon, substituted or unsubstituted alkoxycarbonyloxy group, e.g., methoxycarbonyloxy, ethoxycarbonyloxy, t-butoxycarbonyloxy, and n-octylcarbonyloxy), aryloxycarbonyloxy group (preferably a 7- to 30-carbon, substituted or unsubstituted aryloxycarbonyloxy group, e.g., phenoxycarbonyloxy, p-methoxyphenoxycarbonyloxy, and p-(n-hexadecyloxy)phenoxycarbonyloxy), an amino group (including an anilino group) (preferably an amino group, 1- to 30-carbon, substituted or unsubstituted alkylamino group, and 6- to 30-carbon, substituted or unsubstituted anilino group, e.g., amino, methylamino, dimethylamino, anilino, N-methyl-anilino, and diphenylamino), acylamino group (preferably a formylamino group, 2- to 30-carbon, substituted or unsubstituted alkylcarbonylamino group, and 7- to 30-carbon, substituted or unsubstituted arylcarbonylamino group, e.g., formylamino, acetylamino, pivaloylamino, lauroylamino, benzoylamino, and 3,4,5-tri-(n-octyloxy)phenylcarbonylamino), aminocarbonylamino group (preferably a 1- to 30-carbon, substituted or unsubstituted aminocarbonylamino, e.g., carbamoylamino, N,N-dimethylaminocarbonylamino, N,N-diethylaminocarbonylamino, and morpholinocarbonylamino), an alkoxycarbonylamino group (preferably a 2- to 30-carbon, substituted or unsubstituted alkoxycarbonylamino group, e.g., methoxycarbonylamino, ethoxycarbonylamino, t-butoxycarbonylamino, n-octadecyloxycarbonylamino, and N-methyl-methoxycarbonylamino), aryloxycarbonylamino group (preferably a 7- to 30-carbon, substituted or unsubstituted aryloxycarbonylamino group, e.g., phenoxycarbonylamino, p-chlorophenoxycarbonylamino, and m-(n-octyloxy)phenoxycarbonylamino), sulfamoylamino group (preferably a 0- to 30-carbon, substituted or unsubstituted sulfamoylamino group, e.g., sulfamoylamino, N,N-dimethylaminosulfonylamino, and N-(n-octyl)aminosulfonylamino), alkyl- and aryl-sulfonylamino groups (preferably 1- to 30-carbon, substituted or unsubstituted alkylsulfonylamino and 6- to 30-carbon, substituted or unsubstituted arylsulfonylamino, e.g., methylsulfonylamino, butylsulfonylamino, phenylsulfonylamino, 2,3,5-trichlorophenylsulfonylamino, and p-methylphenylsulfonylamino), mercapto group, alkylthio group (preferably a 1- to 30-carbon, substituted or unsubstituted alkylthio group, e.g., methylthio, ethylthio, and n-hexadecylthio), arylthio group (preferably a 6- to 30-carbon, substituted or unsubstituted arylthio group, e.g., phenylthio, p-chlorophenylthio, and m-methoxyphenylthio), heterocyclic thio group (preferably a 3- to 30-carbon, substituted or unsubstituted heterocyclic thio group, e.g., 2-benzothiazolylthio and 1-phenyl-tetrazole-5-ylthio), sulfamoyl group (preferably a 0- to 30-carbon, substituted or unsubstituted sulfamoyl group, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), sulfo group, alkyl- and aryl-sulfinyl groups (preferably a 1- to 30-carbon, substituted or unsubstituted alkylsulfinyl group and 6- to 30-carbon, substituted or unsubstituted arylsulfinyl group, e.g., methylsulfinyl, ethylsulfinyl, phenylsulfinyl, and p-methylphenylsulfinyl), alkyl- and aryl-sulfonyl groups (preferably a 1- to 30-carbon, substituted or unsubstituted alkylsulfonyl group and 6- to 30-carbon, substituted or unsubstituted arylsulfonyl group, e.g., methylsulfonyl, ethylsulfonyl, phenylsulfonyl, and p-methylphenyl-sulfonyl), acyl group (preferably a formyl group, 2- to 30-carbon, substituted or unsubstituted alkylcarbonyl group, and 7- to 30-carbon, substituted or unsubstituted arylcarbonyl group, e.g., acetyl, pivaloyl, 2-chloroacetyl, stearoyl, benzoyl, and p-(n-octyloxy)phenylcarbonyl), aryloxycarbonyl group (preferably a 7- to 30-carbon, substituted or unsubstituted aryloxycarbonyl group, e.g., phenoxycarbonyl, o-chlorophenoxycarbonyl, m-nitrophenoxycarbonyl, and p-(t-butyl)phenoxycarbonyl), alkoxycarbonyl group (preferably a 2- to 30-carbon, substituted or unsubstituted alkoxycarbonyl group, e.g., methoxycarbonyl, ethoxycarbonyl, t-butoxycarbonyl, and n-octadecyloxycarbonyl), carbamoyl group (preferably 1- to 30-carbon, substituted or unsubstituted carbamoyl, e.g., carbamoyl, N-methylcarbamoyl, N,N-dimethylcarbamoyl, N,N-di-n-octylcarbamoyl, and N-(methylsulfonyl) carbamoyl), aryl- and heterocyclic-azo groups (preferably a 6- to 30-carbon, substituted or unsubstituted arylazo group and 3- to 30-carbon, substituted or unsubstituted heterocyclic azo group, e.g., phenylazo, p-chlorophenylazo, and 5-ethylthio-1,3,4-thiadiazole-2-ylazo), imido group (preferably N-succinimido and N-phthalimido), phosphino group (preferably a 2- to 30-carbon, substituted or unsubstituted phosphino group, e.g., dimethylphosphino, diphenylphosphino, and methylphenoxyphosphino), phosphinyl group (preferably a 2- to 30-carbon, substituted or unsubstituted phosphinyl group, e.g., phosphinyl, dioctyloxyphosphinyl, and diethoxyphosphinyl), phosphinyloxy group (preferably a 2- to 30-carbon, substituted or unsubstituted phosphinyloxy group, e.g., diphenoxyphosphinyloxy and dioctyloxyphosphinyloxy), phosphinylamino group (preferably a 2- to 30-carbon, substituted or unsubstituted phosphinylamino group, e.g., dimethoxyphosphinylamino and dimethylaminophosphinylamino), silyl group (preferably a 3- to 30-carbon, substituted or unsubstituted silyl group, e.g., trimethylsilyl, t-butyldimethylsilyl, and phenyldimethylsilyl).

Of the above substituents, those having a hydrogen atom may be further substituted by the above groups by removing the hydrogen atom. Examples of such substituents are an alkylcarbonylaminosulfonyl group, arylcarbonylaminosulfonyl group, alkylsulfonylaminocarbonyl group, and arylsulfonylaminocarbonyl group. Examples of these groups are methylsulfonylaminocarbonyl, p-methylphenylsulfonylaminocarbonyl, acetylaminosulfonyl, and a benzoylaminosulfonyl group.

Among these, $R_1$ preferably represents any of a hydrogen atom, alkyl group, aryl group, alkoxy group, aryloxy group, amino group, acylamino group, arylthio group, alkylthio group, aminocarbonylamino group, alkoxycarbonylamino group, carbamoyloxy group and heterocyclic thio group. These groups may have substituents.

$R_1$ more preferably represents an alkyl group, aryl group, alkoxy group, aryloxy group or amino group (including an anilino group). Still more preferably, $R_1$ represents a secondary or tertiary alkyl group whose total number of carbon atoms is in the range of 3 to 15. Most preferably, $R_1$ represents a tertiary alkyl group having 4 to 10 carbon atoms.

Either one of $G_1$ and $G_2$ represents a nitrogen atom, and the other represents a carbon atom. The one being a carbon atom is substituted with $R_2$ represented by the general formula (MC-I). In the present invention, it is preferred that $G_1$ represent a carbon atom, $G_2$ represent a nitrogen atom, and $G_1$ be substituted with $R_2$.

$R_2$ can preferably be any of an alkyl group, aryl group, alkoxy group, aryloxy group, alkylthio group, aminocarbonylamino group, alkoxycarbonylamino group and acylamino group. It is further preferred that $R_2$ represent a group containing an alkyl or aryl of 6 to 30 carbon atoms as a partial structure thereof, the total number of carbons atoms of the group being in the range of 6 to 70, so as to impart immobility to the coupler of the general formula (MC-I).

It is also preferred that $R_2$ represent a group linked to a polymer chain through an alkyl group, aryl group, alkoxy group, aryloxy group, alkylthio group, aminocarbonylamino group, alkoxycarbonylamino group, acylamino group or a group consisting of a combination of these so as to impart immobility to the coupler of the general formula (MC-I).

In the present specification, a group "having an aryl group as a partial structure thereof" includes those in which the group is substituted with an aryl group, as well as the group itself is an aryl group. The same can be applied to the case where a group has another group than an aryl group (e.g., an alkyl group), as a partial structure thereof. That is, a group "has an alkyl group as a partial structure thereof" includes the case where an alkyl group is substituted to the group and the case where the group itself is an alkyl group.

X represents a hydrogen atom or a group that is capable of splitting off by a coupling reaction with an oxidized aromatic primary amine color developing agent. Examples of the group that is capable of splitting off, other than a hydrogen atom, are a halogen atom, alkoxy group, aryloxy group, acyloxy group, alkyl- and aryl-sulfonyloxy groups, acylamino group, alkyl- and aryl-sulfonamido groups, alkoxycarbonyloxy group, aryloxycarbonyloxy group, alkyl-, aryl- and heterocyclic-thio groups, carbamoylamino group, carbamoyloxy group, 5- or 6-membered nitrogen-containing heterocyclic group, imido group, and arylazo group. These groups may be substituted with a group mentioned as the substituent for $R_2$.

In more detail, examples of the splitting-off group represented by X are a halogen atom (e.g., a fluorine atom, chlorine atom, and bromine atom), alkoxy group (e.g., ethoxy, dodecyloxy, methoxyethylcarbamoylmethoxy, carboxypropyloxy, methylsulfonylethoxy, and ethoxycarbonylmethoxy), aryloxy group (e.g., 4-methylphenoxy, 4-chlorophenoxy, 4-methoxyphenoxy, 4-carboxyphenoxy, 4-methoxycarboxyphenoxy, 4-carbamoylphenoxy, 3-ethoxycarboxyphenoxy, 3-acetylaminophenoxy, and 2-carboxyphenoxy), acyloxy group (e.g., acetoxy, tetradecanoyloxy, and benzoyloxy), alkyl- and aryl-sulfonyloxy groups (e.g., methanesulfonyloxy and toluenesulfonyloxy), acylamino group (e.g., dichloroacetylamino and heptafluorobutyloylamino), alkyl- and aryl-sulfonamide group (e.g., methanesulfonamino, trifluoromethanesulfonamino, and p-toluenesulfonylamino), alkoxycarbonyloxy group (e.g., ethoxycarbonyloxy and benzyloxycarbonyloxy), aryloxycarbonyloxy group (e.g., phenoxycarbonyloxy), alkyl-, aryl- and heterocyclic-thio groups (e.g., dodecylthio, 1-carboxydodecylthio, phenylthio, 2-butoxy-5-t-octylphenylthio, and tetrazolylthio), carbamoylamino group (e.g., N-methylcarbamoylamino and N-phenylcarbamoylamino), carbamoyloxy group (e.g., N,N-dimethylcarbamoyloxy, N-phenylcarbamoyloxy, morpholinylcarbonyloxy, and pyrrolidinylcarbonyloxy), 5- or 6-membered, nitrogen-containing heterocyclic group (e.g., imidazolyl, pyrazolyl, triazolyl, tetrazolyl, and 1,2-dihydro-2-oxo-1-pyridyl), imido group (e.g., succinimido and hydantoinyl), and arylazo group (e.g., phenylazo and 4-methoxyphenylazo). X can also take the form of a bis coupler obtained by condensing a 4-equivalent coupler by aldehydes or ketones, as a split-off group bonded via a carbon atom.

X is preferably a hydrogen atom, halogen atom, aryloxy group, alkyl- or aryl-thio group, or 5- or 6-membered, nitrogen-containing heterocyclic group which bonds to the coupling active position by a nitrogen atom, and particularly preferably a hydrogen atom, chlorine atom, or phenoxy group which can be substituted. In the present invention, a hydrogen atom is most preferred in respect of color balance of processing dependency.

In those preferred among the couplers represented by the general formula (MC-I), $R_1$ represents a secondary or tertiary alkyl group or aryl group; $G_1$ represents a carbon atom; $G_2$ represents a nitrogen atom; $R_2$ represents a substituted alkyl group or substituted aryl group, the substituent of $R_2$ selected from an alkoxy group, aryloxy group, acylamino group, aminocarbonylamino group, alkylthio group, arylthio group, alkoxycarbonylamino group, aryloxycarbonylamino group, alkyl- and aryl-sulfonylamino groups, carbamoyl group, sulfamoyl group, sulfonyl group, alkoxycarbonyl group, acyloxy group, carbamoyloxy group, sulfinyl group, phosphonyl group, acyl group and halogen atom; and X represents a hydrogen atom, chlorine atom or a substituted or unsubstituted phenoxy group. Among these, those wherein X represents a hydrogen atom are more preferable.

Formula (MC-1) is more preferably a compound in which $R_2$ is a substituent represented by the following general formula (BL-1) or (BL-2) below:

(BL-1)

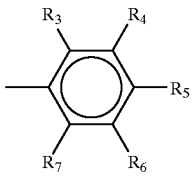

(BL-2)

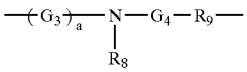

In the general formula (BL-1), each of $R_3$, $R_4$, $R_5$, $R_6$ and $R_7$ independently represents a hydrogen atom or a substituent, and at least one of them represents a substituent having a total of 4 to 70 carbon atoms and containing a substituted or unsubstituted alkyl group as a partial structure, or a substituent having a total of 6 to 70 carbon atoms and containing a substituted or unsubstituted aryl group as a partial structure.

A group represented by the general formula (BL-1) will be described below. Each of $R_3$, $R_4$, $R_5$, $R_6$, and $R_7$ independently represents a hydrogen atom or a substituent. Examples of the substituent are those enumerated above for $R_2$. At least one of $R_3$, $R_4$, $R_5$, $R_6$, and $R_7$ is a substituent having a total of 4 to 70 carbon atoms and containing a substituted or unsubstituted alkyl group as a partial structure, or a substituent having a total of 6 to 70 carbon atoms and containing a substituted or unsubstituted aryl group as a partial structure. Preferred examples are an alkoxy group, aryloxy group, acylamino group, aminocarbonylamino group, carbamoyl group, alkoxycarbonylamino group, sulfonyl group, alkyl- and aryl-sulfonylamino groups, sulfamoyl group, sulfamoylamino group, alkoxycarbonyl group, alkyl group, and aryl group, each having a total of 4 (6 if an aryl group is contained) to 70 carbon atoms and containing a substituted or unsubstituted alkyl group or aryl group as a partial structure.

Of these substituents, an alkyl group having 4 to 70 carbon atoms, and an alkoxy group, acylamino group and alkyl- and aryl-sulfonylamino groups each having an alkyl group having 4 to 70 carbon atoms as a partial structure are preferred.

Especially preferably, $R_3$, or both of $R_4$ and $R_6$ represent a substituent having a total of 4 (6 if aryl group is contained) to 70 carbon atoms, and having a substituted or unsubstituted alkyl group or aryl group as a partial structure.

In the general formula (BL-2), $G_3$ represents a substituted or unsubstituted methylene group; a represents an integer from 1 to 3; $G_4$ represents —O—, —$SO_2$— or —CO—; $R_8$ represents a hydrogen atom, alkyl group, or aryl group; and $R_9$ represents a substituent having a total of 6 to 70 carbon atoms and containing a substituted or unsubstituted alkyl group or aryl group as a partial structure.

If $R_9$ has a substituent, examples of this substituent are those enumerated above for $R_2$.

If a is 2 or more, a plurality of $G_3$'s may be the same or different.

The substituted or unsubstituted methylene group represented by $G_3$ is preferably a simple methylene group, or a methylene group substituted with an alkyl group having 1 to 20 carbon atoms or a methylene group substituted with a substituted or unsubstituted phenyl group. a represents a natural number of 1 to 3, preferably, 1 or 2.

More preferably, a group represented by $(G_3)_a$ is —$CH_2$—, —$C(CH_3)H$—, —$C(CH_3)_2$—, —$C_2H_4$—, —$C(CH_3)H$—$CH_2$—, —$C(CH_3)_2$—$CH_2$—, —$C(CH_3)_2$—$C(CH_3)H$—, —$C(CH_3)H$—$C(CH_3)H$—, —$C(CH_3)_2$—$C(CH_3)_2$—, —$C(i\text{-}C_3H_7)H$—, or —$C(i\text{-}C_3H_7)H$—$CH_2$—.

$G_4$ is preferably —CO— or —$SO_2$—, and $R_8$ is preferably a hydrogen atom.

$R_9$ is preferably a substituted or unsubstituted alkyl group or aryl group having a total of 10 to 70 carbon atoms. When $R_9$ is an aryl group, a phenyl group is preferable.

In a compound represented by the general formula (MC-I), if $G_1$ is a nitrogen atom and $G_2$ is a carbon atom, it is preferable that $R_1$ is a tertiary alkyl group, $R_2$ is a group represented by the general formula (BL-1), each of $R_4$ and $R_6$ is a group selected from an acylamino group, sulfonamide group, ureido group, alkoxycarbonylamino group, sulfonyl group, carbamoyl group, sulfamoyl group, sulfamoylamino group, and alkoxycarbonyl group, each substituted by a substituted or unsubstituted alkyl group having a total of 4 or more carbon atoms or by a substituted or unsubstituted aryl group having 6 or more carbon atoms, and X is a hydrogen atom.

If $G_1$ is a carbon atom and $G_2$ is a nitrogen atom in a compound represented by the general formula (MC-I), it is preferable that $R_1$ is a tertiary alkyl group, $R_2$ is a group represented by the general formula (BL-1) or (BL-2). It is especially preferable that $R_2$ is a group represented by the general formula (BL-2) or a group represented by the general formula (BL-1), wherein each of $R_3$ and $R_7$ is 1- to 6-carbon alkyl group, and at least one of $R_4$, $R_5$, and $R_6$ is a group having a total of 6 to 70 carbon atoms and containing a substituted or unsubstituted alkyl group or aryl group as a partial structure, and X is a hydrogen atom.

In the present invention, it is preferable that $G_1$ is a carbon atom and $G_2$ is a nitrogen atom, $R_1$ is a tertiary alkyl group, $R_2$ is represented by the general formula (BL-2), wherein $R_9$ is a phenyl group having at least one substituent containing a 6- to 70-carbon alkyl group as a partial structure, and a is 1 or 2. Among these especially preferable is that $R_9$ is a group having a group selected from —OH, —$SO_2NH_2$, —$SO_2NHR_{10}$, —$NHSO_2R_{10}$, —$SO_2NHCOR_{10}$, —$CONHSO_2R_{10}$, —COOH, and —$CONH_2$ as a partial structure.

$R_{10}$ represents a substituted or unsubstituted alkyl group or aryl group. If $R_{10}$ is an aryl group, this aryl group is favorably a phenyl group, and at least one electron-withdrawing group is preferably substituted on this phenyl group. Preferred examples of this electron-withdrawing group are a halogen atom, cyano group, alkyl group on which at least one halogen atom is substituted, aryl group on which at least one halogen atom is substituted, acyl group, carbamoyl group, alkyl- or aryl-oxycarbonyl group, a sulfonyl group, and an alkyl- or aryl-aminosulfonyl group.

If $R_{10}$ is an alkyl group, this alkyl group is preferably a 1- to 50-carbon, and more preferably, 1- to 30-carbon, substituted or unsubstituted, straight-chain or branched alkyl group.

When the coupler represented by the general formula (MC-I) forms a polymer, a dimer to tetramer are preferable, and a dimer is especially preferable. When the coupler represented by the general formula (MC-I) links to a polymer chain, the total molecular weight of the polymer is preferably 8,000 to 100,000, and the molecular weight per mother nucleus of the coupler represented by the general formula (MC-I) is preferably 500 to 1,000.

Practical compound examples (couplers (1) to (40)) of formula (MC-1) will be presented below. However, the present invention is not limited to these practical examples.

MC-1

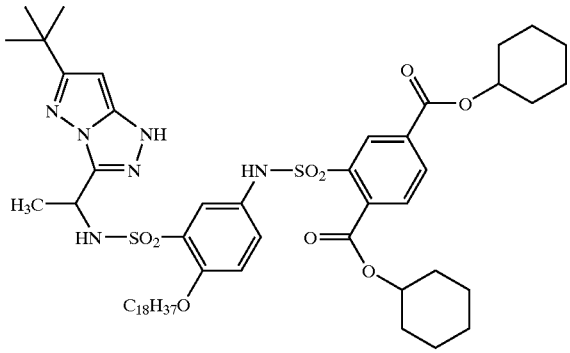

MC-2

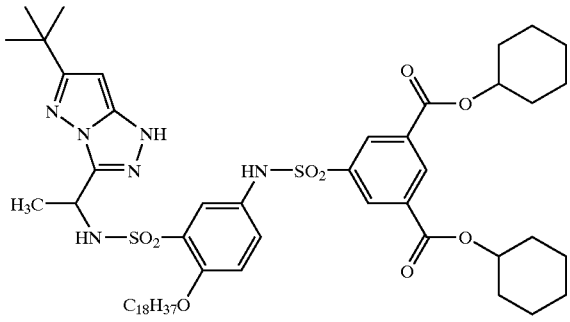

-continued

MC-3

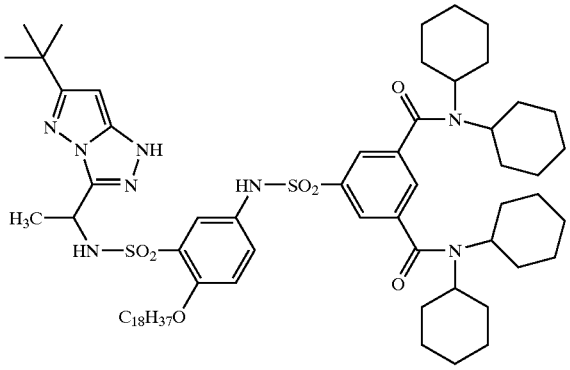

MC-4

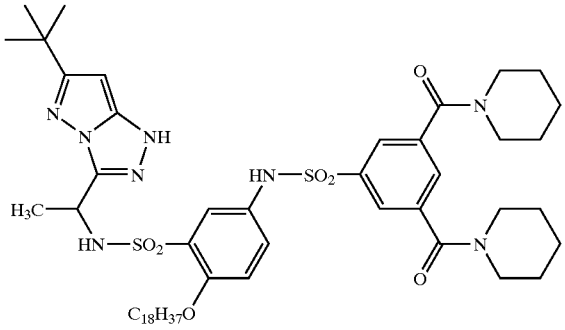

* The alkyl groups are normal alkyl groups, except otherwise specified.

MC-5

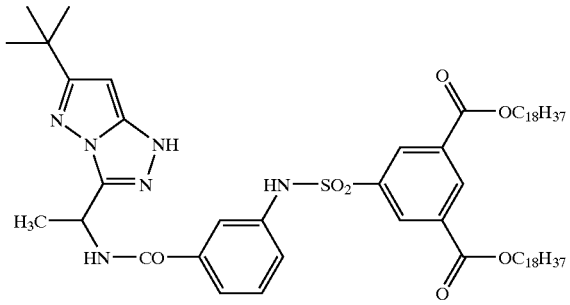

MC-6

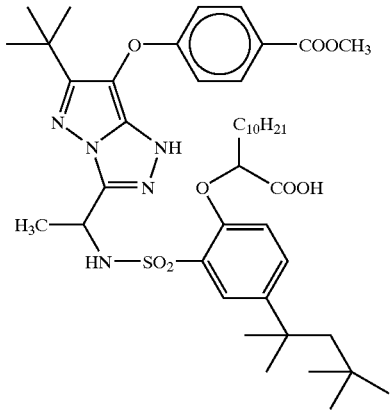

-continued
MC-7
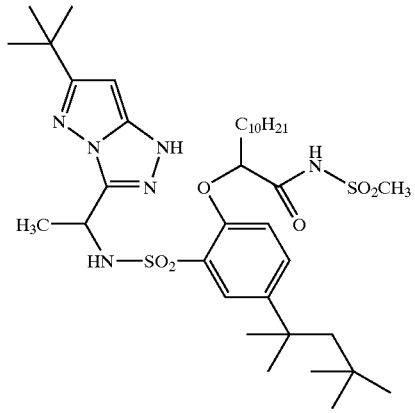
MC-8
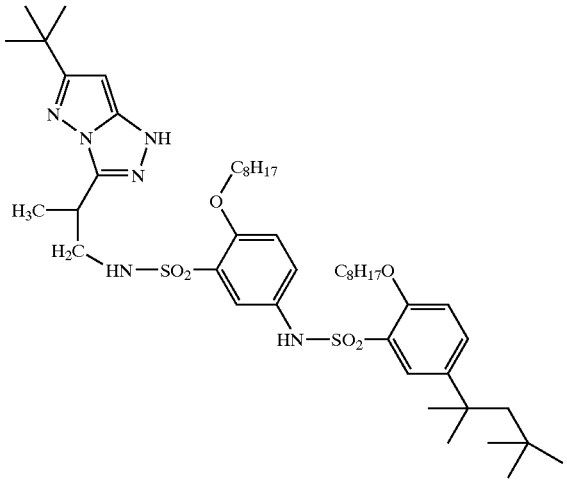
MC-9
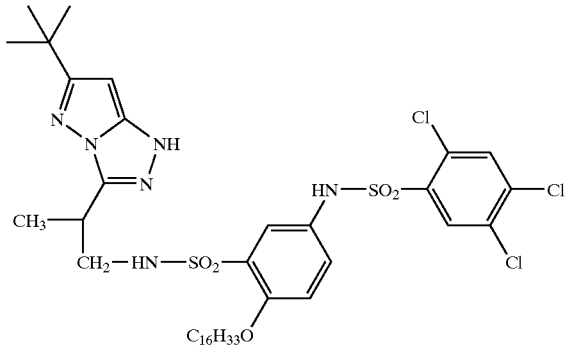
MC-10
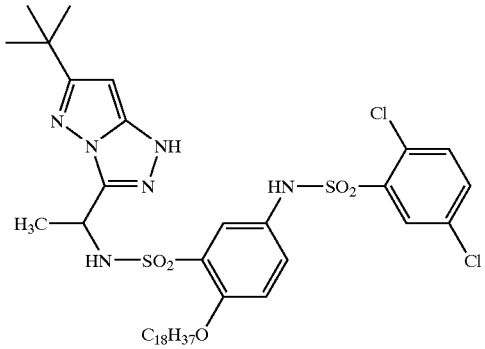
-continued
MC-11
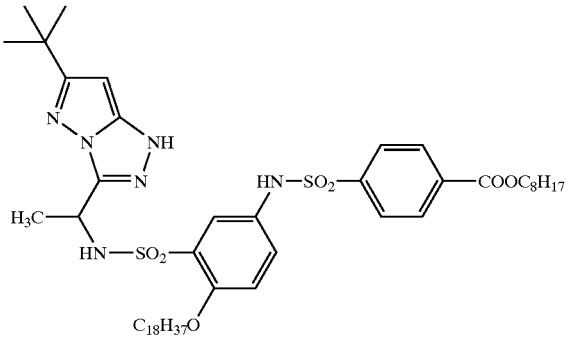
MC-12
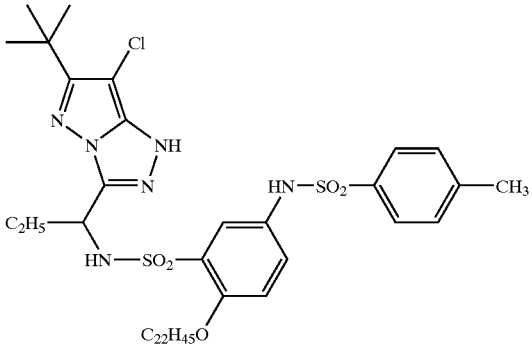
MC-13
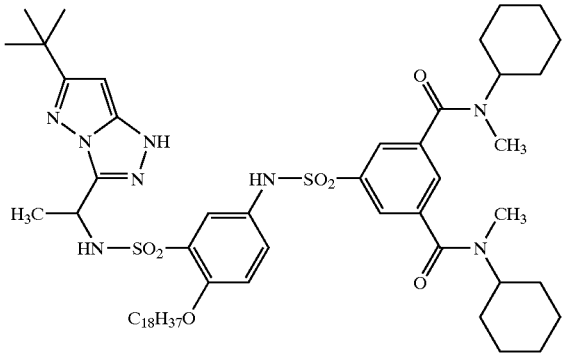
MC-14
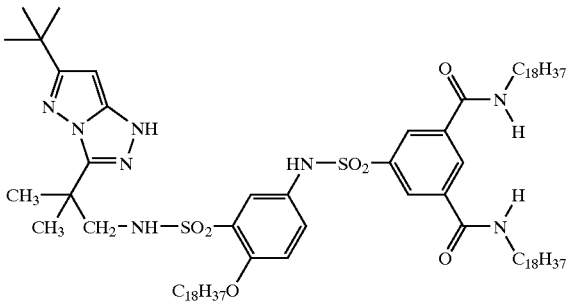

-continued
MC-15
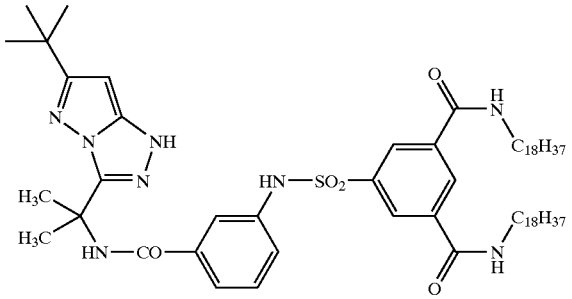
MC-16
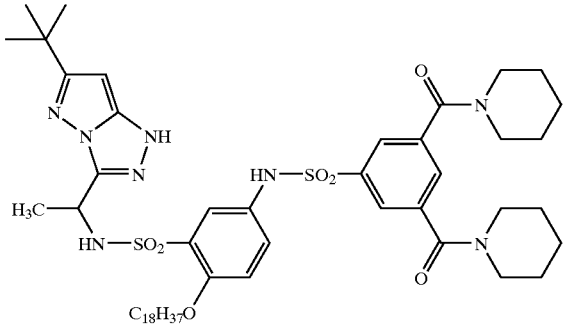
MC-17
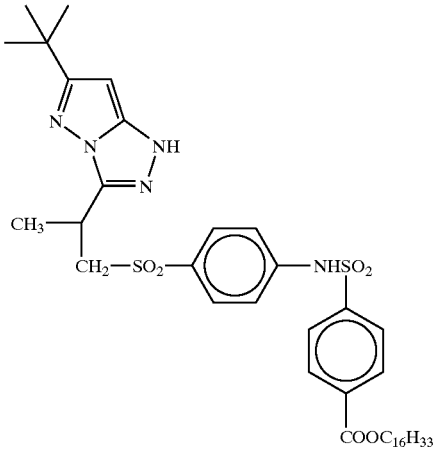
MC-18
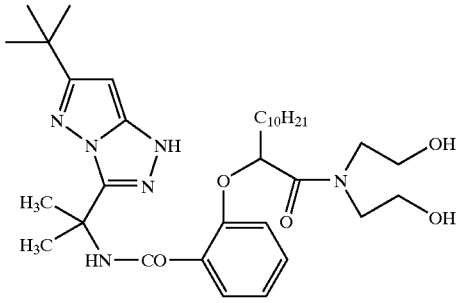
-continued
MC-19
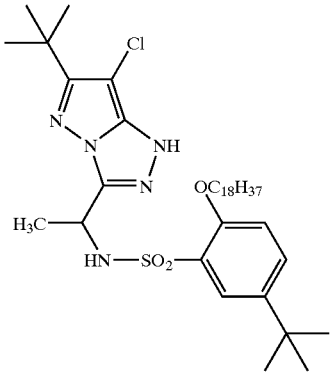
MC-20
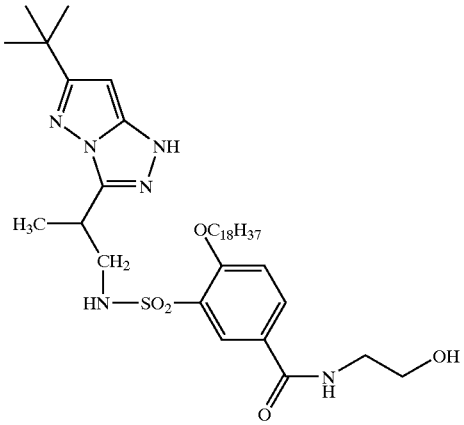
MC-21
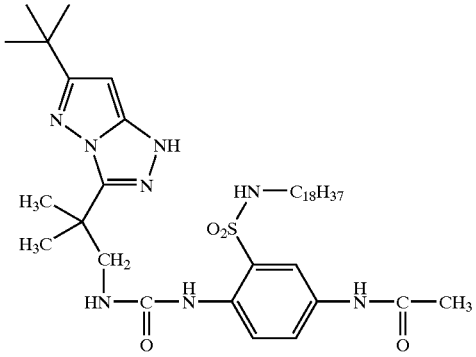
MC-22
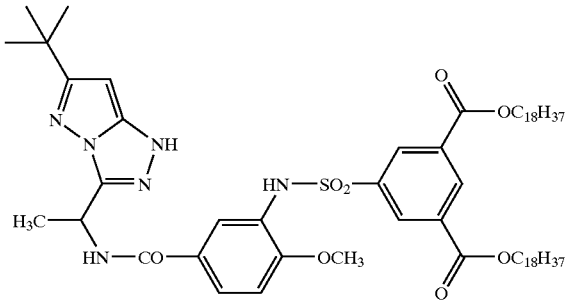

-continued
MC-23
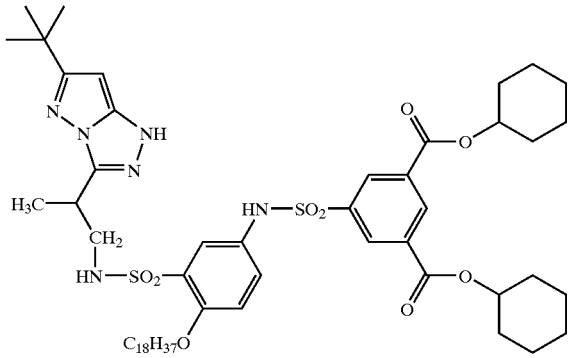
MC-24
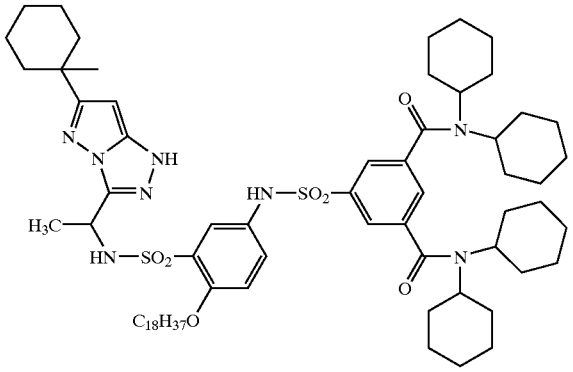
MC-25
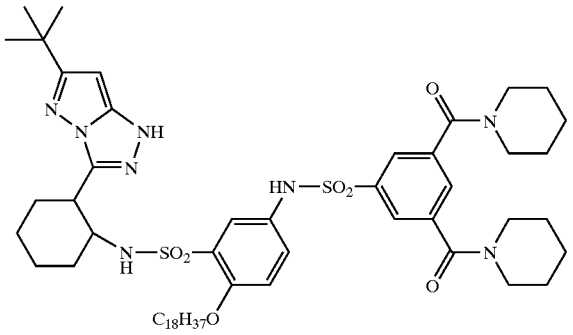
MC-26
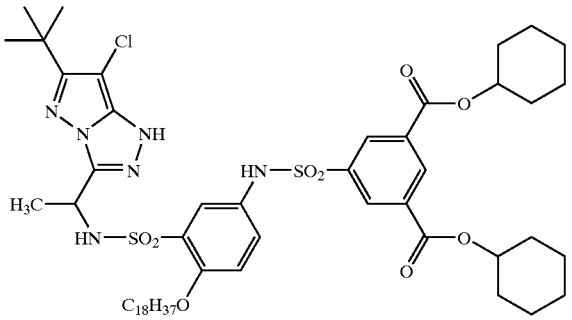
-continued
MC-27
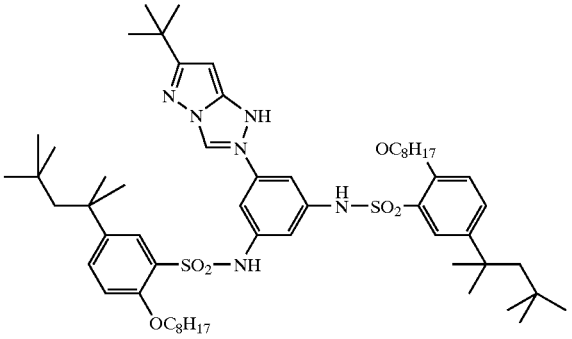
MC-28
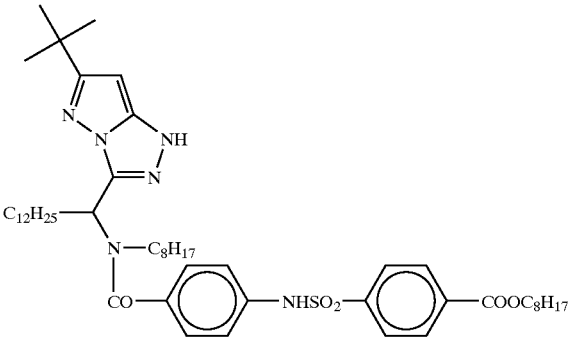
MC-29
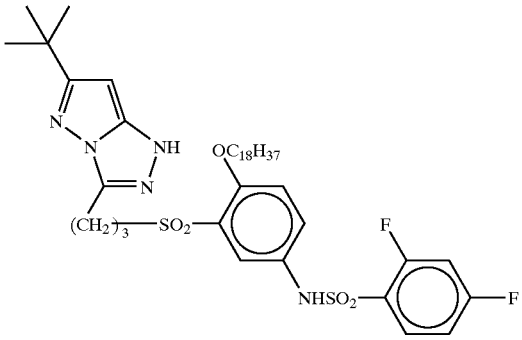
MC-30
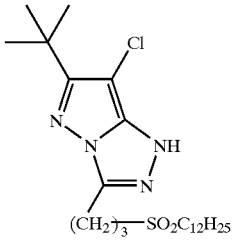

-continued
MC-31
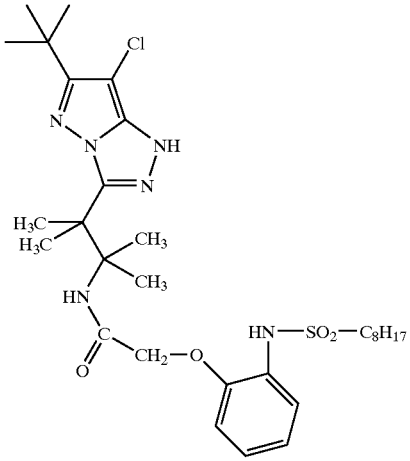
MC-32
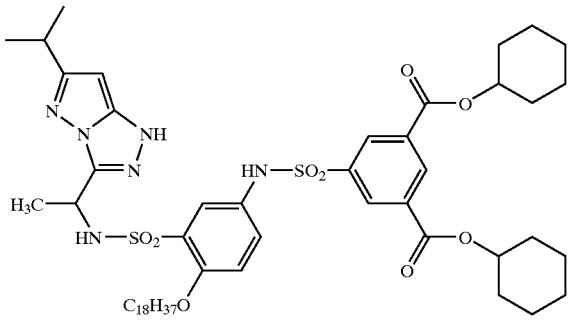
MC-33
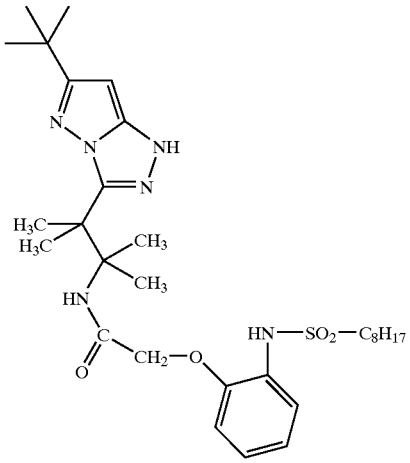
MC-34
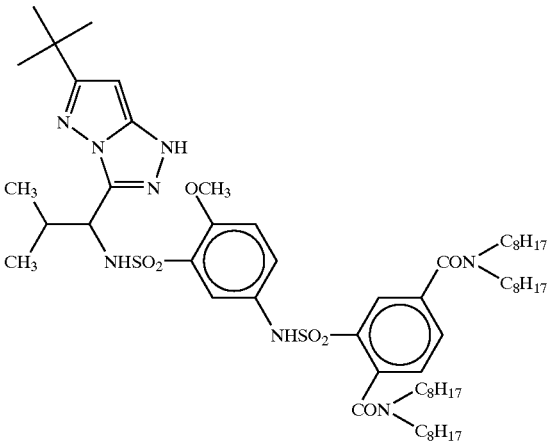
-continued
MC-35
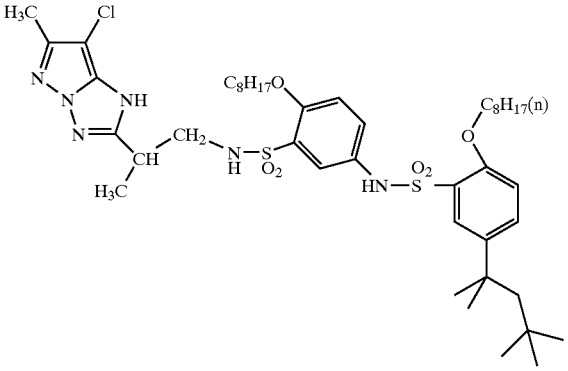
MC-36
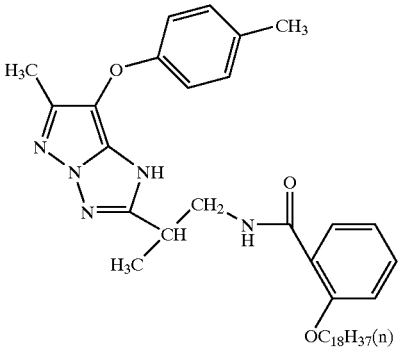
MC-37
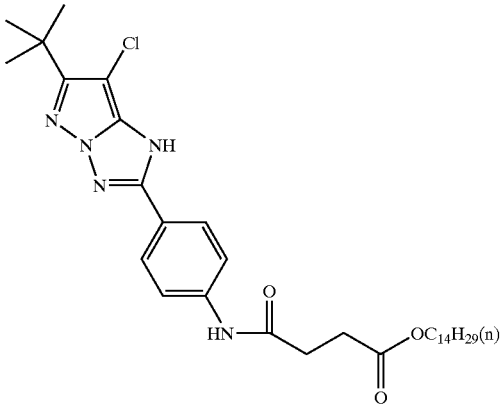
MC-38
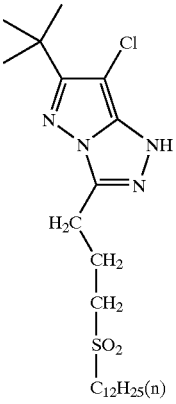

-continued

MC-39

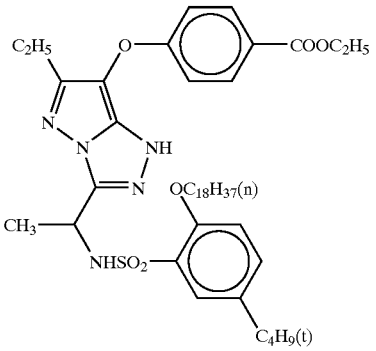

MC-40

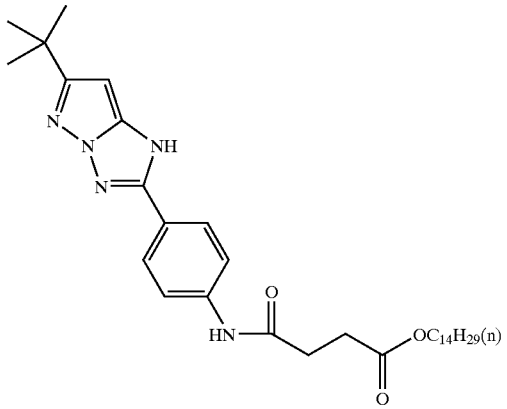

A coupler represented by formula (MC-I) of the present invention can be synthesized by known methods. Examples are described in U.S. Pat. Nos. 4,540,654, 4,705,863, and 5,451,501, JP-A's-61-65245, 62-209457, 62-249155, and 63-41851, Jpn. Pat. Appln. KOKOKU Publication No. (hereinafter referred to as JP-B-)7-122744, JP-B's-5-105682, 7-13309, and 7-82252, U.S. Pat. Nos. 3,725,067 and 4,777,121, JP-A's-2-201442, 2-101077, 3-125143, and 4-242249, the entire contents of all of which are incorporated herein by reference.

A coupler represented by the general formula (MC-I) of the present invention may be introduced to a photosensitive material by various known dispersion methods. Of these methods, an oil-in-water dispersion method is favorable in which a coupler is dissolved in a high-boiling organic solvent (used in combination with a low-boiling solvent where necessary), the solution is dispersed by emulsification in an aqueous gelatin solution, and the dispersion is added to a silver halide emulsion. Examples of the high-boiling solvent used in this oil-in-water dispersion method are described in, e.g., U.S. Pat. No. 2,322,027, the disclosure of which is herein incorporated by reference. Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230, JP-B-53-41091, and EP029104, the disclosures of which are herein incorporated by reference. Also, dispersion using an organic solvent-soluble polymer is described in PCT International Publication WO88/00723, the disclosure of which is herein incorporated by reference.

Examples of the high-boiling solvent usable in the above-mentioned oil-in-water dispersion method are phthalic acid esters (e.g., dibutylphthalate, dioctylphthalate, dicyclohexylphthalate, bis(2-ethylhexyl)phthalate, decylphthalate, bis(2,4-di-tert-amylphenyl)isophthalate, and bis(1,1-diethylpropyl)phthalate), esters of phosphoric acid and phosphonic acid (e.g., diphenylphosphate, triphenylphosphate, tricresyl phosphate, 2-ethylhexyldiphenylphosphate, dioctylbutylphosphate, tricyclohexylphosphate, tri-2-ethylhexylphosphate, tridodecylphosphate, and bis(2-ethylhexyl) phenylphosphate), benzoic acid esters (e.g., 2-ethylhexylbenzoate, 2,4-dichlorobenzoate, dodecylbenzoate, and 2-ethylhexyl-p-hydroxybenzoate), amides (e.g., N,N-diethyldodecaneamide, N,N-diethyllaurylamide and N,N,N,N-tetrakis(2-ethylhexyl) isophthalic acid amide), alcohols and phenols (e.g., isostearylalcohol and 2,4-di-tert-amylphenol), aliphatic esters (e.g., dibutoxyethyl succinate, bis(2-ethylhexyl)succinate, 2-hexyldecyl tetradecanate, tributyl citrate, diethylazelate, isostearyllactate, and trioctyltosylate), aniline derivatives (e.g., N,N-dibutyl-2-butoxy-5-tert-octylaniline), chlorinated paraffins (paraffins containing 10% to 80% of chlorine), trimesic acid esters (e.g., trimesic acid tributyl), dodecylbenzene, diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl) phenol), carboxylic acids (e.g., 2-(2,4-di-tert-amylphenoxy butyric acid and 2-ethoxyoctanedecanic acid), alkylphosphoric acids (e.g., bis(2-ethylhexyl)phosphoric acid and diphenylphosphoric acid). In addition to the above high-boiling solvents, compounds described in, e.g., JP-A-6-258803, the disclosure of which is herein incorporated by reference, may also be preferably used as high-boiling solvents.

Of these solvents, phosphates of aliphatic alcohol, amides, and aliphatic esters are preferred, and the combinations of these solvents with alcohols or phenols are also preferred.

In the present invention, the ratio of the amount of a high-boiling organic solvent to that of a coupler of the present invention is preferably 0 to 2.0, more preferably, 0 to 1.0, and most preferably, 0 to 0.4, as a mass ratio.

If a large amount of tricresyl phosphate is used as a high-boiling organic solvent, the storage stability improving effect of the present invention reduces. Therefore, when tricresyl phosphate is to be used, the mass ratio of this tricresyl phosphate to a coupler of the present invention is preferably 0.4 or less, and more preferably, 0.2 or less.

As a co-solvent, it is also possible to use an organic solvent (e.g., ethyl acetate, butyl acetate, ethyl propionate, methylethylketone, cyclohexanone, 2-ethoxyethylacetate, and dimethylformamide) having a boiling point of 30° C. to about 160° C.

The content of a coupler of the present invention in a photosensitive material is preferably 0.01 to 10 g, and more preferably, 0.1 g to 2 g per $m^2$. The content is appropriately $1\times10^{-3}$ to 1 mol, preferably $2\times10^{-3}$ to $3\times10^{-1}$ mol per mol of a silver halide in the same photosensitive emulsion layer.

When a photosensitive layer is a unit photo-sensitive layer (unit configuration) including two or more photosensitive emulsion layers differing in sensitivity, the content of a coupler of the present invention per mol of a silver halide is preferably $2\times10^{-3}$ to $1\times10^{-1}$ mol in a low-speed layer and $3\times10^{-2}$ to $3\times10^{-1}$ mol in a high-speed layer. When a unit photosensitive layer includes three photosensitive emulsion layers different in sensitivity, the content of a coupler of the present invention per mol of a silver halide is preferably $2\times10^{-3}$ to $1\times10^{-1}$ mol (more preferably $1\times10^{-2}$ to $1\times10^{-1}$ mol) in a low-speed layer, $1\times10^{-2}$ to $2\times10^{-1}$ mol (more preferably $3\times10^{-2}$ to $2\times10^{-1}$ mol) in a medium-speed layer, and $3\times10^{-2}$ to $3\times10^{-1}$ mol (more preferably $5\times10^{-2}$ to $2\times10^{-1}$ mol) in a high-speed layer.

Although the present invention contains a coupler represented by the general formula (MC-I), other couplers can also be used. However, the results become more preferable as the contribution of a color dye of a coupler of the present invention to the total density of dyes generating substantially the same color increases. More specifically, the amount is such that the contribution to the color generation density accounts for preferably 30% or more, more preferably, 50% or more, and most preferably, 70% or more, as a molar ratio.

A sensitive material of the present invention may also contain a competing compound (a compound which competes with an image forming coupler to react with an oxidized form of a color developing agent and which does not form any dye image). Examples of this competing coupler are reducing compounds such as hydroquinones, catechols, hydrazines, and sulfonamidophenols, and compounds which couple with an oxidized form of a color developing agent but do not substantially form a color image (e.g., colorless compound-forming couplers disclosed in German Patent No. 1,155,675, British Patent No. 861,138, and U.S. Pat. Nos. 3,876,428 and 3,912,513, and flow-out couplers disclosed in JP-A-6-83002, the disclosures of which are herein incorporated by reference).

The competing compound is preferably added to a sensitive emulsion layer containing a magenta coupler represented by the general formula (MC-I) of the present invention or a non-sensitive layer. The completing compound is particularly preferably added to a sensitive emulsion layer containing a coupler represented by the general formula (MC-I) of the present invention. The content of a competing compound is 0.01 to 10 g, preferably 0.10 to 5.0 g per $m^2$ of a sensitive material. The content is preferably 1 to 1,000 mol%, more preferably 20 to 500 mol % with respect to the coupler represented by the general formula (MC-1) of the present invention.

In the method of preparing the emulsion used in the present invention (the emulsion is also referred to as the emulsion of the present invention), a chemical sensitization step is usually performed after the completion of a grain growth step, for example, after desalting by washing with water. However, in the case where shell is formed with silver halide after chemical sensitization, there are cases where chemical sensitization is conducted during grains formation followed by a step of forming a shell, and where after host grains are washed with water and desalted chemical sensitization is performed and then a shell is formed by the addition of a silver nitrate solution and a halide solution, by the addition of silver halide fine grains, or by the addition of a silver nitrate solution and silver halide fine grains. When chemical sensitization is performed using a plurality of chemical sensitizers the chemical sensitizers may be added at the same time or may be added separately. The temperature, pH and pAg during the chemical sensitization may be maintained, usually, at 30 to 90° C., 4 to 9, and 7 to 10, respectively.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755.

In the noble metal sensitization, salts of noble metals, such as gold, platinum, palladium, and iridium, can be used. In particular, gold sensitization, palladium sensitization, or a combination of the both is preferred. In the case of gold sensitization, known compounds such as chloroauric acid, potassium chloroaurate, potassium auricthiocyanate, gold sulfide and gold selenide, mesoionic gold compounds described in U.S. Pat. No. 5,220,030, and azole gold compounds described in U.S. Pat. No. 5,049,484 may be used. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Hypo, thiourea compounds and rhodanine compounds, and sulfur-containing compounds described in U.S. Pat. Nos. 3,857,711, 4,266,018 and 4,054,457 may be used as a sulfur sensitizer. Chemical sensitization may be performed in the presence of so-called a chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and the above described G. F. Duffin, Photographic Emulsion Chemistry, pages 138 to 143.

Gold sensitization is preferably used in combination with chalcogen sensitization for the emulsion of the present invention. Preferable amount of gold sensitizer is $1\times10^{-4}$ to $1\times10^{-7}$ mol per mol of silver halide, more preferable amount is $1\times10^{-5}$ to $5\times10^{-7}$ mol pre mol of silver halide. Preferable range of the palladium compounds is $1\times10^{-3}$ to $5\times10^{-7}$ mol per mol of silver halide. Preferable range of thiocyanate or selenocyanate is $5\times10^{-2}$ to $1\times10^{-6}$ mol per mol of silver halide.

Specifically, the grains used in the present invention are preferably gold-sulfur sensitized. Although the grains are preferably surface sensitized, the internal portion thereof may be sensitized. Herein the surface of a silver halide grain means a region of 1 nm toward the interior of the grain from the boundary between the surface of the grain and gelatin that covers the grain or absorbents to the grain. The internal portion of the grain means the portion inner than this region of grain surface. The effect of the chemical sensitization to the interior of the grain is small when it is performed at positions of deeper than 20 nm.

The grains used in the present invention are preferably gold-selenium sensitized. The selenium sensitization used in the present invention means sensitization with the following selenium sensitizers.

That is, in the selenium sensitization, labile selenium compounds may be used, and the compounds described in the specifications and publications of U.S. Pat. Nos. 3,297,446 and 3,297,447, and JP-A's-4-25832, 4-109240, 4-147250, 4-271341, 5-40324, 5-224332, 5-224333, 5-11385, 6-43576, 6-75328, 6-175258, 6-175259, 6-180478, 6-208184 and 6-208186, the entire contents of all of which are incorporated herein by reference.

Specific examples of the labile selenium sensitizers include phosphine selenides (e.g., triphenylphosphineselenide, diphenyl(pentafluorophenyl)phosphineselenide), selenophosphates (e.g., tri-p-tolylselenophosphate), selenophosphinic acid esters, selenophosphonic acid esters, selenoureas (e.g., N,N-dimethylselenourea, N-acetyl-N,N',N'-trimethylselenourea, N-trifluoroacetyl-N,N',N'-trimethylselenourea), selenoamides (e.g., N,N-dimethylselenobenzamide, N,N-diethylselenobenzamide), selenoesters (e.g., p-methoxyselenobenzoic acid o-isopropylester, p-methoxyselenobenzoic acid Se-(3'-oxocyclohexyl)ester), diacylselenides (e.g., bis(2,6-dimethoxybenzoyl)selenide, bis(2,4-dimethoxybenzoyl)selenide), dicarbamoylselenides (e.g., bis(N,N-dimethylcarbamoyl)selenide), bis(alkoxycarbonyl)selenides (e.g., bis(n-butoxycarbonyl)selenide, bis(benzyloxycarbonyl)selenide), triselenanes (e.g., 2,4,6-tris(p-methoxyphenyl)triselenane), diselenides, polyselenides, seleniumsulfide, selenoketones, selenocarboxylic acids, isoselenocyanates, and colloidal selenium. Preferably, phosphineselenides, selenoamides, dicarbamoylselenides, bis(alkoxycarbonyl)selenides, and selenoesters are used.

Additionally, it is possible to use non-labile selenium compounds described in JP-B-46-4553 and 52-34492, the entire contents of both of which are incorporated herein by reference, e.g., sodium selenite, potassium selenocyanate, selenazoles, and selenides.

Grains used in the present invention are preferably subjected to gold-tellurium sensitization. The tellurium sensitization used in the present invention means a sensitization process using tellurium sensitizers presented below.

That is, labile tellurium compounds are used in tellurium sensitization. It is possible to use labile tellurium compounds described in the publications, e.g., of JP-A-'s 4-224595, 4-271341, 4-333043, 5-303157, 6-27573, 6-175258, 6-180478, 6-208184, 6-208186, 6-317867, 7-140579, 7-301879, and 7-301880, the entire contents of all of which are incorporated herein by reference.

More specifically, it is possible to use phosphinetellurides (e.g., normalbutyl-diisopropylphosphinetelluride, triisobutylphosphinetelluride, trinormalbutoxyphosphinetelluride, triisopropylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride, bis(ethoxycarbonyl)telluride), telluroureas (e.g., N,N'-dimethylethylenetellurourea), telluroamides, and telluroesters. Preferable compounds are phosphinetellurides and diacyl(di)tellurides.

The use amount of the selenium and tellurium sensitizers described above varies in accordance with silver halide grains used and chemical sensitization conditions. However, the use amount is $10^{-8}$ to $10^{-2}$ mol, preferably $10^{-7}$ to $10^{-3}$ mol per mol of a silver halide.

Although the conditions of selenium sensitization and tellurium sensitization are not particularly limited, the pAg, pH, and temperature are 6 to 11, 4 to 10, and 40° to 95° C., preferably 7 to 10, 5 to 8, and 45° C. to 85° C., respectively.

Grains of the present invention are preferably subjected to gold-chalcogen sensitization at a composition ratio realizable by sulfur, selenium, and tellurium, and most preferably subjected to gold-sulfur-selenium sensitization.

Fine silver halide grains used in the chemical sensitization process for digestion of the present invention can have any crystal habits and contain twin planes provided that the grain size (equivalent-sphere diameter) is smaller than that of tabular silver halide grains used in the present invention. The silver halide composition of the fine silver halide grains can be any of silver chloride, silver bromide, silver iodobromide, silver chlorobromide, and silver bromochloroiodide. The history of grain formation can also be any history. The average iodide ion content of the fine silver halide grains is desirably 0 to 20 mol %, and more desirably 0.3 to 10 mol % with respect to the total silver halide content in the fine grains.

The emulsion grains of the present invention are especially effective when they include a reduction sensitized region in the interior portion thereof, in the surface thereof, or in the interior portion and the surface thereof. The definitions of the grain surface and the interior portion are the same as those mentioned above. The reduction sensitized region can be formed by a method selected from the method in which a reduction sensitizer is added to the silver halide emulsion, the method commonly known as silver ripening in which growth or ripening is carried out in an environment of pAg as low as 1 to 7 and the method commonly known as high-pH ripening in which growth or ripening is carried out in an environment of pH as high as 8 to 11. At least two of these methods can be used in combination.

The above method in which a reduction sensitizer is added is preferred from the viewpoint that the level of reduction sensitization can be finely regulated.

Examples of known reduction sensitizers include stannous salts, ascorbic acid and derivatives thereof, amines and polyamines, hydrazine derivatives, formamidinesulfinic acid, silane compounds and borane compounds. In the reduction sensitization according to the present invention, appropriate one may be selected from these known reduction sensitizers and used or at least two may be selected and used in combination. Preferred reduction sensitizers are stannous chloride, thiourea dioxide, dimethylaminoborane, ascorbic acid and derivatives thereof. Although the addition amount of reduction sensitizer must be selected because it depends on the emulsion preparing conditions, it is preferred that the addition amount range from $10^{-7}$ to $10^{-3}$ mol per mol of silver halide.

Each reduction sensitizer is dissolved in water or any of organic solvents such as alcohols, glycols, ketones, esters and amides and added during the grain growth. Although the reduction sensitizer may be put in a reaction vessel in advance, it is preferred that the addition be effected at an appropriate time during the grain growth. It is also suitable to add in advance the reduction sensitizer to an aqueous solution of a water-soluble silver salt or a water-soluble alkali halide and to precipitate silver halide grains with the use of the resultant aqueous solution. Alternatively, the reduction sensitizer solution may preferably be either divided and added a plurality of times in accordance with the grain growth or continuously added over a prolonged period of time.

The reduction sensitization may be performed during the step of grain preparation, or after the subsequent washing step, or during the chemical sensitization (after ripening) step.

As a protective colloid and as a binder of other hydrophilic colloid layers that are used when the emulsion of the present invention is prepared, gelatin is used advantageously, but another hydrophilic colloid can also be used.

Use can be made of, for example, a gelatin derivative, a graft polymer of gelatin with another polymer, a protein, such as albumin and casein; a cellulose derivative, such as hydroxyethylcellulose, carboxymethylcellulose, and cellulose sulfate ester; sodium alginate, a saccharide derivative, such as a starch derivative; and many synthetic hydrophilic polymers, including homopolymers and copolymers, such as a polyvinyl alcohol, polyvinyl alcohol partial acetal, poly-N-vinylpyrrolidone, polyacrylic acid, polymethacrylic acid, polyacrylamide, a polyvinylimidazole and a polyvinylpyrazole.

Lime-processed gelatin, as well as acid-processed gelatin, enzyme-treated gelatin such as those described in Bull. Soc. Sci. Photo. Japan, Np. 16, p. 30 (1966), and gelatin that went through processing with phthalic acid described in JP-A-8-82883 may be used as gelatin. Also, a hydrolysis product or enzymatic decomposition product of gelatin may be used.

Preferably, the emulsion of the present invention is washed with water for desalting and is dispersed in a freshly prepared protective colloid. The temperature at which the washing with water is carried out can be selected in accordance with the purpose, and preferably the temperature is selected in the range of 5° C. to 50° C. The pH at which the washing with water is carried out can be selected in accordance with the purpose, and preferably the pH is selected in the range of 2 to 10, and more preferably in the range of 3 to 8. The pAg at which the washing with water is carried out can be selected in accordance with the purpose, and preferably the pAg is selected in the range of 5 to 10. As a method of washing with water, it is possible to select from the noodle washing method, the dialysis method using a diaphragm, the centrifugation method, the coagulation settling method, and the ion exchange method. In the case of the coagulation settling method, selection can be made from, for example, the method wherein sulfuric acid salt is used, the method wherein an organic solvent is used, the method wherein a water-soluble polymer is used, and the method wherein a gelatin derivative is used.

The method of adding a chalcogenide compound during emulsion preparation as described in the specification of U.S. Pat. No. 3,772,031 is sometimes useful. In addition to S, Se and Te compounds, cyanate, thiocyanate, selenocyanate, carbonate, phosphate, and acetate may be present.

An oxidizer capable of oxidizing silver is preferably used during the process of preparing the emulsion of the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates. Examples of suitable organic oxidizers include quinones such as p-quinone, organic peroxides such as peracetic acid and perbenzoic acid and active halogen releasing compounds (e.g., N-bromosuccinimide, chloramine T and chloramine B).

Oxidizers preferred in the present invention are inorganic oxidizers selected from ozone, hydrogen peroxide and adducts thereof, halogen elements and thiosulfonates and organic oxidizers selected from quinones. The embodiment wherein the above-mentioned reduction sensitizer and the oxidizer to silver are used in combination is preferable. A method of performing reduction sensitization after the oxidizer is used, or the reversed method thereof, or a method of making both sensitizer and oxidizer co-exist can be used by selection. These methods can be performed in a grain formation step or after the grain formation step.

The emulsion of the invention can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably, 5 to 30 nm.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt; nitroimidazoles; nitrobenzimidazoles; chlorobenzimidazoles; bromobenzimidazoles; mercaptothiazoles; mercaptobenzothiazoles; mercaptobenzimidazoles; mercaptothiadiazoles; aminotriazoles; benzotriazoles; nitrobenzotriazoles; and mercaptotetrazoles (particularly 1-phenyl-5-mercaptotetrazole); mercaptopyrimidines; mercaptotriazines; a thioketo compound such as oxazolinethione; azaindenes such as triazaindenes, tetrazaindenes (particularly 4-hydroxy-substituted(1,3,3a,7) tetrazaindenes), and pentazaindenes. For example, compounds described in the specifications of U.S. Pat. Nos. 3,954,474 and 3,982,947 and the publication of JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

The photographic emulsion of the present invention is preferably subjected to a spectral sensitization with a methine dye or the like to thereby exert the effects of the invention. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. These dyes may contain any of nuclei commonly used in cyanine dyes as basic heterocyclic nuclei. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

The merocyanine dye or composite merocyanine dye may have a 5 or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, GB's 1,344,281 and 1,507,803, JP-B's-43-4936 and 53-12375, and JP-A's-52-110618 and 52-109925.

The emulsion used in the present invention may contain a dye which itself exerts no spectral sensitizing effect or a substance which absorbs substantially none of visible radiation and exhibits supersensitization, together with the above spectral sensitizing dye.

The addition timing of the spectral sensitizing dye to the emulsion may be performed at any stage of the process for preparing the emulsion which is known as being useful. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods. The addition thereof may be set from $4\times10^{-6}$ to $8\times10^{-3}$ mol per mol of silver halide, and $5\times10^{-5}$ to $5\times10^{-3}$ mol per mol of silver halide is more effective.

The types of silver halide photosensitive materials to which the processing method of the present invention is applied are not limited, but the method of the present invention is preferably applied to silver halide reversal photosensitive materials and black and white photosensitive materials. More preferably, the method of the present invention is applied to silver halide reversal photosensitive materials, and most preferably to silver halide color reversal photosensitive materials.

In silver halide photosensitive materials used in the present invention, it is generally possible to use various techniques and inorganic and organic materials described in Research Disclosure Nos. 308119 (1989), and 37038 (1995).

More specifically, techniques and inorganic and organic materials usable in color photosensitive materials to which the method of the present invention can be applied are described in portions of the specification of EP436,938A2 and patents cited below, the entire contents of which are incorporated herein by reference.

| Items | Corresponding portions |
|---|---|
| 1) Layer configurations | page 146, line 34 to page 147, line 25 |
| 2) Silver halide emulsions usable together | page 147, line 26 to page 148 line 12 |
| 3) Yellow couplers usable together | page 137, line 35 to page 146, line 33, and page 149, lines 21 to 23 |
| 4) Magenta couplers usable together | page 149, lines 24 to 28; EP421, 453A1, page 3, line 5 to page 25, line 55 |
| 5) Cyan couplers usable together | page 149, lines 29 to 33; EP432, 804A2, page 3, line 28 to page 40, line 2 |
| 6) Polymer couplers | page 149, lines 34 to 38; EP435, 334A2, page 113, line 39 to page 123, line 37 |
| 7) Colored couplers | page 53, line 42 to page 137, line 34, and page 149, lines 39 to 45 |
| 8) Functional couplers usable together | page 7, line 1 to page 53, line 41, and page 149, line 46 to page 150, line 3; EP435, 334A2, page 3, line 1 to page 29, line 50 |
| 9) Antiseptic and mildewproofing agents | page 150, lines 25 to 28 |
| 10) Formalin scavengers | page 149, lines 15 to 17 |
| 11) Other additives usable together | page 153, lines 38 to 47; EP421, 453A1, page 75, line 21 to page 84, line 56, and page 27, line 40 to page 37, line 40 |
| 12) Dispersion methods | page 150, lines 4 to 24 |
| 13) Supports | page 150, lines 32 to 34 |
| 14) Film thickness · film physical properties | page 150, lines 35 to 49 |
| 15) Color development step | page 150, line 50 to page 151, line 47 |
| 16) Desilvering step | page 151, line 48 to page 152, line 53 |
| 17) Automatic processor | page 152, line 54 to page 153, line 2 |
| 18) Washing · stabilizing step | page 153, lines 3 to 37 |

EXAMPLES

The present invention will be described in detail below by way of examples, however, the present invention is not limited to these examples.

Example 1

Preparation of Emulsion Em-a

To an aqueous solution obtained by dissolving 6 g of potassium bromide and 0.8 g of low-molecular-weight gelatin of 10 to 20 thousand average molecular weight in 1.5 L of distilled water under satisfactory agitation, an aqueous solution containing 64 g of potassium bromide and 5.0 g of low-molecular-weight gelatin per 500 mL and an aqueous solution containing 90 g of silver nitrate and 4 g of ammonium nitrate per 500 mL were added at 35° C. over a period of 30 sec by the double jet method. During this period, the pAg of the mixture was maintained at 9.0 (Addition (1) at which 5.7% of the total silver quantity was consumed).

The mixture was subjected to physical ripening, and the pAg thereof was adjusted to 9.5 with an aqueous solution of KBr. The temperature of the mixture was raised to 50° C., and 35 g of gelatin processed with phthalic acid was added thereto. Thereafter, an aqueous solution containing 225 g of potassium bromide per L and an aqueous solution containing 316 g of silver nitrate and 0.6 g of ammonium nitrate per L were added to the mixture over a period of 14 min according to the double jet method. During this period, the pAg of the mixture was maintained at 8.8 (Addition (2) at which 9.2% of the total silver quantity was consumed).

Subsequently, an aqueous solution containing 17.2 g of potassium iodide per L and an aqueous solution containing 67.5 g of silver nitrate and 13.2 g of ammonium nitrate per L were added in equivalent amounts to the mixture over a period of 6 min 30 sec by the double jet method (Addition (3) at which 3.5% of the total silver quantity was consumed).

Then, an aqueous solution of KBr and aqueous solution of silver nitrate as employed in the above Addition step (2) were added to the mixture while maintaining the pAg thereof at 8.8 over a period of 30 min (Addition (4) at which 81% of the total silver quantity was consumed).

Thereafter, the thus obtained emulsion was washed at 35° C. according to the customary flocculation method. Gelatin was added to the emulsion so as to adjust the pH and pAg to 6.3 and 8.3, respectively, at 40° C. Thus, there was obtained tabular AgBrI emulsion (av. I=3.5 mol % and variation coefficient: 20%) having an average grain diameter, in terms of sphere of equal volume, of 0.23 μm, an average projected area diameter of 0.28 μm and an average aspect ratio of 2.7. The emulsion was heated to 56° C., and subjected to optimum gold-sulfur-selenium sensitization, thereby obtaining emulsion Em-a.

Preparation of Emulsions Em-b and Em-c

Emulsion Em-b was obtained in the same manner as conducted for the Emulsion Em-a except that thiourea dioxide as a reduction sensitizer was added after the physical ripening after the Addition (1) step in an amount of $3\times10^{-5}$ mol per mol of silver of finished grains, and except that $C_2H_5$—$SO_2S$—Na was added after the Addition (4) step in an amount of $2.5\times10^{-4}$ mol per mol of silver. Similarly, thiourea dioxide was added after the Addition (4) step in an amount of $3\times10^{-5}$ mol per mol of silver, thereby obtaining emulsion Em-c.

Preparation of Emulsions Em-d to Em-k

Emulsions Em-d to Em-k were obtained in the same manner as conducted for the Emulsion Em-a except that organic electron-donating compounds A-1, -1, -6, -19, -20, -21, -36 and -45, respectively, were brought into optimum action after the Addition (4) step.

Preparation of Emulsions Em-l to Em-p

Emulsions Em-l to Em-p were obtained in the same manner as conducted for the Emulsion Em-a except that organic electron-donating compound A-1 or -21 was brought into optimum action after the Addition (4) step, and thereafter, storability enhancing compound A-2, A-3, A-4 or A-5 was added.

Emulsions Em-q to Em-t were obtained in the same manner as conducted for the Emulsion Em-a except that organic electron-donating compound 53, 54, 55 or 56 was brought into optimum action after the Addition (4) step.

In Table 1, there are listed the amount of applied reduction sensitizer, the type and amount of employed organic electron-donating compound, the type and amount of storability enhancing compound and the oxidation potential with respect to each of the emulsions Em-a to Em-t.

TABLE 1

| | Reduction sensitizer | Organic electron-donating compound | | Storability-improving compound | | | |
|---|---|---|---|---|---|---|---|
| Emulsion | Timing Amount (mol/mol Ag) | Compound | Amount (mol/mol Ag) | Compound | Amount (mol/mol Ag) | Oxidation potential (eV) | |
| Em-a | — | — | — | — | — | — | Comp. |
| Em-b | After step (1) $3\times10^{-5}$ | — | — | — | — | — | Comp. |
| Em-c | After step (4) $3\times10^{-5}$ | — | — | — | — | — | Comp. |
| Em-d | — | A-1 | $8\times10^{-6}$ | — | — | — | Comp. |
| Em-e | — | 1 | $3\times10^{-6}$ | — | — | — | Inv. |
| Em-f | — | 6 | $4\times10^{-6}$ | — | — | — | Inv. |
| Em-g | — | 19 | $4\times10^{-6}$ | — | — | — | Inv. |
| Em-h | — | 20 | $6\times10^{-6}$ | — | — | — | Inv. |
| Em-i | — | 21 | $8\times10^{-6}$ | — | — | — | Inv. |
| Em-j | — | 36 | $8\times10^{-6}$ | — | — | — | Inv. |
| Em-k | — | 45 | $8\times10^{-6}$ | — | — | — | Inv. |
| Em-l | — | A-1 | $8\times10^{-6}$ | A-3 | $3\times10^{-4}$ | 0.18 | Comp. |
| Em-m | — | 21 | $8\times10^{-6}$ | A-2 | $3\times10^{-4}$ | 0.22 | Inv. |
| Em-n | — | 21 | $8\times10^{-6}$ | A-3 | $3\times10^{-4}$ | 0.13 | Inv. |
| Em-o | — | 21 | $8\times10^{-6}$ | A-4 | $3\times10^{-4}$ | 0.77 | Inv. |
| Em-p | — | 21 | $8\times10^{-6}$ | A-5 | $3\times10^{-4}$ | 0.90 | Inv. |
| Em-q | — | 53 | $3\times10^{-6}$ | — | — | — | Inv. |
| Em-r | — | 54 | $4\times10^{-6}$ | — | — | — | Inv. |

TABLE 1-continued

| Emulsion | Reduction sensitizer Timing Amount (mol/mol Ag) | Organic electron-donating compound Compound | Organic electron-donating compound Amount (mol/mol Ag) | Storability-improving compound Compound | Storability-improving compound Amount (mol/mol Ag) | Oxidation potential (eV) | |
|---|---|---|---|---|---|---|---|
| Em-s | — | 55 | $4 \times 10^{-6}$ | — | — | — | Inv. |
| Em-t | — | 56 | $3 \times 10^{-6}$ | — | — | — | Inv. |

A-1

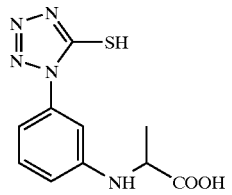

The following compound was added to each of the emulsions Em-a to Em-t, and applied, together with a protective layer, onto a triacetylcellulose film support coated with a subbing layer according to a simultaneous extrusion process. Thus, respective samples 101 to 120 were obtained.

(1) Emulsion Layer

Emulsion: any one of the emulsions Em-a to Em-t (corresponding to samples 101 to 120)

Stabilizer: 4-hydroxy-6-methyl-1,3,3a,7-tetrazaindene (2) Protective Layer

Gelatin

Appropriate sensitometric exposure (1 sec) by light having passed through Fuji filter SC50 was effected for the obtained samples. The exposed samples were subjected to black and white development performed with the use of the CR56 first developer of the following composition at 20° C. for 10 min. The developed samples were subjected to the customary stop, fixing, washing, drying and density measurement.

The composition of the processing solution was as follows.

| <CR56 first developer> | <Tank soln.> |
|---|---|
| Nitrilo-N,N,N-trimethylenephosphonic acid pentasodium salt | 1.5 g |
| Diethylenetriamine pentaacetic acid pentasodium salt | 2.0 g |
| Sodium sulfite | 30 g |
| Potassium hydroquinonemonosulfonate | 20 g |
| Potassium carbonate | 15 g |
| Potassium bicarbonate | 12 g |
| 1-Phenyl-4-methyl-4-hydroxymethyl-3-pyrazolidone | 2.5 g |
| Potassium bromide | 2.5 g |
| Potassium thiocyanate | 1.2 g |
| Potassium iodide | 2.0 mg |
| Diethylene glycol | 13 g |
| Water to make | 1000 mL |
| pH | 9.60 |

The pH was adjusted with sulfuric acid or potassium hydroxide.

This developer contains a satisfactory amount of sodium sulfite (containing 0.24 mol of sulfite ions in 1 L), so that it can be regarded as a developer inducing a solution physical development.

The following Table 2 lists the speed, fog and fog result exhibited upon development after aging of samples in environment of 55° C. and 30% humidity for 3 days. The film speed is defined as the inverse number of exposure intensity realizing a density which is half of the sum of fog and maximum density, and expressed in terms of log E relative value with respect to the difference of speed from that of the sample 101.

TABLE 2

| Coated sample | Emulsion | Speed (log E) | Fog | Fog after 3-day storage under 55° C. & 30% | |
|---|---|---|---|---|---|
| 101 | Em-a | 0.00 | 0.04 | 0.08 | Comp. |
| 102 | Em-b | †0.10 | 0.08 | 0.20 | Comp. |
| 103 | Em-c | †0.12 | 0.12 | 0.35 | Comp. |
| 104 | Em-d | †0.16 | 0.08 | 0.19 | Comp. |
| 105 | Em-e | †0.30 | 0.06 | 0.10 | Inv. |
| 106 | Em-f | †0.31 | 0.07 | 0.10 | Inv. |
| 107 | Em-g | †0.30 | 0.07 | 0.09 | Inv. |
| 108 | Em-h | †0.28 | 0.08 | 0.11 | Inv. |
| 109 | Em-i | †0.29 | 0.08 | 0.11 | Inv. |
| 110 | Em-j | †0.28 | 0.06 | 0.09 | Inv. |
| 111 | Em-k | †0.25 | 0.05 | 0.09 | Inv. |
| 112 | Em-l | †0.17 | 0.07 | 0.17 | Comp. |
| 113 | Em-m | †0.31 | 0.05 | 0.09 | Inv. |
| 114 | Em-n | †0.32 | 0.04 | 0.08 | Inv. |
| 115 | Em-o | †0.31 | 0.05 | 0.09 | Inv. |
| 116 | Em-p | †0.31 | 0.05 | 0.08 | Inv. |
| 117 | Em-q | †0.33 | 0.07 | 0.10 | Inv. |
| 118 | Em-r | †0.31 | 0.05 | 0.07 | Inv. |
| 119 | Em-s | †0.30 | 0.04 | 0.07 | Inv. |
| 120 | Em-t | †0.32 | 0.04 | 0.08 | Inv. |

It is apparent from Table 2 that when development is performed with the use of developer arising a solution physical development, the silver halide photosensitive materials for which the sensitizing method of causing organic electron-donating compounds of the present invention to act is employed exhibit higher film speed, lower fog and longer storability than those of the silver halide photosensitive materials for which the sensitizing method of causing reduction sensitizers or conventional organic electron-donating compounds to act.

For comparison, Table 3 lists the results of coating samples 101, 104, 105, 112 and 113 obtained by performing development with developers (two types) prepared by reducing the amount of $Na_2SO_3.7H_2O$. With respect to all the samples, the specified film speed is a value relative to that of the sample 101. It is apparent that the advantages of the present invention are conspicuous when the development is carried out with the use of developers (0.10 mol/L or more sulfite ions) arising a solution physical development.

TABLE 3

| Coated sample | Sulfite ion contained in developer (mol/L) | Speed (Log E) | Fog | Fog after 3-day storage under 55° C. & 30% | |
|---|---|---|---|---|---|
| 101 | 0.24 | ±0.00 Control | 0.04 | 0.08 | Comp. |
| 104 | 0.24 | †0.16 | 0.08 | 0.19 | Comp. |
| 105 | 0.24 | †0.30 | 0.06 | 0.10 | Inv. |
| 112 | 0.24 | †0.17 | 0.07 | 0.17 | Comp. |
| 113 | 0.24 | †0.31 | 0.05 | 0.09 | Inv. |
| 101 | 0.10 | ±0.00 Control | 0.03 | 0.07 | Comp. |
| 104 | 0.10 | †0.06 | 0.05 | 0.14 | Comp. |
| 105 | 0.10 | †0.14 | 0.04 | 0.09 | Inv. |
| 112 | 0.10 | †0.06 | 0.05 | 0.12 | Comp. |
| 113 | 0.10 | †0.17 | 0.04 | 0.08 | Inv. |
| 101 | 0.07 | ±0.00 Control | 0.02 | 0.05 | Comp. |
| 104 | 0.07 | †0.06 | 0.04 | 0.12 | Comp. |
| 105 | 0.07 | †0.08 | 0.04 | 0.10 | Comp. |
| 112 | 0.07 | †0.06 | 0.04 | 0.11 | Comp. |
| 113 | 0.07 | †0.08 | 0.04 | 0.09 | Comp. |

Example 2

Preparation of Coated Sample 201

1. Preparation of Triacetylcellulose Film

Triacetylcellulose was dissolved (13% by weight) by a common solution casting process in dichloromethane/methanol=92/8 (weight ratio), and triphenyl phosphate and biphenyldiphenyl phosphate in a weight ratio of 2:1, which are plasticizers, were added to the resultant solution so that the total amount of the plasticizers was 14% to the triacetylcellulose. Then, a triacetylcellulose film was made by a band process. The thickness of the support after drying was 97 μm.

2. Components of Undercoat Layer

The two surfaces of the triacetylcellulose film were subjected to undercoating treatment. Numbers represent weight contained per liter of an undercoat solution.

The two surfaces of the triacetylcellulose film were subjected to corona discharge treatment before undercoating treatment.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water to make | 1.0 L |

3. Coating of Back Layers

One surface of the undercoated support was coated with the following back layers.

| | |
|---|---|
| 1st layer | |
| Binder: acid-processed gelatin (isoelectric point: 9.0) | 1.00 g |
| Polymeric latex: P-2 (average grain size: 0.1 μm) | 0.13 g |

-continued

| | |
|---|---|
| Polymeric latex: P-3 (average grain size 0.2 μm) | 0.23 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| 2nd layer | |
| Binder: acid-processed gelatin (isoelectric point: 9.0) | 3.10 g |
| Polymeric latex: P-3 (average grain size: 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| 3rd layer | |
| Binder: acid-processed gelatin (isoelectric point: 9.0) | 3.50 g |
| Surfactant W-3 | 0.020 g |
| Potassium sulfate | 0.30 g |
| Sodium hydroxide | 0.03 g |
| 4th layer | |
| Binder: lime-processed gelatin (isoelectric point: 5.4) | 1.15 g |
| 1:9 copolymer of methacrylic acid and methylmethacrylate (average grain size: 2.0 μm) | 0.040 g |
| 6:4 copolymer of methacrylic acid and methylmethacrylate (average grain size: 2.0 μm) | 0.030 g |
| Surfactant W-3 | 0.060 g |
| Surfactant W-2 | 7.0 mg |
| Hardener H-1 | 0.23 g |

4. Coating of Photosensitive Emulsion Layers

Sample 201 was prepared by coating photosensitive emulsion layers presented below on the side opposite, against the support, to the side having the back layers. Numbers represent addition amounts per $m^2$ of the coating surface. Note that the effects of added compounds are not restricted to the described purposes.

| | |
|---|---|
| 1st layer: Antihalation layer | |
| Black colloidal silver | 0.25 g |
| Gelatin | 2.40 g |
| Ultraviolet absorbent U-1 | 0.15 g |
| Ultraviolet absorbent U-3 | 0.15 g |
| Ultraviolet absorbent U-4 | 0.10 g |
| Ultraviolet absorbent U-5 | 0.10 g |
| High-boiling organic solvent Oil-1 | 0.10 g |
| High-boiling organic solvent Oil-2 | 0.10 g |
| Dye D-4 | 1.0 mg |
| Dye D-8 | 2.5 mg |
| Fine crystal solid dispersion of dye E-1 | 0.05 g |
| 2nd layer: Interlayer | |
| Gelatin | 0.50 g |
| Compound Cpd-A | 0.2 mg |
| Compound Cpd-K | 3.0 mg |
| Compound Cpd-M | 0.030 g |
| Ultraviolet absorbent U-6 | 6.0 mg |

-continued

| | | |
|---|---|---|
| High-boiling organic solvent Oil-3 | | 0.010 g |
| High-boiling organic solvent Oil-4 | | 0.010 g |
| High-boiling organic solvent Oil-7 | | 2.0 mg |
| Dye D-7 | | 4.0 mg |
| 3rd layer: Interlayer | | |
| Yellow colloidal silver | | 0.020 g |
| Silver iodobromide emulsion the surface and internal portion of which are previously fogged (cubic grains, average silver iodide content: 1 mol %, equivalent sphere average grain diameter: 0.06 μm) | silver | 0.010 g |
| Gelatin | | 0.60 g |
| Compound Cpd-D | | 0.020 g |
| High-boiling organic solvent Oil-3 | | 0.010 g |
| High-boiling organic solvent Oil-8 | | 0.010 g |
| 4th layer: Low-speed red-sensitive emulsion layer | | |
| Emulsion A | silver | 0.15 g |
| Emulsion B | silver | 0.20 g |
| Emulsion C | silver | 0.20 g |
| Gelatin | | 0.80 g |
| Coupler C-1 | | 0.10 g |
| Coupler C-2 | | 0.05 g |
| Coupler C-3 | | 0.02 g |
| Coupler C-10 | | 3.0 mg |
| Coupler C-11 | | 2.0 mg |
| Ultraviolet absorbent U-3 | | 0.010 g |
| Compound Cpd-I | | 0.020 g |
| Compound Cpd-D | | 3.0 mg |
| Compound Cpd-J | | 2.0 mg |
| High-boiling organic solvent Oil-2 | | 0.070 g |
| Additive P-1 | | 5.0 mg |
| 5th layer: Medium-speed red-sensitive emulsion layer | | |
| Emulsion C | silver | 0.25 g |
| Emulsion D | silver | 0.25 g |
| Gelatin | | 0.80 g |
| Coupler C-1 | | 0.15 g |
| Coupler C-2 | | 0.08 g |
| Coupler C-3 | | 0.02 g |
| Coupler C-10 | | 3.0 mg |
| Compound Cpd-D | | 3.0 mg |
| Ultraviolet absorbent U-3 | | 0.010 g |
| High-boiling organic solvent Oil-2 | | 0.10 g |
| Additive P-1 | | 7.0 mg |
| 6th layer: High-speed red-sensitive emulsion layer | | |
| Emulsion E | silver | 0.25 g |
| Emulsion F | silver | 0.30 g |
| Gelatin | | 1.70 g |
| Coupler C-1 | | 0.10 g |
| Coupler C-2 | | 0.10 g |
| Coupler C-3 | | 0.60 g |
| Coupler C-10 | | 5.0 mg |
| Ultraviolet absorbent U-1 | | 0.010 g |
| Ultraviolet absorbent U-2 | | 0.010 g |
| High-boiling organic solvent Oil-2 | | 0.050 g |
| Compound Cpd-K | | 1.0 mg |
| Compound Cpd-F | | 0.030 g |
| Compound Cpd-L | | 1.0 mg |
| Additive P-1 | | 0.010 g |
| Additive P-4 | | 0.030 g |
| 7th layer: Interlayer | | |
| Gelatin | | 0.70 g |
| Additive P-2 | | 0.10 g |
| Dye D-5 | | 0.020 g |
| Dye D-9 | | 6.0 mg |
| Compound Cpd-I | | 0.010 g |
| Compound Cpd-M | | 0.040 g |
| Compound Cpd-O | | 3.0 mg |
| Compound Cpd-P | | 5.0 mg |
| High-boiling organic solvent Oil-6 | | 0.050 g |
| 8th layer: Interlayer | | |
| Yellow colloidal silver | | 0.020 g |
| Gelatin | | 1.00 g |
| Additive P-2 | | 0.05 g |

-continued

| | | |
|---|---|---|
| Ultraviolet absorbent U-1 | | 0.010 g |
| Ultraviolet absorbent U-3 | | 0.010 g |
| Compound Cpd-A | | 0.050 g |
| Compound Cpd-D | | 0.030 g |
| Compound Cpd-M | | 0.050 g |
| High-boiling organic solvent Oil-3 | | 0.010 g |
| High-boiling organic solvent Oil-6 | | 0.050 g |
| 9th layer: Low-speed green-sensitive emulsion layer | | |
| Emulsion G | silver | 0.30 g |
| Emulsion H | silver | 0.35 g |
| Emulsion I | silver | 0.30 g |
| Gelatin | | 1.70 g |
| Coupler C-4 | | 0.20 g |
| Coupler C-5 | | 0.050 g |
| Coupler C-6 | | 0.020 g |
| Coupler C-7 | | 0.010 g |
| Compound Cpd-A | | 5.0 mg |
| Compound Cpd-B | | 0.030 g |
| Compound Cpd-D | | 5.0 mg |
| Compound Cpd-G | | 2.5 mg |
| Compound Cpd-F | | 0.010 g |
| Compound Cpd-K | | 2.0 mg |
| Ultraviolet absorbent U-6 | | 5.0 mg |
| High-boiling organic solvent Oil-2 | | 0.15 g |
| Additive P-1 | | 5.0 mg |
| 10th layer: Medium-speed green-sensitive emulsion layer | | |
| Emulsion I | silver | 0.30 g |
| Emulsion J | silver | 0.30 g |
| Silver bromide emulsion the internal portion of which is fogged (cubic grains, equivalent sphere average grain diameter: 0.11 μm) | silver | 3.0 mg |
| Gelatin | | 0.70 g |
| Coupler C-4 | | 0.050 g |
| Coupler C-5 | | 0.050 g |
| Coupler C-6 | | 0.020 g |
| Coupler C-7 | | 0.010 g |
| Compound Cpd-A | | 5.0 mg |
| Compound Cpd-B | | 0.030 g |
| Compound Cpd-F | | 0.010 g |
| Compound Cpd-G | | 2.0 mg |
| High-boiling organic solvent Oil-2 | | 0.030 g |
| 11th layer: High-speed green-sensitive emulsion layer | | |
| Emulsion K | silver | 0.60 g |
| Gelatin | | 0.80 g |
| Coupler C-6 | | 0.40 g |
| Coupler C-7 | | 5.0 mg |
| Compound Cpd-A | | 5.0 mg |
| Compound Cpd-B | | 0.030 g |
| Compound Cpd-F | | 0.010 g |
| High-boiling organic solvent Oil-2 | | 0.030 g |
| 12th layer: Yellow filter layer | | |
| Yellow colloidal silver | silver | 0.010 g |
| Gelatin | | 1.0 g |
| Compound Cpd-C | | 0.010 g |
| Compound Cpd-M | | 0.10 g |
| High-boiling organic solvent Oil-1 | | 0.020 g |
| High-boiling organic solvent Oil-6 | | 0.10 g |
| Fine crystal solid dispersion of dye E-2 | | 0.20 g |
| 13th layer: Interlayer | | |
| Gelatin | | 0.40 g |
| Compound Cpd-Q | | 0.20 g |
| Dye D-6 | | 2.0 mg |
| High-boiling organic solvent Oil-5 | | 0.010 g |
| 14th layer: Low-speed blue-sensitive emulsion layer | | |
| Emulsion L | silver | 0.15 g |
| Emulsion M | silver | 0.20 g |
| Emulsion N | silver | 0.10 g |
| Gelatin | | 0.80 g |
| Coupler C-8 | | 0.020 g |
| Coupler C-9 | | 0.30 g |
| Coupler C-10 | | 5.0 mg |
| Compound Cpd-B | | 0.10 g |

-continued

| | | |
|---|---|---|
| Compound Cpd-I | | 8.0 mg |
| Compound Cpd-K | | 1.0 mg |
| Compound Cpd-M | | 0.010 g |
| Ultraviolet absorbent U-6 | | 0.010 g |
| High-boiling organic solvent Oil-2 | | 0.010 g |
| 15th layer: Medium-speed blue-sensitive emulsion layer | | |
| Emulsion N | silver | 0.20 g |
| Emulsion O | silver | 0.20 g |
| Silver bromide emulsion the internal portion of which is fogged (cubic grains, equivalent sphere average grain diameter: 0.11 μm) | silver | 3.0 mg |
| Gelatin | | 0.80 g |
| Coupler C-8 | | 0.020 g |
| Coupler C-9 | | 0.25 g |
| Coupler C-10 | | 0.010 g |
| Compound Cpd-B | | 0.10 g |
| Compound Cpd-N | | 2.0 mg |
| High-boiling organic solvent Oil-2 | | 0.010 g |
| 16th layer: High-speed blue-sensitive emulsion layer | | |
| Emulsion P | silver | 0.20 g |
| Emulsion Q | silver | 0.25 g |
| Gelatin | | 2.00 g |
| Coupler C-3 | | 5.0 mg |
| Coupler C-8 | | 0.10 g |
| Coupler C-9 | | 1.00 g |
| Coupler C-10 | | 0.020 g |
| High-boiling organic solvent Oil-2 | | 0.10 g |
| High-boiling organic solvent Oil-3 | | 0.020 g |
| Ultraviolet absorbent U-6 | | 0.10 g |
| Compound Cpd-B | | 0.20 g |
| Compound Cpd-E | | 0.030 g |
| Compound Cpd-N | | 5.0 mg |
| 17th layer: 1st protective layer | | |
| Gelatin | | 1.00 g |
| Ultraviolet absorbent U-1 | | 0.15 g |
| Ultraviolet absorbent U-2 | | 0.050 g |
| Ultraviolet absorbent U-5 | | 0.20 g |
| Compound Cpd-O | | 5.0 mg |

-continued

| | | |
|---|---|---|
| Compound Cpd-A | | 0.030 g |
| Compound Cpd-H | | 0.20 g |
| Dye D-1 | | 8.0 mg |
| Dye D-2 | | 0.010 g |
| Dye D-3 | | 0.010 g |
| High-boiling organic solvent Oil-3 | | 0.10 g |
| 18th layer: 2nd protective layer | | |
| Colloidal silver | silver | 2.5 mg |
| Fine grain silver iodobromide emulsion (equivalent sphere average grain diameter 0.06 μm, average silver iodide content: 1 mol %) | silver | 0.10 g |
| Gelatin | | 0.80 g |
| Compound Cpd-T | | 0.24 g |
| Ultraviolet absorbent U-1 | | 0.030 g |
| Ultraviolet absorbent U-6 | | 0.030 g |
| High-boiling organic solvent Oil-3 | | 0.010 g |
| 19th layer: 3rd protective layer | | |
| Gelatin | | 1.00 g |
| Polymethylmethacrylate (average grain size 1.5 μm) | | 0.10 g |
| 6:4 copolymer of methylmethacrylate and methacrylic acid (average grain size 1.5 μm) | | 0.15 g |
| Silicone oil SO-1 | | 0.20 g |
| Surfactant W-1 | | 3.0 mg |
| Surfactant W-2 | | 8.0 mg |
| Surfactant W-3 | | 0.040 g |
| Surfactant W-7 | | 0.015 g |

In addition to the above compositions, additives F-1 to F9 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

C-1

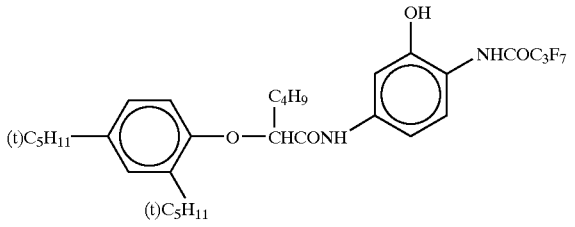

C-2

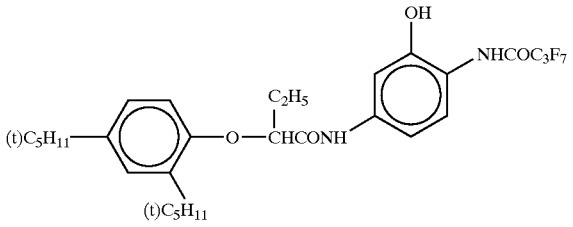

C-3

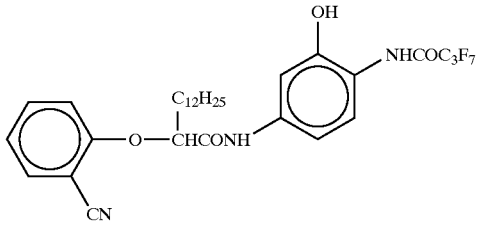

C-4

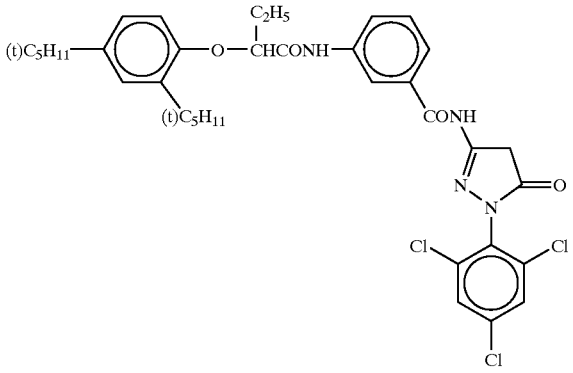

-continued
C-5
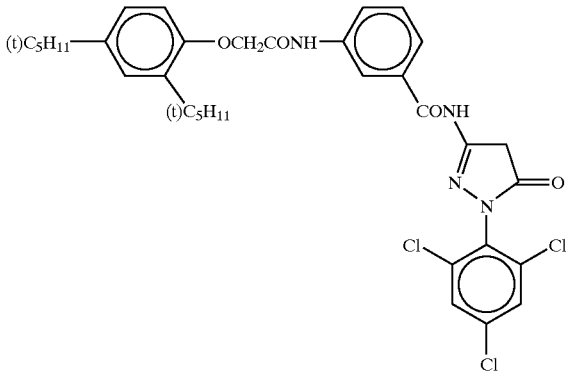
C-6
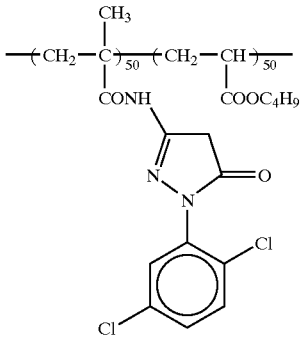
The numbers are in wt. %
Av. molecular weight: about 25,000
C-7
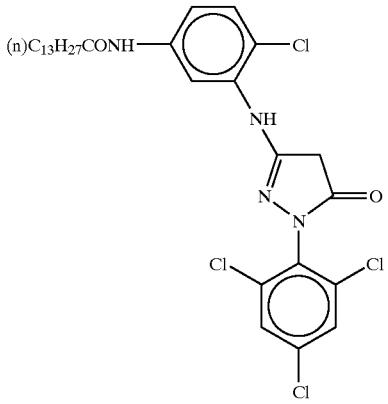
C-8
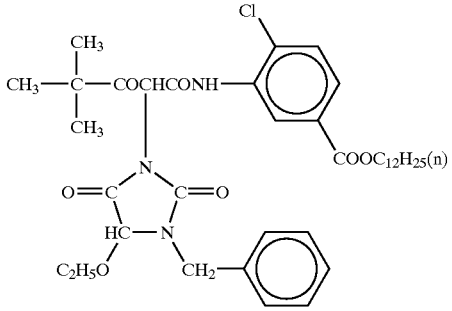
C-9
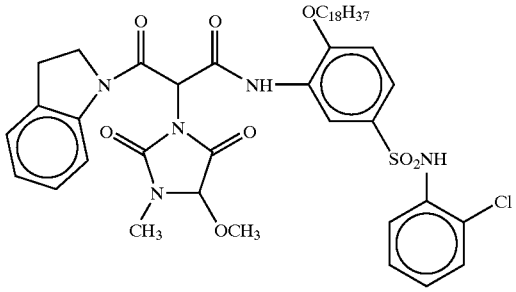
C-10
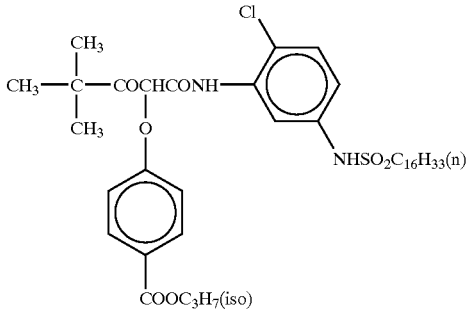
C-11
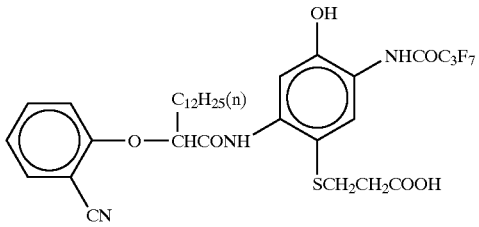
C-12
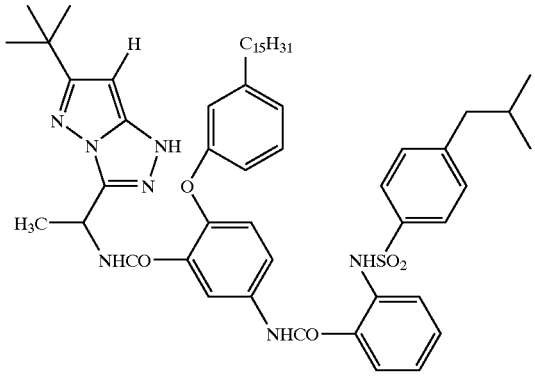

-continued
C-13
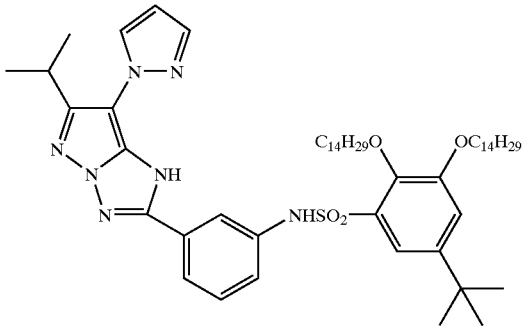
Oil-1
Tri-n-hexyl phosphate
Oil-2
Tricresyl phosphate
Oil-3
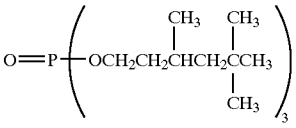
Oil-4
Tricyclohexyl phosphate
Oil-5
Bis (2-ethylhexyl) succinate
Oil-6
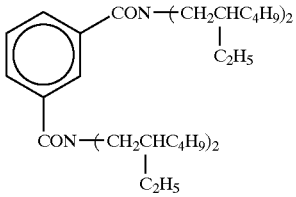
Oil-7
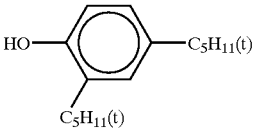
Oil-8
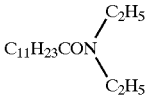
Cpd-A
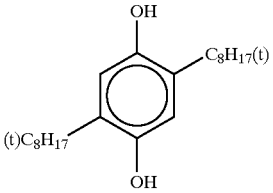
Cpd-B
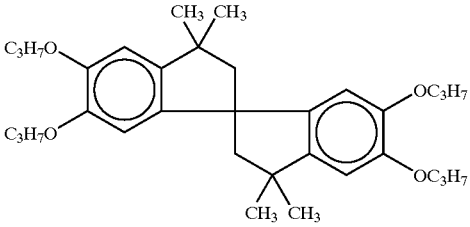
Cpd-C
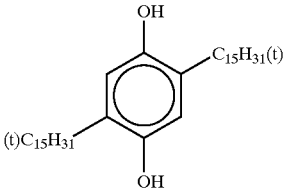
Cpd-D
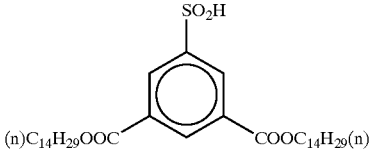
Cpd-E
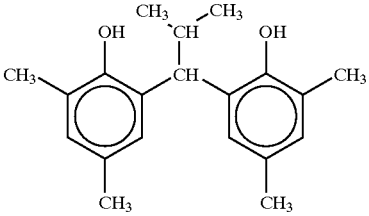
Cpd-F
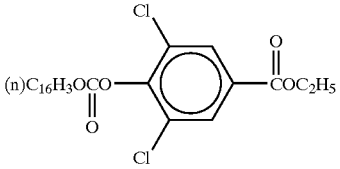
Cpd-G
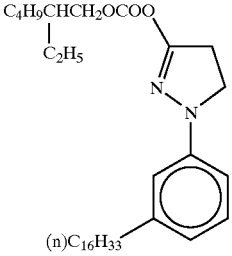

-continued
Cpd-H
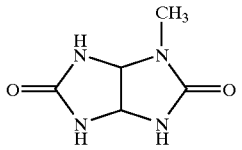
Cpd-I
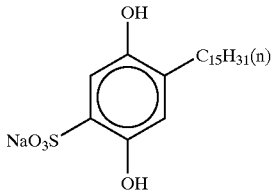
Cpd-J
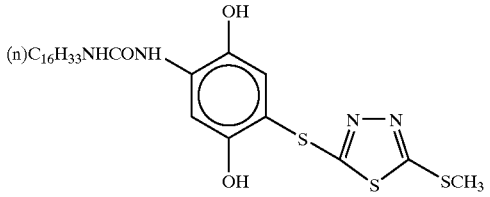
Cpd-K
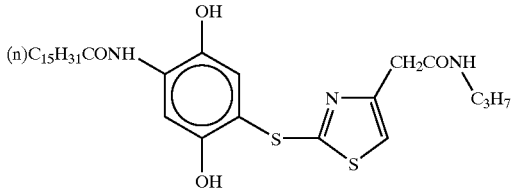
Cpd-L
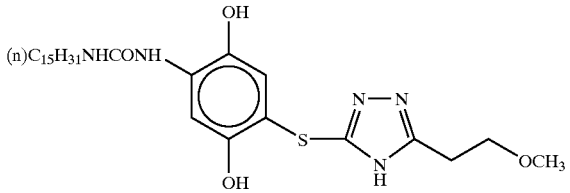
Cpd-M
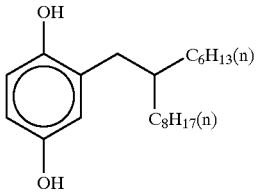
Cpd-N
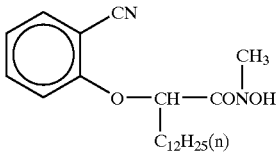
Cpd-O
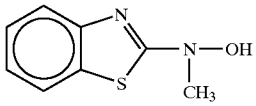
Cpd-P
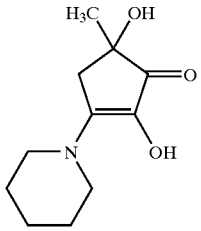
Cpd-Q
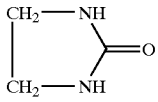
U-1
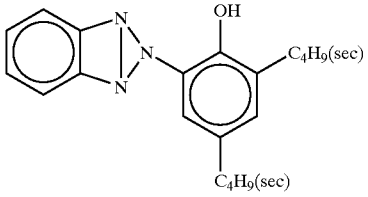
U-2
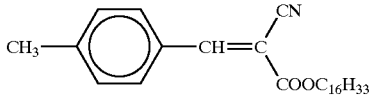
U-3
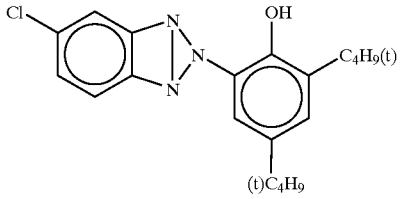
U-4
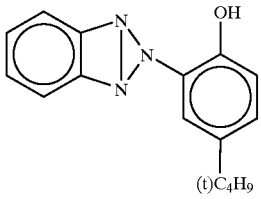

-continued
U-5
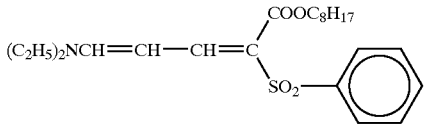
U-6
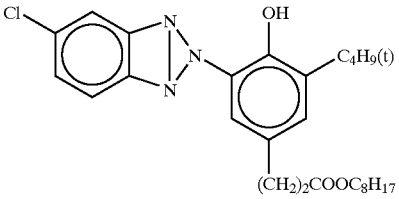
S-1
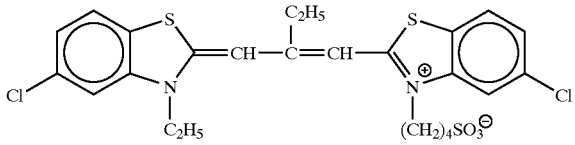
S-2
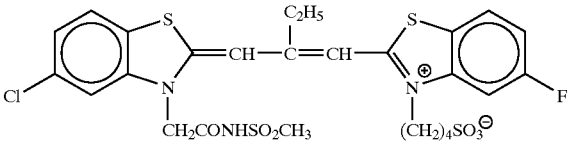
S-3
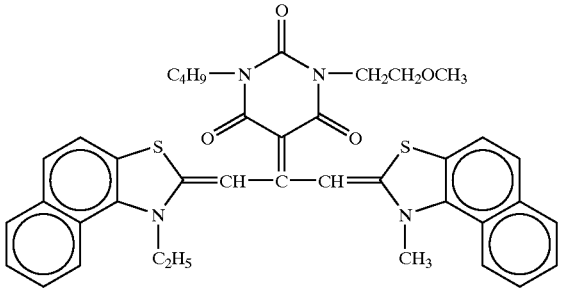
S-4
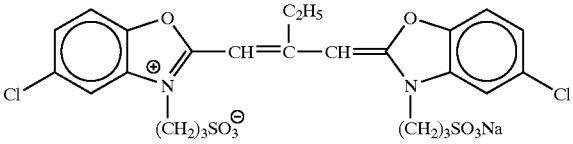
S-5
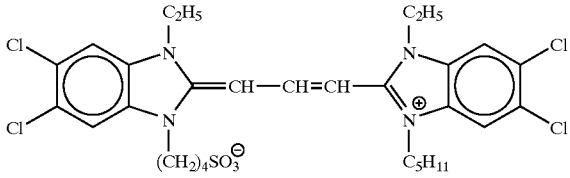
S-6
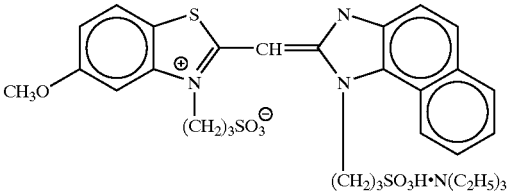
S-7
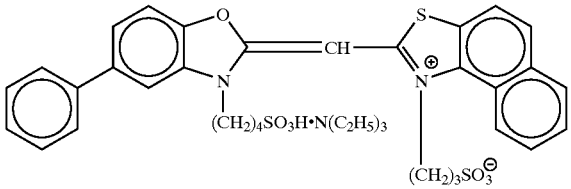
S-8
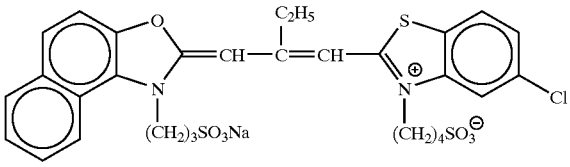
S-9
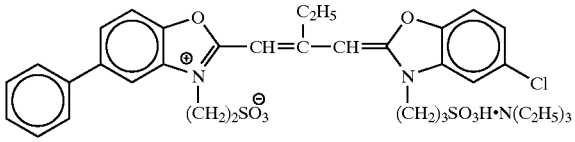
S-10
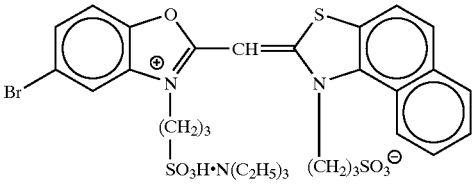
S-11
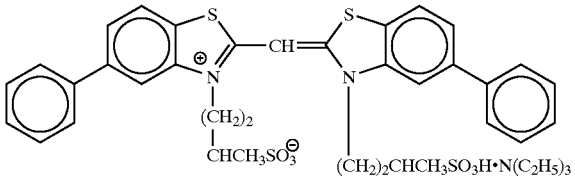
S-12
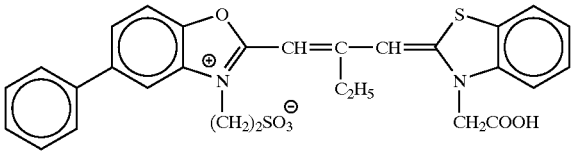

-continued
S-13
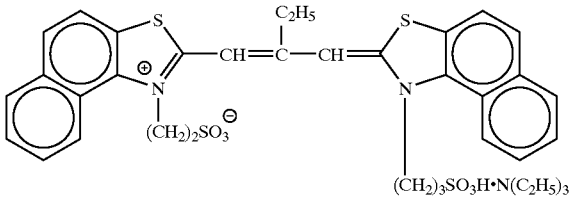
S-14
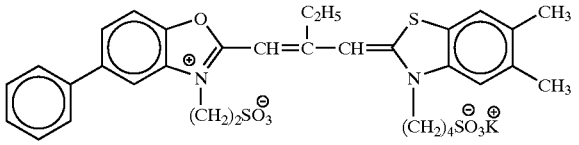
D-1
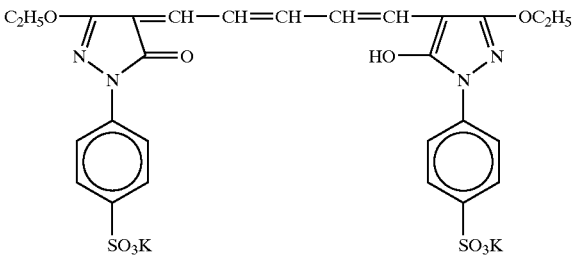
D-2
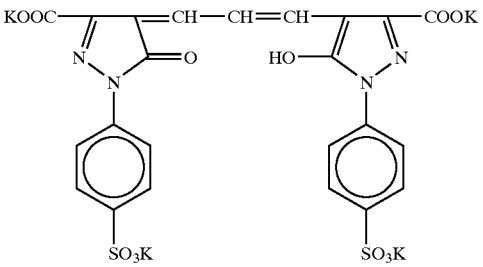
D-3
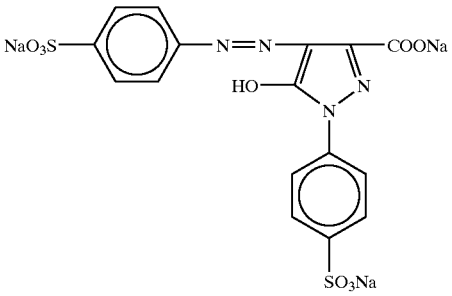
D-4
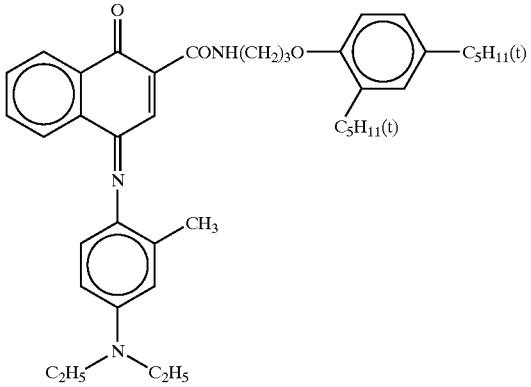
D-5
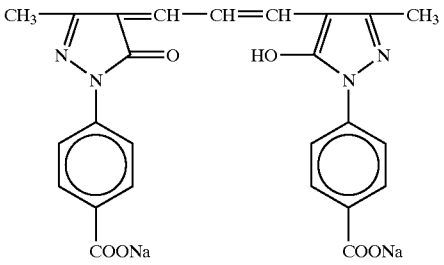
D-6
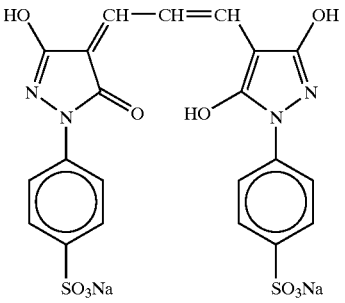
D-7
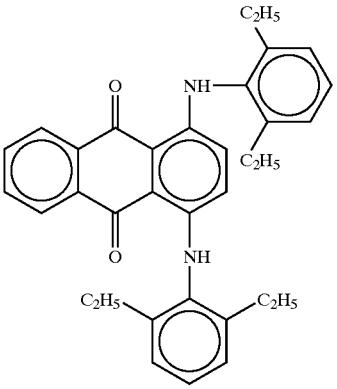
D-8
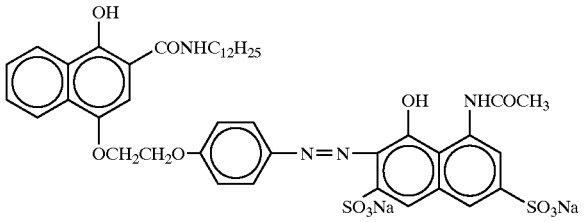

-continued
D-9
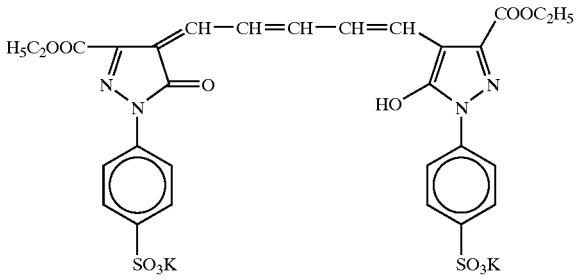
D-10
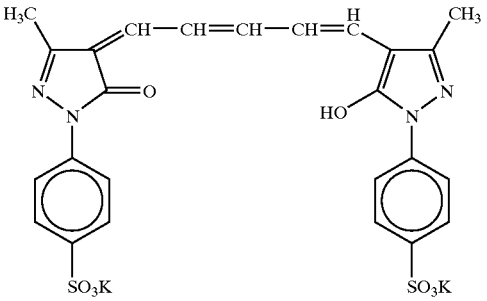
E-1
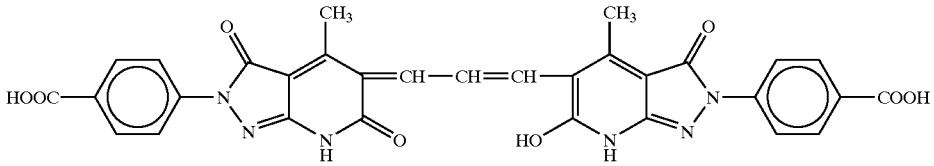
E-2
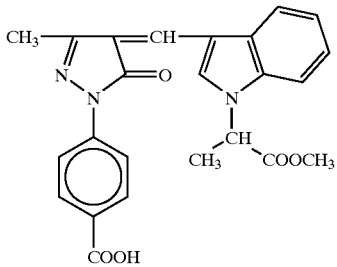
H-1
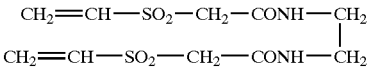
W-1
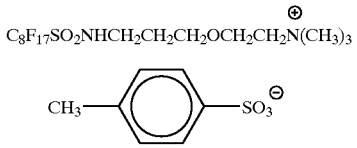
W-2
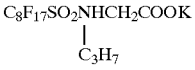
W-3
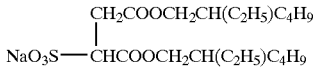
W-4
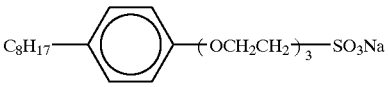
W-5
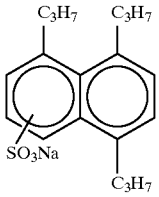
W-6
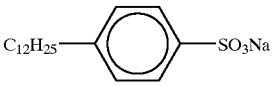
W-7
$C_8F_{17}SO_3Li$
P-1
(n = 100–1000)
P-2
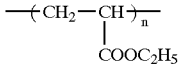
(n = 100–1000)
P-3
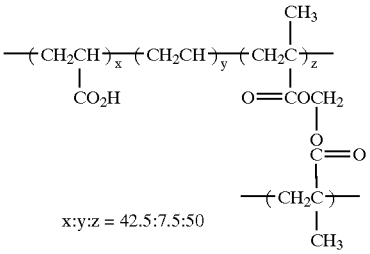
x:y:z = 42.5:7.5:50

-continued

P-4

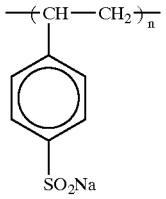

(n = 100–1000)

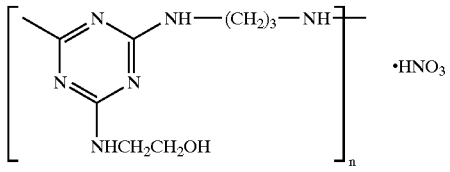

(n = 3–4)

F-1

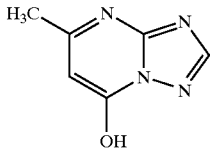

F-2

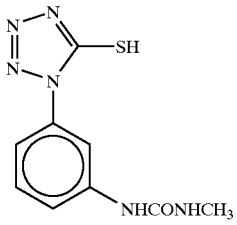

F-3

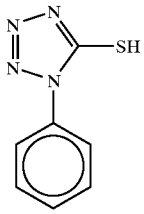

F-4

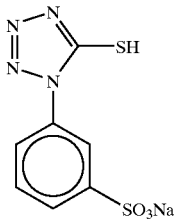

F-5

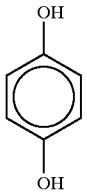

F-6

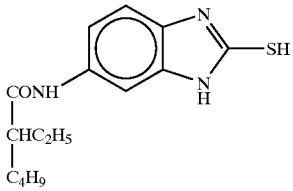

F-7

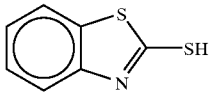

F-8

F-9

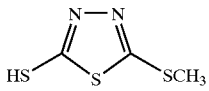

SO-1

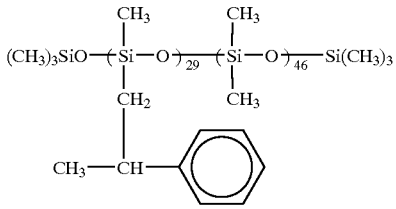

Preparation of Organic Solid Dispersed Dye (Preparation of Fine Crystalline Solid Dispersion of Dye E-1)

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 2 hr. The beads were filtered out, and water was added to dilute the material to a dye concentration of 3%. After that, the material was heated to 90° C. for 10 hr for stabilization. The average grain size of the obtained fine dye grains was 0.30 $\mu$m, and the grain size distribution (grain size standard deviation×100/average grain size) was 20%.

(Preparation of Fine Crystalline Solid Dispersion of Dye E-2)

Water and 270 g of W-4 were added to 1,400 g of a wet cake of E-2 containing 30 weight % of water, and the resultant material was stirred to form a slurry having an E-2 concentration of 40 weight %. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 8 hr, thereby obtaining a solid fine-grain dispersion of E-2. This dispersion was diluted to 20 weight % by ion exchange water to obtain a fine crystalline solid dispersion. The average grain size was 0.15 μm.

The characteristics of the emulsions used are shown in Table 4, and spectral sensitizing dyes added to the emulsions and the amounts thereof are shown in Table 5.

TABLE 4

Configuration of silver halide emulsions

Silver iodobromide emulsions used in sample 101

| Emulsion | Characteristics | Av. ESD (μm) | COV (%) | Av. AgI content (mol %) | Structure in halide composition of silver halide grains | AgI content at grain surface (mol %) | Other characteristics (1) | (2) | (3) | (4) | (5) |
|---|---|---|---|---|---|---|---|---|---|---|---|
| A | Monodispersed tetradecahedral grains | 0.23 | 9 | 3.5 | Triple structure | 1.5 | | ○ | | | |
| B | Monodispersed (111) tabular grains Av. aspect ratio 2.8 | 0.27 | 20 | 3.5 | Quadruple structure | 1.5 | ○ | ○ | ○ | ○ | ○ |
| C | Monodispersed (111) tabular grains Av. aspect ratio 2.1 | 0.30 | 19 | 3.0 | Triple structure | 0.1 | ○ | ○ | | ○ | ○ |
| D | Monodispersed (111) tabular grains Av. aspect ratio 3.2 | 0.34 | 21 | 4.5 | Triple structure | 1.8 | ○ | ○ | | ○ | ○ |
| E | Monodispersed (111) tabular grains Av. aspect ratio 3.3 | 0.39 | 10 | 2.0 | Quadruple structure | 1.5 | | ○ | | | |
| F | Monodispersed (111) tabular grains Av. aspect ratio 4.5 | 0.55 | 12 | 1.5 | Triple structure | 0.5 | ○ | ○ | | | ○ |
| G | Monodispersed cubic grains | 0.16 | 9 | 3.5 | Quadruple structure | 2.0 | | | ○ | | |
| H | Monodispersed cubic grains | 0.24 | 12 | 4.9 | Quadruple structure | 0.1 | ○ | ○ | | ○ | |
| I | Monodispersed (111) tabular grains Av. aspect ratio 4.0 | 0.30 | 12 | 3.5 | Quintuple structure | 4.5 | ○ | ○ | | ○ | ○ |
| J | Monodispersed (111) tabular grains Av. aspect ratio 5.0 | 0.45 | 21 | 3.0 | Quadruple structure | 0.2 | ○ | ○ | | ○ | ○ |
| K | Monodispersed (111) tabular grains Av. aspect ratio 5.5 | 0.58 | 12 | 2.7 | Triple structure | 1.1 | ○ | ○ | | | ○ |
| M | Monodispersed tetradecahedral grains | 0.30 | 9 | 7.5 | Triple structure | 5.0 | ○ | ○ | | ○ | ○ |
| N | Monodispersed (111) tabular grains Av. aspect ratio 3.0 | 0.33 | 13 | 2.1 | Quadruple structure | 4.0 | ○ | ○ | ○ | | |
| O | Monodispersed (111) tabular grains Av. aspect ratio 3.0 | 0.43 | 9 | 2.5 | Quadruple structure | 1.0 | ○ | ○ | | ○ | ○ |
| P | Monodispersed (111) tabular grains Av. aspect ratio 6.5 | 0.72 | 21 | 2.8 | Triple structure | 0.5 | ○ | ○ | | | ○ |
| Q | Monodispersed (111) tabular grains Av. aspect ratio 6.2 | 0.88 | 8 | 0.8 | Quadruple structure | 0.4 | ○ | ○ | | | ○ |

Av. ESD = Equivalent sphere average grain size; COV = Coefficient of variation (Other characteristics) The mark "○" means each of the conditions set forth below is satisfied.

(1) A reduction sensitizer was added during grain formation;

(2) A selenium sensitizer was used as an after-ripening agent (3) A rhodium salt was added during grain formation.

(4) A shell was provided subsequent to after-ripening by using silver nitrate in an amount of 10%, in terms of silver molar ratio, of the emulsion grains at that time, together with the equimolar amount of potassium bromide (5) The presence of dislocation lines in an average number of ten or more per grain was observed by a transmission electron microscope.

Note that all the lightsensitive emulsion were after-ripped by the use of sodium thiosulfate, potassium thiocyanate, and sodium aurichloride.

Note, also, a iridium salt was added during grain formation.

Note, also, that chemically-modified gelatin whose amino groups were partially converted to phthalic acid amide, was added to emulsions B, C, E, H, J, N, and Q.

TABLE 5

Spectral sensitization of emulsions A to Q

| Emulsion | Spectral sensitizer added | Addition amount per mol of silver halide (g) | Timing of the addition of the spectral sensitizer |
|---|---|---|---|
| A | S-1 | 0.01 | Subsequent to after-ripening |
| | S-2 | 0.35 | Prior to after-ripening |
| | S-3 | 0.02 | Prior to after-ripening |
| | S-8 | 0.03 | Prior to after-ripening |
| | S-13 | 0.015 | Prior to after-ripening |
| | S-14 | 0.01 | Prior to after-ripening |
| B | S-2 | 0.35 | Prior to after-ripening |
| | S-3 | 0.02 | Prior to after-ripening |
| | S-8 | 0.03 | Prior to after-ripening |
| | S-13 | 0.015 | Prior to after-ripening |
| | S-14 | 0.01 | Prior to after-ripening |
| C | S-2 | 0.45 | Prior to after-ripening |
| | S-8 | 0.04 | Prior to after-ripening |
| | S-13 | 0.02 | Prior to after-ripening |
| D | S-2 | 0.52 | Subsequent to after-ripening |
| | S-3 | 0.05 | Subsequent to after-ripening |
| | S-8 | 0.05 | Prior to after-ripening |
| | S-13 | 0.015 | Prior to after-ripening |
| E | S-1 | 0.01 | Prior to after-ripening |
| | S-2 | 0.48 | Prior to after-ripening |
| | S-8 | 0.05 | Prior to after-ripening |
| | S-13 | 0.01 | Subsequent to after-ripening |
| F | S-2 | 0.42 | Prior to after-ripening |
| | S-3 | 0.04 | Prior to after-ripening |
| | S-8 | 0.04 | Prior to after-ripening |
| G | S-4 | 0.3 | Subsequent to after-ripening |
| | S-5 | 0.05 | Subsequent to after-ripening |
| | S-12 | 0.1 | Subsequent to after-ripening |
| H | S-4 | 0.2 | Prior to after-ripening |
| | S-5 | 0.05 | Subsequent to after-ripening |
| | S-9 | 0.15 | Prior to after-ripening |
| | S-14 | 0.02 | Subsequent to after-ripening |
| I | S-4 | 0.3 | Prior to after-ripening |
| | S-9 | 0.2 | Prior to after-ripening |
| | S-12 | 0.1 | Prior to after-ripening |
| J | S-4 | 0.35 | Prior to after-ripening |
| | S-5 | 0.05 | Subsequent to after-ripening |
| | S-12 | 0.1 | Prior to after-ripening |
| K | S-4 | 0.32 | Prior to after-ripening |
| | S-9 | 0.05 | Prior to after-ripening |
| | S-12 | 0.1 | Prior to after-ripening |
| | S-14 | 0.02 | Prior to after-ripening |
| L, M | S-6 | 0.1 | Subsequent to after-ripening |
| | S-10 | 0.2 | Subsequent to after-ripening |
| | S-11 | 0.05 | Subsequent to after-ripening |
| N | S-6 | 0.05 | Subsequent to after-ripening |
| | S-7 | 0.05 | Subsequent to after-ripening |
| | S-10 | 0.25 | Subsequent to after-ripening |
| | S-11 | 0.05 | Subsequent to after-ripening |
| O | S-10 | 0.4 | Subsequent to after-ripening |
| | S-11 | 0.15 | Subsequent to after-ripening |
| P | S-6 | 0.05 | Subsequent to after-ripening |
| | S-7 | 0.05 | Subsequent to after-ripening |
| | S-10 | 0.33 | Prior to after-ripening |
| | S-11 | 0.1 | Prior to after-ripening |
| Q | S-6 | 0.05 | Prior to after-ripening |
| | S-7 | 0.05 | Prior to after-ripening |
| | S-10 | 0.2 | Prior to after-ripening |
| | S-11 | 0.27 | Prior to after-ripening |

Preparation of Em-(i)

Dye S-2 was added in an amount optimum for chemical sensitization to emulsion Em-a of Example 1 before chemical sensitization, and caused to act at 40° C. for 20 min. The mixture was heated to 56° C., and in the presence of potassium thiocyanate, optimum gold-sulfur-selenium sensitization thereof was effected with the use of hypo, N,N-dimethylselenourea and chloroauric acid as a sulfur sensitizer, gold sensitizer and selenium sensitizer, respectively, thereby obtaining emulsion Em-(i).

Preparation of Em-(ii) to Em-(vi)

In the same manner as in the preparation of emulsion Em-(i), emulsions Em-d, Em-e, Em-i, Em-l and Em-n were subjected to addition of dye S-2, acting thereof and optimum gold-sulfur-selenium sensitization, thereby obtaining emulsions Em-(ii), Em-(iii), Em-(iv), Em-(v) and Em-(vi), respectively.

Preparation of Em-(vii) to Em-(ix)

After the preparation of emulsions Em-(ii), Em-(iii) and Em-(vi), AgBrI silver halide fine grain emulsion containing 1 mol % of silver iodide and having an equivalent diameter (in terms of diameter of a sphere of equal volume) of 0.05 μm was added thereto each in an amount corresponding to 3 mol % of the silver quantity of host grains and ripened, thereby obtaining emulsions Em-(vii), Em-(viii) and Em-(ix), respectively.

Samples 202 to 210 were obtained by replacing the emulsion B of the sample 201 with each of the thus obtained emulsions.

Evaluation of Samples

Evaluation of Speed and Fog

Each of the thus obtained samples 202 to 210 was subjected to wedge exposure through SC-39 filter manufactured by Fuji Photo Film Co., Ltd. wherein use was made of a white light source of 2500 Lux and 4800 K 1/50 sec color temperature, and then to the following development processing. Thereafter, the inverse number (E) of relative exposure amount realizing a cyan color formation density of 0.2 was determined, which was referred to as the cyan color formation speed of each sample. It was ascertained that the cyan color formation speed of the sample 201 was brought about mainly by the emulsion B. In particular, it was expressed by a relative value providing that the speed of the sample 202 was 100. Further, the cyan color formation maximum density of each of the samples was obtained and the density decrement of each of the samples from the cyan color formation maximum density of the sample 202 as a reference was determined. With respect to reversal photosensitive materials, for convenience, this density decrement be regarded as the fog of each sample. Generally, a decrease of the cyan color formation maximum density invites a fog increase. Evaluation of a fog change during the sample storage was performed by comparing the difference of cyan color formation maximum density between sample having been stored in 45° C./55% humidity environment for 7 days and sample not having been subjected to storage aging with that of sample 202 as a reference. The details and results of the samples are listed in Table 6.

TABLE 6

| Coated sample | Emulsion | Organic electron-donating compound | Storability improving compound | Shell was provided or not provided after chemical sensitization | Relative speed at cyan density of 0.2 | Cyan color maximum density | Change in cyan color maximum density after 7-day storage under 45° C. & 55% | |
|---|---|---|---|---|---|---|---|---|
| 202 | Em-(i) | — | — | — | 100 | Control | Control | Comp. |
| 203 | Em-(ii) | A-1 | — | — | 140 | −0.08 | −0.23 | Comp. |
| 204 | Em-(iii) | 1 | — | — | 198 | −0.04 | −0.05 | Inv. |
| 205 | Em-(iv) | 21 | — | — | 194 | −0.08 | −0.06 | Inv. |
| 206 | Em-(v) | A-1 | A-3 | — | 147 | −0.06 | −0.18 | Comp. |
| 207 | Em-(vi) | 21 | A-3 | — | 210 | −0.01 | −0.02 | Inv. |
| 208 | Em-(vii) | A-1 | — | Provided | 155 | −0.12 | −0.30 | Comp. |
| 209 | Em-(viii) | 1 | — | Provided | 208 | −0.05 | −0.07 | Inv. |
| 210 | Em-(ix) | 21 | A-3 | Provided | 225 | −0.03 | −0.04 | Inv. |

It is apparent from Table 6 that with respect to red-sensitive emulsions, the organic electron-donating compounds of the present invention realize higher speed, lower fog and less degree of fog after storage than those of conventional compounds, thereby attesting to effective action of storage improver. Further, it has been found that when emulsion grains are covered with shells, the organic electron-donating compounds of the present invention function more effectively.

Example 3

Preparation of Em-(x)

Dye S-4 was added in an amount optimum for chemical sensitization to emulsion Em-a of Example 1 before chemical sensitization, and caused to act at 40° C. for 20 min. The mixture was heated to 56° C., and in the presence of potassium thiocyanate, optimum gold-sulfur-selenium sensitization thereof was effected with the use of hypo, N,N-dimethylselenoureaa and chloroauric acid as a sulfur sensitizer, selenium sensitizer and gold sensitizer, respectively, thereby obtaining emulsion Em-(x).

Preparation of Em-(xi) to Em-(xiii)

In the same manner as in the preparation of emulsion Em-(x), emulsions Em-d, Em-e and Em-g were subjected to addition of dye S-4, acting thereof and optimum gold-sulfur-selenium sensitization, thereby obtaining emulsions Em-(xi), Em-(xii) and Em-(xiii), respectively.

Preparation of Samples 302 to 309

Samples 302 to 304 were obtained by replacing the emulsion G of the sample 201 with each of the thus obtained emulsions. Further, samples 305 to 309 were obtained by replacing the couplers C-4 and C-5 of the samples 302 to 304 with 0.6-fold molar amount of couplers C-12 and C-13, respectively.

Evaluation of Sample

Evaluation of Speed and Fog

Each of the thus obtained samples 302 to 309 was subjected to wedge exposure through SC-39 filter manufactured by Fuji Photo Film Co., Ltd. wherein use was made of a white light source of 2500 Lux and 4800 K 1/50 sec color temperature, and then to the following development processing. Thereafter, the inverse number (E) of relative exposure amount realizing a magenta color formation density of 0.18 was determined, which was referred to as the magenta color formation speed of each sample. It was ascertained that the magenta color formation speed of the sample 201 was brought about mainly by the emulsion G. In particular, it was expressed by a relative value providing that the speed of the sample 302 was 100. Further, the magenta color formation maximum density decrement of each of the samples from the magenta color formation maximum density of the sample 302 as a reference was determined. For convenience, this decreased density can be regarded as the fog of each sample. Generally, a decrease of the magenta color formation maximum density invites a fog increase. Evaluation of a fog change during the sample storage was performed by comparing the difference of magenta color formation maximum density between sample having been stored in 45° C./55% humidity environment for 7 days and sample not having been subjected to storage aging with that of sample 302 as a reference. The details and results of the samples are listed in Table 7.

TABLE 7

| Coated sample | Emulsion | Coupler in 9th and 11th layers | Organic electron-donating compound | Relative speed at magenta density of 0.18 | Magenta color maximum density | Change in magenta color maximum density after 7-day storage under 45° C. & 55% | |
|---|---|---|---|---|---|---|---|
| 302 | Em-(x) | C-4, 5, 6, 7 | — | 100 | Control | Control | Comp. |
| 303 | Em-(xi) | C-4, 5, 6, 7 | A-1 | 155 | −0.06 | −0.20 | Comp. |
| 304 | Em-(xii) | C-4, 5, 6, 7 | 1 | 205 | −0.04 | −0.06 | Inv. |
| 305 | Em-(xiii) | C-4, 5, 6, 7 | 19 | 208 | −0.06 | −0.07 | Inv. |
| 306 | Em-(x) | C-12, 13, 6, 7 | — | 95 | †0.05 | −0.08 | Comp. |
| 307 | Em-(xi) | C-12, 13, 6, 7 | A-1 | 162 | −0.08 | −0.25 | Comp. |
| 308 | Em-(xii) | C-12, 13, 6, 7 | 1 | 225 | −0.04 | −0.07 | Inv. |
| 309 | Em-(xiii) | C-12, 13, 6, 7 | 19 | 232 | −0.06 | −0.08 | Inv. |

From Table 7, there have been obtained unexpected results that with respect to green-sensitive emulsions, the organic electron-donating compounds of the present invention realize higher speed, lower fog and less degree of fog after storage than those of conventional compounds, and that the effects thereof are enhanced by combination with couplers of specified structure (C-12 and C-13).

Evident regeneration of these results was attained by the use of a magenta coupler represented by the following general formula MC-1:

(MC-1)

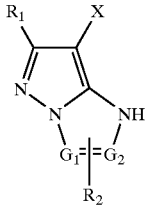

In the general formula (MC-I), $R_1$ represents a hydrogen atom or substituent; one of $G_1$ and $G_2$ represents a carbon atom, and the other represents a nitrogen atom; and $R_2$ represents a substituent that substitutes one of $G_1$ and $G_2$ which is a carbon atom. $R_1$ and $R_2$ may further have a substituent. A polymer of the general formula (MC-I) may be formed via $R_1$ or $R_2$. A polymer chain may be bonded via $R_1$ or $R_2$. X represents a hydrogen atom or a group that is capable of splitting off by a coupling reaction with an oxidized aromatic primary amine color developing agent.

In Examples 2 and 3 the following development processing steps (Development A) were performed.

On the occasion of processing, the processing for the evaluations was conducted after the running processing with an unexposed sample 201 and a fully exposed sample 201 in a ratio of 1:1 until the replenishing volume becomes four times the tank volume.

| Step | Time (min) | Temp. (° C.) | Tank vol. (L) | Replenishment rate (mL/m²) |
|---|---|---|---|---|
| 1st Development | 6 | 38 | 12 | 2200 |
| 1st Aater washing | 2 | 38 | 4 | 7500 |
| Reversal | 2 | 38 | 4 | 1100 |
| Color development | 6 | 38 | 12 | 2200 |
| Prebleaching | 2 | 38 | 4 | 1100 |
| Bleaching | 6 | 38 | 12 | 220 |
| Fixing | 4 | 38 | 8 | 1100 |
| 2nd Water washing | 4 | 38 | 8 | 7500 |
| Final rinse | 1 | 25 | 2 | 1100 |

The composition of each processing solution was as follows. The solution for the 1st development contains sodium sulfite in a large amount so that the development solution can be regarded as developer in which a solution physical development arises.

| (1st development solution) | Tank solution | Replenisher |
|---|---|---|
| Pentasodium nitrilo-N,N,N-trimethylenephosphonate | 1.5 g | 1.5 g |
| Pentasodium diethylenetriaminepentacetate | 2.0 g | 2.0 g |
| Sodium sulfite | 30 g | 30 g |
| Hydroquinone/potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolidone | 2.5 g | 3.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1000 mL | 1000 mL |
| pH | 9.60 | 9.60 |

This pH was adjusted by the use of sulfuric acid or potassium hydroxide.

| (reversal solution) | Tank solution | Replenisher |
|---|---|---|
| Pentasodium nitrilo-N,N,N-trimethylenephosphonate | 3.0 g | same as the tank solution |
| Stannous chloride dihydrate | 1.0 g | |
| p-Aminophenol | 0.1 g | |
| Sodium hydroxide | 8 g | |
| Glacial acetic acid | 15 mL | |
| Water to make | 1000 mL | |
| pH | 6.00 | |

This pH was adjusted by the use of acetic acid or sodium hydroxide.

| (Color developer) | Tank solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 8.0 g | 8.0 g |
| Citrazinic acid | 0.5 g | 0.5 g |
| N-Ethyl-N-(β-methanesulfonamidoethyl)-3-methyl-4-aminoaniline 3/2 sulfate monohydrate | 10 g | 10 g |
| 3,6-Dithiaoctane-1,8-diol | 1.0 g | 1.0 g |
| Water to make | 1000 mL | 1000 mL |
| pH | 11.80 | 12.00 |

This pH was adjusted by the use of sulfuric acid or potassium hydroxide.

| (Prebleaching) | Tank solution | Replenisher |
|---|---|---|
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde/sodium bisulfite adduct | 30 g | 35 g |
| Water to make | 1000 mL | 1000 mL |
| pH | 6.30 | 6.10 |

This pH was adjusted by the use of acetic acid or sodium hydroxide.

| (Bleaching solution) | Tank solution | Re-plenisher |
|---|---|---|
| Disodium ethylenediaminetetraacetate dihydrate | 2.0 g | 4.0 g |
| Fe (III) ammonium ethylenediaminetetraacetate dihydrate | 120 g | 240 g |
| Potassium bromide | 100 g | 200 g |
| Ammonium nitrate | 10 g | 20 g |
| Water to make | 1000 mL | 1000 mL |
| pH | 5.70 | 5.50 |

This pH was adjusted by the use of nitric acid or sodium hydroxide.

| (Fixing solution) | Tank solution | Replenisher |
|---|---|---|
| Ammonium thiosulfate | 80 g | same as the tank solution |
| Sodium sulfite | 5.0 g | |
| Sodium bisulfite | 5.0 g | |
| Water to make | 1000 mL | |
| pH | 6.60 | |

This pH was adjusted by the use of acetic acid or aqueous ammonia.

| (Stabilizer) | Tank solution | Replenisher |
|---|---|---|
| 1,2-Benzoisothiazolin-3-one | 0.02 g | 0.03 g |
| Polyoxyethylene p-monononylphenyl ether (av. deg. of polymn. 10) | 0.3 g | 0.3 g |
| Polymaleic acid (av. mol. wt. 2,000) | 0.1 g | 0.15 g |
| Water to make | 1000 mL | 1000 mL |
| pH | 7.0 | 7.0 |

Note that in the development processing step, the solution of each bath was continuously circulated and stirred, and at the bottom of each tank was provided with a bubbling pipe having small apertures of 0.3 mm diameter in intervals of 1 cm, and nitrogen gas was continuously bubbled through the apertures to stir the solution.

Example 4

Preparation of Coated Sample 401

(I) Preparation of Triacetylcellulose Film

Triacetylcellulose was dissolved (13% by weight) by a common solution casting process in dichloromethane/methanol=92/8 (weight ratio), and triphenyl phosphate and biphenyldiphenyl phosphate in a weight ratio of 2:1, which are plasticizers, were added to the resultant solution so that the total amount of the plasticizers was 14% to the triacetylcellulose. Then, a triacetylcellulose film was made by a band process. The thickness of the support after drying was 97 $\mu$m.

(II) Components of Undercoat Layer

The two surfaces of the triacetylcellulose film were subjected to undercoating treatment. Numbers represent weight contained per liter of an undercoat solution.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water to make | 1.0 L |

One surface of the undercoated support was coated with the following back layers.

| | |
|---|---|
| 1st layer | |
| Binder: acid-processed gelatin (isoelectric point: 9.0) | 1.00 g |
| Polymeric latex: P-2 (average grain size: 0.1 $\mu$m) | 0.13 g |
| Polymeric latex: P-3 (average grain size 0.2 $\mu$m) | 0.23 g |
| Ultraviolet absorbent U-41 | 0.030 g |
| Ultraviolet absorbent U-42 | 0.010 g |
| Ultraviolet absorbent U-43 | 0.010 g |
| Ultraviolet absorbent U-44 | 0.020 g |
| High-boiling organic solvent Oil-42 | 0.030 g |
| Surfactant W-42 | 0.010 g |
| Surfactant W-44 | 3.0 mg |
| 2nd layer | |
| Binder: acid-processed gelatin (isoelectric point: 9.0) | 3.10 g |
| Polymeric latex: P-3 (average grain size: 0.2 $\mu$m) | 0.11 g |
| Ultraviolet absorbent U-41 | 0.030 g |
| Ultraviolet absorbent U-43 | 0.010 g |
| Ultraviolet absorbent U-44 | 0.020 g |
| High-boiling organic solvent Oil-42 | 0.030 g |
| Surfactant W-42 | 0.010 g |
| Surfactant W-44 | 3.0 mg |
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| 3rd layer | |
| Binder: acid-processed gelatin (isoelectric point: 9.0) | 3.30 g |
| Surfactant W-42 | 0.020 g |
| Potassium sulfate | 0.30 g |
| Sodium hydroxide | 0.03 g |
| 4th layer | |
| Binder: lime-processed gelatin (isoelectric point: 5.4) | 1.15 g |
| 1:9 copolymer of methacrylic acid and methylmethacrylate (average grain size: 2.0 $\mu$m) | 0.040 g |
| 6:4 copolymer of methacrylic acid and methylmethacrylate (average grain size: 2.0 $\mu$m) | 0.030 g |
| Surfactant W-42 | 0.060 g |
| Surfactant W-41 | 7.0 mg |
| Hardener H-1 | 0.23 g |

(IV) Coating of Photosensitive Emulsion Layers

Sample 401 was prepared by coating photosensitive emulsion layers presented below on the side opposite, against the support, to the side having the back layers. Numbers represent addition amounts per $m^2$ of the coating surface. Note that the effects of added compounds are not restricted to the described purposes.

The gelatin shown below and used were those having molecular weight (weight-average molecular weight) of 100,000 to 200,000. The contents of major metal ions of calcium, iron and sodium were 2,500 to 3,000 ppm, 1 to 7 ppm and 1,500 to 3,000 ppm, respectively.

Gelatin whose calcium content is 1,000 ppm or less was also used in combination.

For each of the layers the organic compounds to be added were prepared as emulsified dispersion (W-42, W-43 and W-44 were used as surfactants) containing gelatin. Each of the light-sensitive emulsions and yellow colloidal silver were also prepared as gelatin dispersions. These dispersions were mixed so that the indicated addition amounts were obtained to prepare coating solutions for coatings. Cpd—H, —O, —P and —Q, Dye D-1, -2, -3, -5, -6, -8, -9 and -10, H-1, P-4, F1 to F9 were dissolved into water or a water miscible organic solvent such as methanol, dimethylformamide, ethanol or dimethylacetamide, and then the solutions were added to the coating liquids for respective layers.

The gelatin concentration (weight of solid gelatin/coating liquid volume) of each layer thus prepared were within the range of 2.5% to 15.0%. The pH of each coating liquid was in the range of 5.0 to 8.5, and pAg of each of the coating liquids containing a silver halide emulsion was in the range of 7.0 to 9.5 when the temperature was adjusted to 40° C.

After the coating, drying was effected in a drying step of multiple stages at temperatures in the range of 10 to 45 ° C. to obtain the sample.

| | | | |
|---|---|---|---|
| 1st layer: Antihalation layer | | | |
| Black colloidal silver | | 0.20 | g |
| Gelatin | | 2.20 | g |
| Compound Cpd-B | | 0.010 | g |
| Ultraviolet absorbent U-41 | | 0.050 | g |
| Ultraviolet absorbent U-43 | | 0.020 | g |
| Ultraviolet absorbent U-44 | | 0.020 | g |
| Ultraviolet absorbent U-45 | | 0.010 | g |
| Ultraviolet absorbent U-42 | | 0.070 | g |
| Compound Cpd-F | | 0.20 | g |
| High-boiling organic solvent Oil-42 | | 0.020 | g |
| High-boiling organic solvent Oil-46 | | 0.020 | g |
| Dye D-4 | | 1.0 | mg |
| Dye D-8 | | 1.0 | mg |
| Fine crystal solid dispersion 2 of dye E-1 | | 0.05 | g |
| 2nd layer: Interlayer | | | |
| Gelatin | | 0.4 | g |
| Compound Cpd-F | | 0.050 | g |
| Compound Cpd-R | | 0.020 | g |
| Compound Cpd-S | | 0.020 | g |
| High-boiling organic solvent Oil-46 | | 0.010 | g |
| High-boiling organic solvent Oil-47 | | 5.0 | mg |
| High-boiling organic solvent Oil-48 | | 0.020 | g |
| Dye D-11 | | 2.0 | mg |
| Dye D-7 | | 4.0 | mg |
| 3rd layer: Interlayer | | | |
| Gelatin | | 0.4 | g |
| 4th layer: Light-sensitive emulsion layer | | | |
| Emulsion R' | silver | 0.20 | g |
| Emulsion S' | silver | 0.10 | g |
| Fine grain silver iodide (equivalent sphere average grain diameter: 0.05 μm, cubic) | silver | 0.050 | g |
| Gelatin | | 0.5 | g |
| Compound Cpd-F | | 0.030 | g |
| High-boiling organic solvent Oil-46 | | 0.010 | g |
| 5th layer: Light-sensitive emulsion layer | | | |
| Emulsion U' | silver | 0.20 | g |
| Gelatin | | 0.4 | g |

-continued

| | | | |
|---|---|---|---|
| 6th layer: Interlayer | | | |
| Gelatin | | 1.50 | g |
| Compound Cpd-M | | 0.10 | g |
| Compound Cpd-D | | 0.010 | g |
| Compound Cpd-K | | 3.0 | mg |
| Compound Cpd-O | | 3.0 | mg |
| Compound Cpd-T | | 5.0 | mg |
| Ultraviolet absorbent U-46 | | 0.010 | g |
| High-boiling organic solvent Oil-46 | | 0.10 | g |
| High-boiling organic solvent Oil-43 | | 0.010 | g |
| High-boiling organic solvent Oil-44 | | 0.010 | g |
| 7th layer: Low-speed red-sensitive emulsion layer | | | |
| Emulsion A' | silver | 0.15 | g |
| Emulsion B' | silver | 0.10 | g |
| Emulsion C' | silver | 0.15 | g |
| Yellow colloidal silver | silver | 1.0 | mg |
| Gelatin | | 0.60 | g |
| Coupler C-41 | | 0.15 | g |
| Coupler C-42 | | 7.0 | mg |
| Ultraviolet absorbent U-42 | | 3.0 | mg |
| Compound Cpd-J | | 2.0 | mg |
| High-boiling organic solvent Oil-45 | | 0.050 | g |
| High-boiling organic solvent Oil-50 | | 0.020 | g |
| 8th layer: Medium-speed red-sensitive emulsion layer | | | |
| Emulsion C' | silver | 0.20 | g |
| Emulsion D' | silver | 0.15 | g |
| Internally-fogged silver bromide emulsion (cubic, equivalent sphere average grain diameter: 0.11 μm) | silver | 0.010 | g |
| Gelatin | | 0.60 | g |
| Coupler C-41 | | 0.15 | g |
| Coupler C-42 | | 7.0 | mg |
| High-boiling organic solvent Oil-45 | | 0.050 | g |
| High-boiling organic solvent Oil-50 | | 0.020 | g |
| Compound Cpd-T | | 2.0 | mg |
| 9th layer: High-speed red-sensitive emulsion layer | | | |
| Emulsion E' | silver | 0.15 | g |
| Emulsion F' | silver | 0.20 | g |
| Gelatin | | 1.50 | g |
| Coupler C-41 | | 0.70 | g |
| Coupler C-42 | | 0.025 | g |
| Coupler C-43 | | 0.020 | g |
| Coupler C-48 | | 3.0 | mg |
| Ultraviolet absorbent U-41 | | 0.010 | g |
| High-boiling organic solvent Oil-45 | | 0.25 | g |
| High-boiling organic solvent Oil-49 | | 0.05 | g |
| High-boiling organic solvent Oil-50 | | 0.10 | g |
| Compound Cpd-D | | 3.0 | mg |
| Compound Cpd-L | | 1.0 | mg |
| Compound Cpd-T | | 0.050 | g |
| Additive P-1 | | 0.010 | g |
| Additive P-4 | | 0.010 | g |
| Dye D-8 | | 1.0 | mg |
| 10th layer: Interlayer | | | |
| Gelatin | | 0.50 | g |
| Additive P-2 | | 0.030 | g |
| Dye D-5 | | 0.010 | g |
| Dye D-9 | | 6.0 | mg |
| Compound Cpd-I | | 0.020 | g |
| Compound Cpd-O | | 3.0 | mg |
| Compound Cpd-P | | 5.0 | mg |
| 11th layer: Interlayer | | | |
| Yellow colloidal silver | | 3.0 | mg |
| Gelatin | | 1.00 | g |
| Additive P-2 | | 0.010 | g |
| Compound Cpd-A | | 0.030 | g |
| Compound Cpd-M | | 0.10 | g |
| Compound Cpd-O | | 2.0 | mg |
| Ultraviolet absorbent U-41 | | 0.010 | g |
| Ultraviolet absorbent U-42 | | 0.010 | g |
| Ultraviolet absorbent U-45 | | 5.0 | mg |
| High-boiling organic solvent Oil-43 | | 0.010 | g |
| High-boiling organic solvent Oil-46 | | 0.10 | g |

-continued

| | | | |
|---|---|---|---|
| 12th layer: Low-speed green-sensitive emulsion layer | | | |
| Emulsion G' | silver | 0.15 | g |
| Emulsion H' | silver | 0.15 | g |
| Emulsion I' | silver | 0.15 | g |
| Gelatin | | 1.00 | g |
| Coupler C-44 | | 0.060 | g |
| Coupler C-45 | | 0.10 | g |
| Compound Cpd-B | | 0.020 | g |
| Compound Cpd-G | | 2.5 | mg |
| Compound Cpd-K | | 1.0 | mg |
| High-boiling organic solvent Oil-42 | | 0.010 | g |
| High-boiling organic solvent Oil-45 | | 0.020 | g |
| 13th layer: Medium-speed green-sensitive emulsion layer | | | |
| Emulsion I' | silver | 0.10 | g |
| Emulsion J' | silver | 0.20 | g |
| Gelatin | | 0.50 | g |
| Coupler C-44 | | 0.10 | g |
| Coupler C-45 | | 0.050 | g |
| Coupler C-46 | | 0.010 | g |
| Compound Cpd-B | | 0.020 | g |
| Compound Cpd-U | | 8.0 | mg |
| High-boiling organic solvent Oil-42 | | 0.010 | g |
| High-boiling organic solvent Oil-45 | | 0.020 | g |
| Additive P-1 | | 0.010 | g |
| 14th layer: High-speed green-sensitive emulsion layer | | | |
| Emulsion J' | silver | 0.15 | g |
| Emulsion K' | silver | 0.25 | g |
| Internally-fogged silver bromide emulsion (cubic, equivalent sphere average grain diameter: 0.11 μm) | silver | 5.0 | mg |
| Gelatin | | 1.20 | g |
| Coupler C-44 | | 0.50 | g |
| Coupler C-45 | | 0.20 | g |
| Coupler C-47 | | 0.10 | g |
| Compound Cpd-B | | 0.030 | g |
| Compound Cpd-U | | 0.020 | g |
| High-boiling organic solvent Oil-45 | | 0.15 | g |
| Additive P-1 | | 0.030 | g |
| 15th layer: Yellow filter layer | | | |
| Yellow colloidal silver | silver | 2.0 | mg |
| Gelatin | | 1.0 | g |
| Compound Cpd-C | | 0.010 | g |
| Compound Cpd-M | | 0.020 | g |
| High-boiling organic solvent Oil-41 | | 0.020 | g |
| High-boiling organic solvent Oil-46 | | 0.020 | g |
| Fine crystal solid dispersion 2 of dye E-2 | | 0.25 | g |
| 16th layer: Light-sensitive emulsion layer | | | |
| Emulsion T' | silver | 0.15 | g |
| Gelatin | | 0.40 | g |
| Coupler C-41 | | 5.0 | mg |
| Coupler C-42 | | 0.5 | mg |
| High-boiling organic solvent Oil-45 | | 2.0 | mg |
| Compound Cpd-Q | | 0.20 | g |
| Dye D-6 | | 2.0 | mg |
| 17th layer: Low-speed blue-sensitive emulsion layer | | | |
| Emulsion L' | silver | 0.08 | g |
| Emulsion M' | silver | 0.10 | g |
| Emulsion N' | silver | 0.12 | g |
| Surface and internally-fogged silver bromide emulsion (cubic, equivalent sphere average grains size 0.11 μm) | silver | 0.010 | g |
| Gelatin | | 0.80 | g |
| Coupler C-48 | | 0.020 | g |
| Coupler C-49 | | 0.020 | g |
| Coupler C-50 | | 0.20 | g |
| Compound Cpd-B | | 0.010 | g |
| Compound Cpd-I | | 8.0 | mg |
| Compound Cpd-K | | 2.0 | mg |
| Ultraviolet absorbent U-45 | | 0.010 | g |
| Additive P-1 | | 0.020 | g |

-continued

| | | | |
|---|---|---|---|
| 18th layer: Medium-speed blue-sensitive emulsion layer | | | |
| Emulsion N' | silver | 0.20 | g |
| Emulsion O' | silver | 0.20 | g |
| Gelatin | | 0.80 | g |
| Coupler C-48 | | 0.030 | g |
| Coupler C-49 | | 0.030 | g |
| Coupler C-50 | | 0.30 | g |
| Compound Cpd-B | | 0.015 | g |
| Compound Cpd-E | | 0.020 | g |
| Compound Cpd-N | | 2.0 | mg |
| Compound Cpd-T | | 0.010 | g |
| Ultraviolet absorbent U-45 | | 0.015 | g |
| Additive P-1 | | 0.030 | g |
| 19th layer: High-speed blue-sensitive emulsion layer | | | |
| Emulsion P' | silver | 0.20 | g |
| Emulsion Q' | silver | 0.15 | g |
| Gelatin | | 2.00 | g |
| Coupler C-48 | | 0.10 | g |
| Coupler C-49 | | 0.15 | g |
| Coupler C-50 | | 1.10 | g |
| Coupler C-43 | | 0.010 | g |
| High-boiling organic solvent Oil-45 | | 0.020 | g |
| Compound Cpd-B | | 0.060 | g |
| Compound Cpd-D | | 3.0 | mg |
| Compound Cpd-E | | 0.020 | g |
| Compound Cpd-F | | 0.020 | g |
| Compound Cpd-N | | 5.0 | mg |
| Compound Cpd-T | | 0.070 | g |
| Ultraviolet absorbent U-45 | | 0.060 | g |
| Additive P-1 | | 0.10 | g |
| 20th layer: 1st protective layer | | | |
| Gelatin | | 0.70 | g |
| Ultraviolet absorbent U-41 | | 0.020 | g |
| Ultraviolet absorbent U-45 | | 0.030 | g |
| Ultraviolet absorbent U-42 | | 0.10 | g |
| Compound Cpd-B | | 0.030 | g |
| Compound Cpd-O | | 5.0 | mg |
| Compound Cpd-A | | 0.030 | g |
| Compound Cpd-H | | 0.20 | g |
| Dye D-1 | | 2.0 | mg |
| Dye D-2 | | 3.0 | mg |
| Dye D-3 | | 2.0 | mg |
| High-boiling organic solvent Oil-42 | | 0.020 | g |
| High-boiling organic solvent Oil-43 | | 0.030 | g |
| 21st layer: 2nd protective layer | | | |
| Fine grain silver iodobromide emulsion (average grain size 0.06 μm, AgI content 1 mol %) | silver | 0.10 | g |
| Gelatin | | 0.80 | g |
| Ultraviolet absorbent U-42 | | 0.030 | g |
| Ultraviolet absorbent U-45 | | 0.030 | g |
| High-boiling organic solvent Oil-42 | | 0.010 | g |
| 22nd layer: 3rd protective layer | | | |
| Gelatin | | 1.00 | g |
| Polymethylmethacrylate (average grain size 1.5 μm) | | 0.10 | g |
| 6:4 copolymer of methylmethacrylate and methacrylic acid (average grain size 1.5 μm) | | 0.15 | g |
| Silicone oil SO-1 | | 0.20 | g |
| Surfactant W-41 | | 0.010 | g |
| Surfactant W-42 | | 0.040 | g |

In addition to the above compositions, additives F1 to F9 were added to all emulsion layers. Also, a gelatin hardener H-1 and surfactants W-42, W-43, and W-44 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

The thus prepared sample 401 had a coating layer thickness in a dry state of 25.8 μm, and swelling rate when swelled by purified water at 25° C. thereof was 1.78 times.

C-41
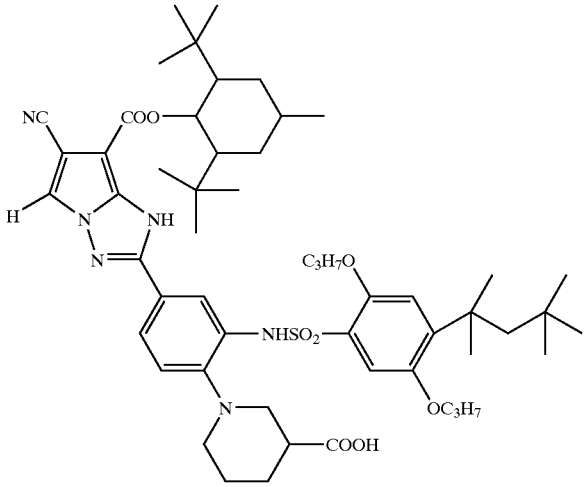
C-42
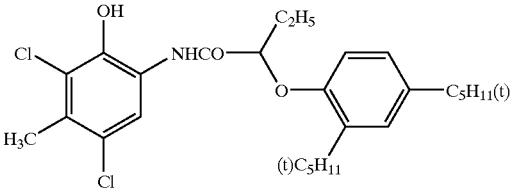
C-43
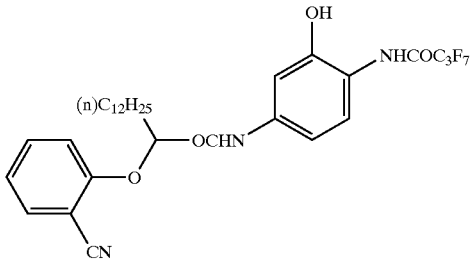
C-44
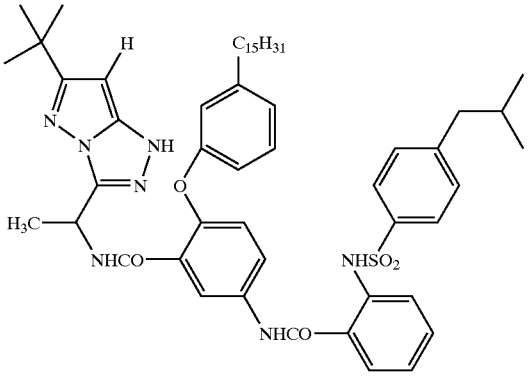
C-45
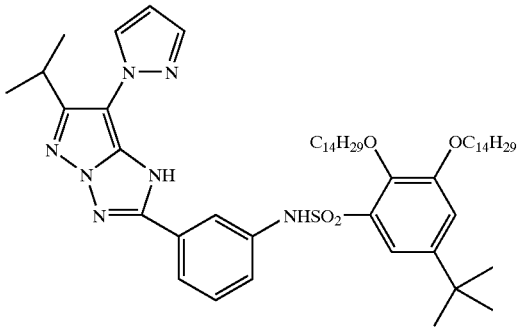
C-46
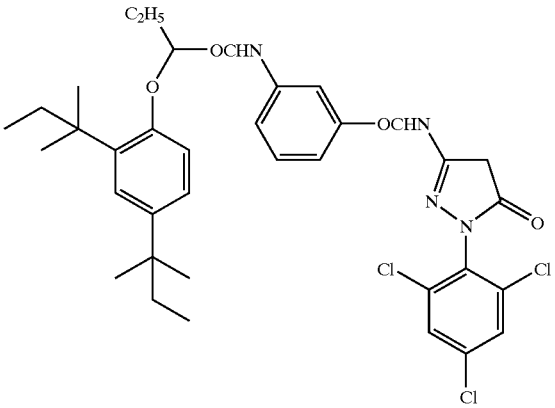
C-47
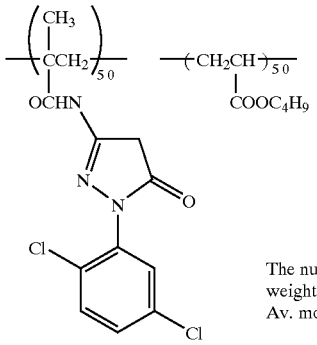
The numbers represents weight%.
Av. mol. wt: about 25,000
C-48
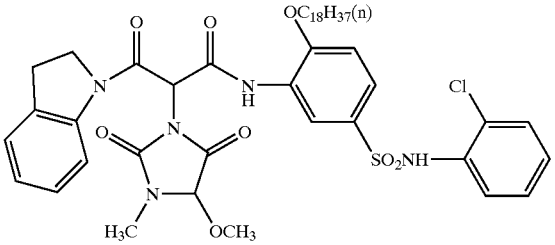

-continued
C-49
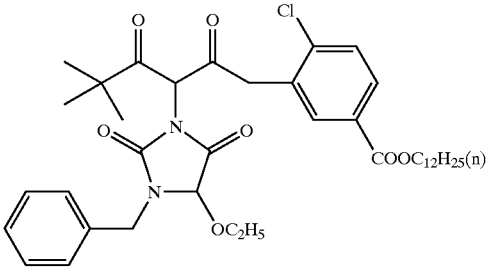
C-50
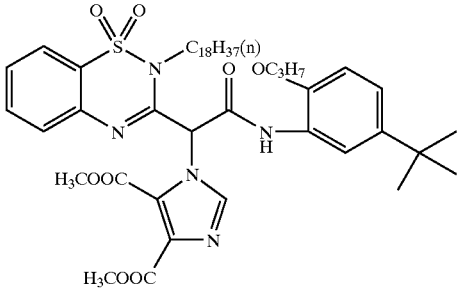
Oil-41
Tri-n-hexyl phosphate
Oil-42
Tricresyl phosphate
Oil-43
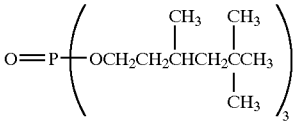
Oil-44
Tricyclohexcyl phosphate
Oil-45
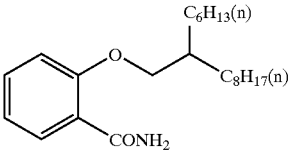
Oil-46
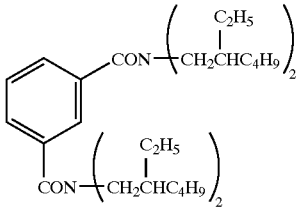
Oil-47
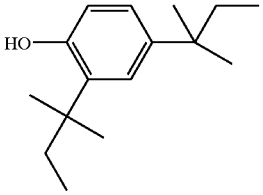
Oil-48
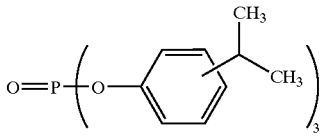
(A mixtures of isomers)
Oil-49
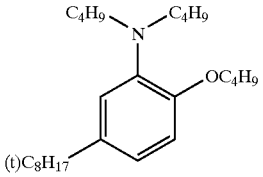
Oil-50
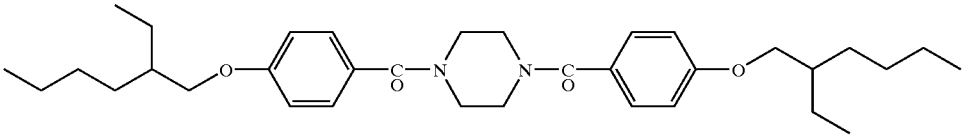
Cpd-R
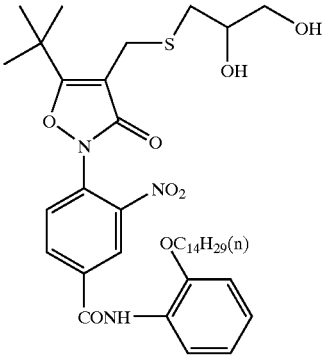
Cpd-S
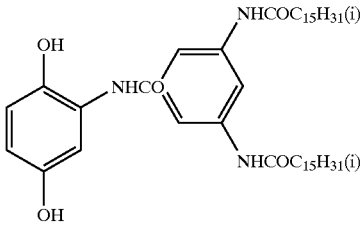

-continued
Cpd-T
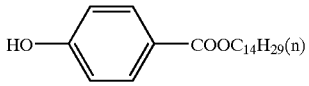
Cpd-U
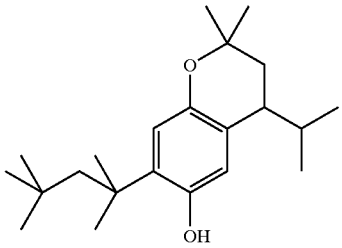
U-41
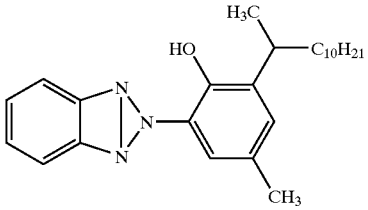
U-42
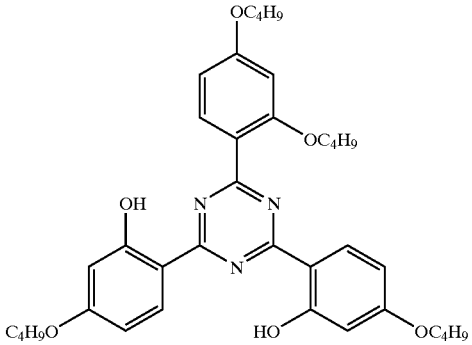
U-43
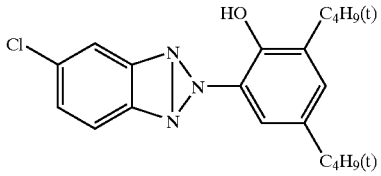
U-44
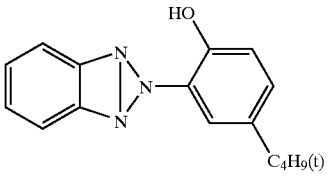
U-45
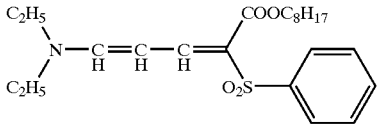
U-46
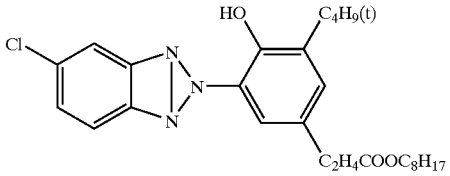
S-41
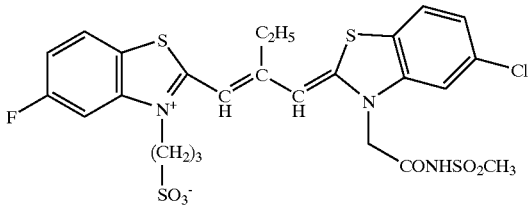
S-42
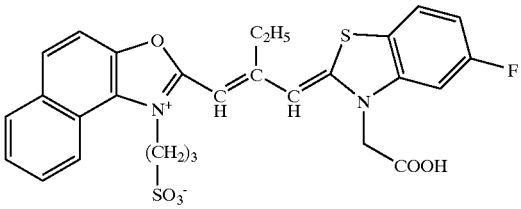
S-43
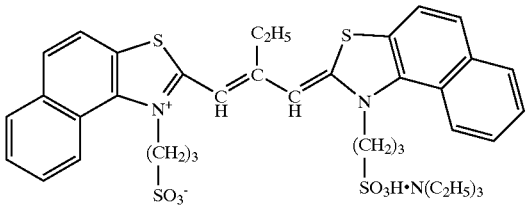
S-44
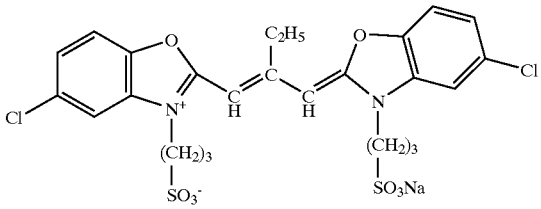

-continued

S-45

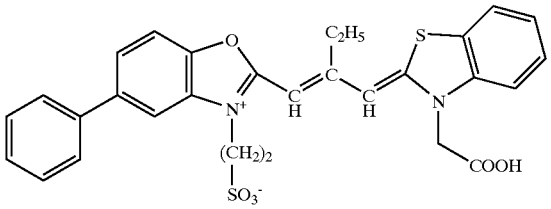

S-46

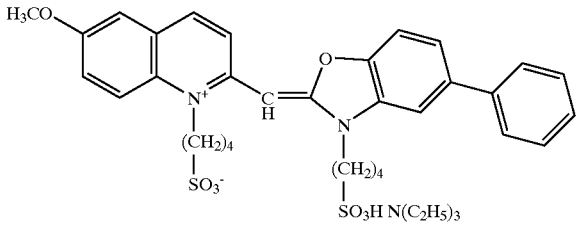

S-47

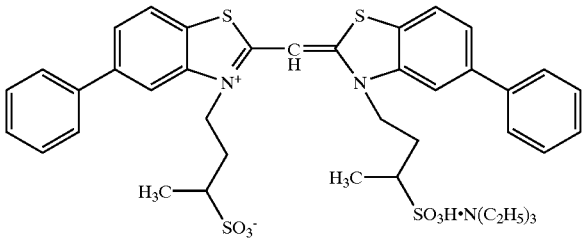

S-48

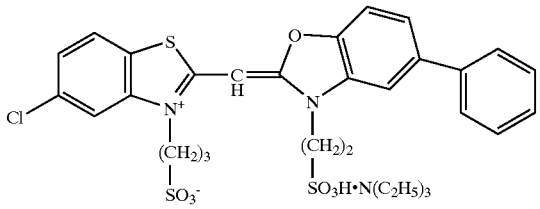

D-11

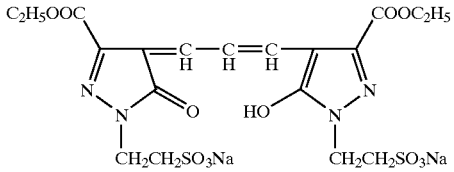

W-41

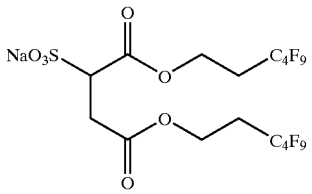

W-42

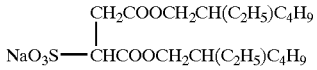

W-43

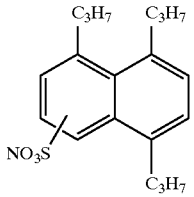

W-44

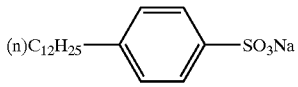

W-45

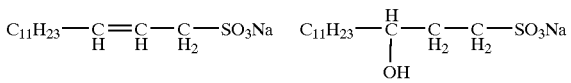

A mixture (60%:40%)

Preparation of Organic Solid Dispersion Dye (Preparation of Fine Crystalline Solid Dispersion 2 of dye E-1)

Water and 15 g of W-45 were added to a wet cake of E-1 (270 g as a net weight of E-1), and the resultant material was stirred to make the material 4000 g. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 2 hr. The beads were filtered off, and this dispersion was diluted to the dye concentration of 3% by the addition of water. Then, the dispersion was heated at 90° C. for 10 hours for stabilization. The average grain size of the dye fine grains was 0.25 μm, and the width of the distribution of grain sizes (standard deviation of grain sizes× 100/average grain size) was 20%.

(Preparation of Fine Crystalline Solid Dispersion 2 of Dye E-2)

Water and 270 g of W-43 were added to 1,400 g of a wet cake of E-2 containing 30 weight % of water, and the resultant material was stirred to form a slurry having an E-2 concentration of 40 weight %. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 8 hr, thereby obtaining a solid fine-grain dispersion of E-2. This dispersion was diluted to 20 weight % by ion exchange water to obtain a fine crystalline solid dispersion 2 of dye Dye E-2. The average grain size was 0.15 μm.

The characteristics of the emulsions used are shown in Table 8, and spectral sensitizing dyes added to the emulsions, the amounts and the addition timing thereof are shown in Table 9.

TABLE 8

| | Configuration of silver halide emulsions | | | | | | | | | | |
|---|---|---|---|---|---|---|---|---|---|---|---|
| | Silver iodobromide emulsions used in sample 401 | | | | | | | | | | |
| | | Av. ESD ESD | COV COV | Av. AgI content content | Structure in halide composition of silver of silver | AgI content at grain surface surface | Other characteristics | | | | |
| Emulsion | Characteristics | (μm) | (%) | (mol %) | halide grains | (mol %) | (1) | (2) | (3) | (4) | (5) |
| A' | Monodispersed tetradecahedral grains | 0.17 | 9 | 3.5 | Triple structure | 2.5 | ○ | ○ | | ○ | |
| B' | Monodispersed (111) tabular grains Av. aspect ratio 3.0 | 0.21 | 13 | 2.5 | Quadruple structure | 2.5 | | | ○ | | |
| C' | Monodispersed (111) tabular grains Av. aspect ratio 4.5 | 0.32 | 12 | 1.8 | Triple structure | 0.1 | | ○ | | ○ | ○ |
| D' | Monodispersed (111) tabular grains Av. aspect ratio 6.0 | 0.32 | 21 | 4.8 | Triple structure | 2.0 | | ○ | | ○ | ○ |
| E' | Monodispersed (111) tabular grains Av. aspect ratio 6.0 | 0.49 | 15 | 2.0 | Quadruple structure | 1.5 | | ○ | | | |
| F' | Monodispersed (111) tabular grains Av. aspect ratio 8.0 | 0.65 | 13 | 1.6 | Triple structure | 0.6 | | ○ | ○ | | ○ |
| G' | Monodispersed cubic grains | 0.14 | 9 | 3.5 | Quadruple structure | 0.3 | ○ | | ○ | ○ | |
| H' | Monodispersed cubic grains | 0.23 | 13 | 1.9 | Quadruple structure | 0.7 | | ○ | | | ○ |
| I' | Monodispersed (111) tabular grains Av. aspect ratio 4.0 | 0.37 | 15 | 3.5 | Quintuple structure | 1.5 | ○ | ○ | | ○ | ○ |
| J' | Monodispersed (111) tabular grains Av. aspect ratio 7.0 | 0.40 | 21 | 2.0 | Quadruple structure | 2.2 | | ○ | | ○ | ○ |
| K' | Monodispersed (111) tabular grains Av. aspect ratio 8.5 | 0.66 | 13 | 1.5 | Triple structure | 1.8 | ○ | ○ | ○ | | ○ |
| L' | Monodispersed tetradecahedral grains | 0.30 | 9 | 7.5 | Triple structure | 0.8 | | | ○ | | ○ |
| M' | Monodispersed tetradecahedral grains | 0.30 | 9 | 7.5 | Triple structure | 2.5 | | ○ | | ○ | |
| N' | Monodispersed (111) tabular grains Av. aspect ratio 3.0 | 0.33 | 18 | 3.5 | Quintuple structure | 5.1 | ○ | ○ | | | |
| O' | Monodispersed (111) tabular grains Av. aspect ratio 5.0 | 0.43 | 9 | 2.5 | Quadruple structure | 1.0 | | ○ | ○ | ○ | ○ |
| P' | Monodispersed (111) tabular grains Av. aspect ratio 9.0 | 0.70 | 21 | 2.8 | Triple structure | 0.5 | ○ | ○ | | | ○ |
| Q' | Monodispersed (111) tabular grains Av. aspect ratio 9.0 | 0.84 | 10 | 1.1 | Quadruple structure | 0.8 | ○ | ○ | | | ○ |
| R' | Monodispersed (111) tabular grains Av. aspect ratio 5.0 | 0.40 | 15 | 8.0 | Quadruple structure | 4.0 | ○ | ○ | | | ○ |
| S' | Monodispersed (111) tabular grains Av. aspect ratio 4.0 | 0.70 | 13 | 12.5 | Quadruple structure | 3.0 | | ○ | ○ | | ○ |
| T' | Monodispersed (111) tabular grains Av. aspect ratio 4.0 | 0.45 | 13 | 10.5 | Quadruple structure | 2.8 | ○ | ○ | | | ○ |

TABLE 8-continued

| Configuration of silver halide emulsions | | | | | | | | | | | |
|---|---|---|---|---|---|---|---|---|---|---|---|
| Silver iodobromide emulsions used in sample 401 | | | | | | | | | | | |
| Emulsion | Characteristics | Av. ESD ESD (μm) | COV COV (%) | Av. AgI content content (mol %) | Structure in halide composition of silver of silver halide grains | AgI content at grain surface surface (mol %) | Other characteristics (1) | (2) | (3) | (4) | (5) |
| U' | Monodispersed (111) tabular grains Av. aspect ratio 4.0 | 0.56 | 15 | 12.5 | Triple structure | 1.5 | | ○ | ○ | | ○ |

Av. ESD = Equivalent sphere average grain size; COV = Coefficient of variation
(Other characteristics) The mark "○" means each of the conditions set forth below is satisfied.
(1) A reduction sensitizer was added during grain formation;
(2) A selenium sensitizer was used as an after-ripening agent
(3) A rhodium salt was added during grain formation.
(4) A shell was provided subsequent to after-ripening by using silver nitrate in an amount of 10%, in terms of silver molar ratio, of the emulsion grains at that time, together with the equimolar amount of potassium bromide
(5) The presence of dislocation lines in an average number of ten or more per grain was observed by a transmission electron microscope.
Note that all the lightsensitive emulsion were after-ripped by the use of sodium thiosulfate, potassium thiocyanate, and sodium aurichloride.
Note, also, a iridium salt was added during grain formation.
Note, also, that chemically-modified gelatin whose amino groups were partially converted to phthalic acid amide, was added to emulsions B', C', E', H', J', N', Q', R', S', and T'.

TABLE 9

| Spectral sensitization of emulsions A' to U' | | | |
|---|---|---|---|
| Emulsion | Spectral sensitizer added | Addition amount per mol of silver halide (g) | Timing of the addition of the spectral sensitizer |
| A' | S-41 | 0.75 | Subsequent to after-ripening |
| | S-42 | 0.15 | Prior to after-ripening |
| | S-43 | 0.10 | Prior to after-ripening |
| B' | S-41 | 0.60 | Prior to after-ripening |
| | S-42 | 0.30 | Prior to after-ripening |
| | S-43 | 0.05 | Prior to after-ripening |
| C' | S-41 | 0.60 | Prior to after-ripening |
| | S-42 | 0.20 | Prior to after-ripening |
| | S-43 | 0.07 | Prior to after-ripening |
| D' | S-41 | 0.70 | Subsequent to after-ripening |
| | S-42 | 0.15 | Subsequent to after-ripening |
| | S-43 | 0.10 | Prior to after-ripening |
| E' | S-41 | 0.75 | Prior to after-ripening |
| | S-42 | 0.30 | Prior to after-ripening |
| | S-43 | 0.15 | Prior to after-ripening |
| F' | S-41 | 0.92 | Prior to after-ripening |
| | S-42 | 0.30 | Prior to after-ripening |
| | S-43 | 0.15 | Prior to after-ripening |
| G' | S-44 | 0.65 | Subsequent to after-ripening |
| | S-45 | 0.10 | Subsequent to after-ripening |
| H' | S-44 | 0.60 | Prior to after-ripening |
| | S-45 | 0.10 | Subsequent to after-ripening |
| I' | S-44 | 0.70 | Prior to after-ripening |
| | S-45 | 0.10 | Prior to after-ripening |
| J' | S-44 | 0.70 | Prior to after-ripening |
| | S-45 | 0.10 | Subsequent to after-ripening |
| | S-46 | 0.08 | Subsequent to after-ripening |
| K' | S-44 | 0.70 | Prior to after-ripening |
| | S-45 | 0.15 | Prior to after-ripening |
| | S-46 | 0.10 | Prior to after-ripening |
| L', M' | S-46 | 0.09 | Subsequent to after-ripening |
| | S-47 | 0.10 | Subsequent to after-ripening |
| | S-48 | 0.51 | Subsequent to after-ripening |
| N' | S-46 | 0.08 | Subsequent to after-ripening |
| | S-47 | 0.15 | Subsequent to after-ripening |
| | S-48 | 0.58 | Subsequent to after-ripening |
| O' | S-47 | 0.20 | Subsequent to after-ripening |

TABLE 9-continued

| Spectral sensitization of emulsions A' to U' | | | |
|---|---|---|---|
| Emulsion | Spectral sensitizer added | Addition amount per mol of silver halide (g) | Timing of the addition of the spectral sensitizer |
| | S-48 | 0.65 | Subsequent to after-ripening |
| P' | S-46 | 0.06 | Subsequent to after-ripening |
| | S-47 | 0.15 | Subsequent to after-ripening |
| | S-48 | 0.70 | Subsequent to after-ripening |
| Q' | S-46 | 0.05 | Prior to after-ripening |
| | S-47 | 0.15 | Prior to after-ripening |
| | S-48 | 0.80 | Prior to after-ripening |
| R' | S-44 | 0.40 | Subsequent to after-ripening |
| | S-46 | 0.30 | Subsequent to after-ripening |
| S' | S-44 | 0.40 | Subsequent to after-ripening |
| | S-46 | 0.30 | Prior to after-ripening |
| T' | S-47 | 0.05 | Prior to after-ripening |
| | S-48 | 0.60 | Prior to after-ripening |
| U' | S-41 | 0.60 | Prior to after-ripening |
| | S-43 | 0.30 | Prior to after-ripening |

Preparation of Em-(xxi)

Dye S-48 was added in an amount optimum for chemical sensitization to emulsion Em-a of Example 1 before chemical sensitization, and caused to act at 40° C. for 20 min. The mixture was heated to 56° C., and in the presence of potassium thiocyanate, optimum gold-sulfur-selenium sensitization thereof was effected with the use of hypo, N,N-dimethylselenourea and chloroauric acid as a sulfur sensitizer, selenium sensitizer, and gold sensitizer, respectively, thereby obtaining emulsion Em-(xxi).

Preparation of Em-(xxii) to Em-(xxvi)

In the same manner as in the preparation of emulsion Em-(xxi), after Dye S-47 was absorbed to emulsions Em-d, Em-f, Em-q, Em-s and Em-t, optimum gold-sulfur sensitization was performed, thereby obtaining emulsions Em-(xxii), Em-(xxiii), Em-(xxiv), Em-(xxv) and Em-(xxvi), respectively.

Samples 402 to 407 were obtained by replacing the emulsion N' of the sample 401 with each of the thus obtained emulsions.

Evaluation of Sample

Evaluation of Speed and Fog

Each of the thus obtained samples 402 to 407 was subjected to wedge exposure through SC-39 filter manufactured by Fuji Photo Film Co., Ltd. wherein use was made of a white light source of 2500 Lux and 4800 K 1/50 sec color temperature, and then to the following development processing. Thereafter, the inverse number (E) of relative exposure amount realizing a yellow color formation density of 0.2 was determined, which was referred to as the yellow color formation speed of each sample. It was ascertained that the yellow color densitiy of the sample 401 was brought about mainly by the emulsion N'. In particular, it was expressed by a relative value providing that the speed of the sample 402 was 100. Further, the yellow color formation maximum density decrement of each of the samples from the yellow color formation maximum density of the sample 402 as a reference was determined. In reversal photosensitive materials, for convenience, this decreased density can be regarded as the fog of each sample. Generally, a decrease of the yellow color formation maximum density invites a fog increase. Evaluation of a fog change during the sample storage was performed by comparing the difference of yellow color formation maximum density between sample having been stored in 45° C./55% humidity environment for 7 days and sample not having been subjected to storage aging with that of sample 402 as a reference. The details and results of the samples are listed in Table 10.

TABLE 10

| Coated sample | Emulsion | Organic electron-donating compound | Relative speed at yellow density of 0.2 | Yellow color maximum density | Change in yellow color maximum density after 7-day storage under 45° C. & 55% | |
|---|---|---|---|---|---|---|
| 402 | Em-(xxi) | — | 100 | Control | Control | Comp. |
| 403 | Em-(xxii) | A-1 | 135 | −0.06 | −0.16 | Comp. |
| 404 | Em-(xxiii) | 6 | 202 | −0.05 | −0.07 | Inv. |
| 405 | Em-(xxiv) | 52 | 212 | −0.06 | −0.09 | Inv. |
| 406 | Em-(xxv) | 55 | 207 | −0.05 | −0.06 | Inv. |
| 407 | Em-(xxvi) | 56 | 215 | −0.04 | −0.06 | Inv. |

The development processing carried out in Example 4 was the same as in Examples 2 and 3 (Development A). It is apparent from Table 10 that the organic electron-donating compounds of the present invention realize higher speed, lower fog and less degree of fog after storage than those of conventional compounds.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. A method of processing a silver halide photosensitive material comprising: processing, with a developer in which a solution physical development arises, the silver halide photosensitive material containing at least one compound selected from the group consisting of compounds of the following types 1 to 4:

(Type 1)

a compound capable of undergoing a one-electron oxidation to thereby form a one-electron oxidation product thereof, wherein the one-electron oxidation product is capable of releasing further two or more electrons accompanying a subsequent bond cleavage reaction;

(Type 2)

a compound capable of undergoing a one-electron oxidation to thereby form a one-electron oxidation product thereof, wherein the one-electron oxidation product is capable of releasing further one electron accompanying a subsequent carbon-carbon bond cleavage reaction, and the compound having, in its molecule, two or more groups adsorptive to silver halide;

(Type 3)

a compound capable of undergoing a one-electron oxidation to thereby form a one-electron oxidation product thereof, wherein the one-electron oxidation product is capable of releasing further one or more electrons after going through a subsequent bond forming reaction; and (Type 4)

a compound capable of undergoing a one-electron oxidation to thereby form a one-electron oxidation product thereof, wherein the one-electron oxidation product is capable of releasing further one or more electrons after going through a subsequent intramolecular ring cleavage reaction.

2. The method of processing a silver halide photosensitive material according to claim 1, wherein the compound of type 1 is represented by the following general formula (1-1) or (1-2), the compound of type 2 is represented by the following general formula (2), the compound of type 3 is represented by the following general formula (3), and the compound of type 4 is represented by the following general formula (4-1) or (4-2):

(1-1)

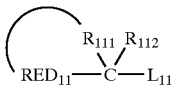

(1-2)

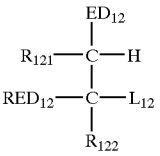

(2)

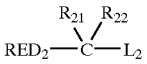

-continued (3)

$$RED_3—L_3—Y_3$$

(4-1)

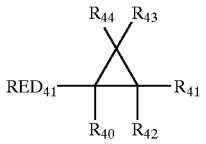

(4-2)

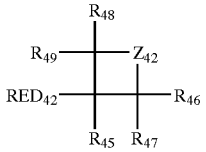

wherein in the general formula (1-1), $RED_{11}$ represents a reducing group; $L_{11}$ represents a split-off group; $R_{112}$ represents a hydrogen atom or substituent; and $R_{111}$ represents a group of nonmetallic atoms capable of forming a cyclic structure corresponding to a tetrahydro form, hexahydro form or octahydro form of a 5-membered or 6-membered aromatic ring (including an aromatic heterocycle) together with the carbon atom (C) and $RED_{11}$, wherein in the general formula (1-2), $RED_{12}$ and $L_{12}$ have the same meanings as those of $RED_{11}$ and $L_{11}$ of the general formula (1-1), respectively; each of $R_{121}$ and $R_{122}$ represents a hydrogen atom or substituent capable of substituting on the carbon atom; and $ED_{12}$ represents an electron-donating group, wherein the groups $R_{121}$ and $RED_{12}$, the groups $R_{121}$ and $R_{122}$, or the groups $ED_{12}$ and $RED_{12}$ may be bonded with each other to thereby form a cyclic structure, wherein in the general formula (2), $RED_2$ has the same meaning as that of $RED_{12}$ of the general formula (1-2); $L_2$ represents a split-off group; and each of $R_{21}$ and $R_{22}$ represents a hydrogen atom or substituent, wherein $RED_2$ and $R_{21}$ may be bonded with each other to thereby form a cyclic structure, provided that the compound represented by the general formula (2) is a compound having, in its molecule, two or more groups adsorptive to silver halide, wherein in the general formula (3), $RED_3$ has the same meaning as $RED_{12}$ of the general formula (1-2); $Y_3$ represents a reactive group having a carbon-carbon double bond moiety or a carbon-carbon triple bond moiety, which moiety being capable of forming a new bond by reacting with a one-electron oxidized $RED_3$, and $L_3$ represents a linking group that links between $RED_3$ and $Y_3$, wherein in the general formulae (4-1) and (4-2), each of $RED_{41}$ and $RED_{42}$ has the same meaning as $RED_{12}$ of the general formula (1-2); each of $R_{40}$ to $R_{44}$ and $R_{45}$ to $R_{49}$ represents a hydrogen atom or substituent; and in the general formula (4-2), $Z_{42}$ represents $—CR_{420}R_{421}—$, $—NR_{423}—$ or —O—, wherein each of $R_{420}$ and $R_{421}$ represents a hydrogen atom or substituent; and $R_{423}$ represents a hydrogen atom, alkyl group, aryl group or heterocyclic group.

3. The method of processing a silver halide photosensitive material according to claim 1, wherein the compound selected from the group consisting of those of types 1 to 4 is one having, in its molecule, an adsorptive group or a partial structure of sensitizing dye.

* * * * *